US010752397B2

(12) United States Patent
Jones et al.

(10) Patent No.: US 10,752,397 B2
(45) Date of Patent: Aug. 25, 2020

(54) COLLAPSIBLE BULK MATERIAL SLEEVE AND CONTAINER

(71) Applicant: RMC Jones LLC, Prior Lake, MN (US)

(72) Inventors: Robert J. Jones, Prior Lake, MN (US); Michael R. Jones, Apple Valley, MN (US)

(73) Assignee: RMC Jones LLC, Prior Lake, MN (US)

( * ) Notice: Subject to any disclaimer, the term of this patent is extended or adjusted under 35 U.S.C. 154(b) by 0 days.

(21) Appl. No.: 16/218,034

(22) Filed: Dec. 12, 2018

(65) Prior Publication Data

US 2020/0189787 A1 Jun. 18, 2020

(51) Int. Cl.

| | |
|---|---|
| ***B65D 5/10*** | (2006.01) |
| ***B65D 5/44*** | (2006.01) |
| ***B65D 77/06*** | (2006.01) |
| ***B65D 88/16*** | (2006.01) |
| ***B65D 5/02*** | (2006.01) |
| ***B65D 5/62*** | (2006.01) |
| ***B65D 88/62*** | (2006.01) |

(52) U.S. Cl.

CPC ..... *B65D 5/10* (2013.01); *B65D 5/029* (2013.01); *B65D 5/445* (2013.01); *B65D 5/62* (2013.01); *B65D 77/062* (2013.01); *B65D 88/1618* (2013.01); *B65D 88/62* (2013.01); *B65D 2519/00597* (2013.01); *B65D 2519/00711* (2013.01)

(58) Field of Classification Search

CPC ..... B65D 5/10; B65D 5/029; B65D 5/445; B65D 5/65; B65D 88/1618; B65D 88/62

See application file for complete search history.

(56) References Cited

U.S. PATENT DOCUMENTS

| | | | |
|---|---|---|---|
| 49,390 | A | 8/1865 | Doolittle |
| 920,637 | A | 5/1901 | Paar |
| 915,455 | A | 3/1909 | Lynch, Jr. |
| 1,044,023 | A | 11/1912 | Colgate |
| 1,139,281 | A | 5/1915 | Hazelton |
| 1,794,821 | A | 3/1931 | Andrews |
| 2,056,956 | A | 10/1936 | Carpenter |
| 2,337,370 | A | 12/1943 | Broadfoot |

(Continued)

OTHER PUBLICATIONS

Pressed Wood Pallets http://uline.com/BL_8203/Pressed-Wood-Pallets retrieved Dec. 4, 2018.

(Continued)

*Primary Examiner* — Derek J Battisti

(74) *Attorney, Agent, or Firm* — Merchant & Gould P.C.

(57) ABSTRACT

A collapsible bulk material container and sleeve configuration thereof are disclosed. The container includes a forming member assembly that provides container rigidity and stability and forms an internal geometric volumetric cavity for containing a bulk material load. A continuously woven sleeve having contiguous woven zones of selectable varied fabric weight and strength engage the forming member and provide the primary containment strength of the container. The sleeve engages the forming member either externally or internally. The sleeve includes a fabric weight zone of greatest strength adjacent the lower portion of the container.

11 Claims, 36 Drawing Sheets

(56) References Cited

U.S. PATENT DOCUMENTS

| | | | | |
|---|---|---|---|---|
| 2,502,586 | A | 4/1950 | Ottinger | |
| 2,503,022 | A | 4/1950 | Benoist et al. | |
| 2,611,526 | A | 9/1952 | George | |
| 2,783,960 | A | 3/1957 | Herz et al. | |
| 3,026,078 | A | 3/1962 | Simkins | |
| 3,041,029 | A | 6/1962 | Brown | |
| 3,123,254 | A | 3/1964 | Rabby et al. | |
| 3,255,720 | A | 6/1966 | Pasquier | |
| 3,256,839 | A | 6/1966 | Peterson et al. | |
| 3,257,068 | A | 6/1966 | Wright | |
| 3,301,200 | A | 1/1967 | Landsiedel | |
| 3,423,009 | A | 1/1969 | Palmer | |
| T886,012 | I4 | 5/1971 | Small | |
| 3,653,578 | A | 4/1972 | Wood | |
| 3,779,448 | A | 12/1973 | Wootten | |
| RE28,439 | E | 6/1975 | Shepherd | |
| 3,896,991 | A | 7/1975 | Kozlowski et al. | |
| 3,937,392 | A | 2/1976 | Swisher | |
| 3,945,493 | A | 3/1976 | Cardinal | |
| 3,957,195 | A | 5/1976 | Lin | |
| 3,983,914 | A | 10/1976 | Benson | |
| 4,013,168 | A | 3/1977 | Bamburg et al. | |
| 4,115,909 | A | 9/1978 | Corella | |
| 4,176,748 | A | 12/1979 | Beane | |
| 4,226,327 | A | 10/1980 | Ballard | |
| 4,308,905 | A | 1/1982 | Gallagher | |
| 4,337,888 | A | 7/1982 | Kudalkar | |
| 4,362,199 | A * | 12/1982 | Futerman | B65D 88/1681 383/17 |
| RE31,191 | E | 3/1983 | Connolly | |
| 4,457,483 | A | 7/1984 | Gagne | |
| 4,538,385 | A | 9/1985 | Kandarian | |
| 4,622,693 | A | 11/1986 | Mykleby | |
| 4,655,366 | A | 4/1987 | Sykes | |
| 4,664,957 | A * | 5/1987 | van de Pol | B65D 88/1618 383/17 |
| 4,666,059 | A | 5/1987 | Nordstrom | |
| 4,703,517 | A * | 10/1987 | Marino | B65D 88/1681 383/7 |
| 4,781,475 | A * | 11/1988 | LaFleur | B65D 88/1612 383/119 |
| 4,850,506 | A | 7/1989 | Heaps, Jr. et al. | |
| 4,868,955 | A | 9/1989 | Magnant et al. | |
| 4,903,431 | A | 2/1990 | Stoll | |
| 4,907,515 | A | 3/1990 | Win | |
| 4,940,820 | A | 7/1990 | Pithouse et al. | |
| 4,997,125 | A | 3/1991 | Glerum | |
| 5,108,196 | A * | 4/1992 | Hughes | B65D 88/1681 383/117 |
| 5,158,369 | A | 10/1992 | Derby | |
| 5,165,568 | A | 11/1992 | Wischusen, III | |
| 5,226,544 | A | 7/1993 | Gallucci et al. | |
| 5,285,957 | A | 2/1994 | Halsell | |
| 5,323,922 | A | 6/1994 | Lapoint, Jr. et al. | |
| 5,340,217 | A | 8/1994 | Rothman | |
| 5,405,006 | A | 4/1995 | Burgdorf et al. | |
| 5,518,168 | A | 5/1996 | Mayer | |
| 5,566,531 | A | 10/1996 | Nordstrom et al. | |
| 5,615,608 | A | 4/1997 | Shaw et al. | |
| 5,690,037 | A | 11/1997 | Hill | |
| 5,758,973 | A | 6/1998 | LaFleur | |
| 5,759,644 | A | 6/1998 | Stanley | |
| 5,772,108 | A | 6/1998 | Ruggiere, Sr. et al. | |
| 5,795,282 | A | 8/1998 | DeMunnik | |
| 5,890,437 | A | 4/1999 | Hill | |
| 5,938,338 | A * | 8/1999 | McDonough | B65D 88/1618 383/24 |
| 6,112,672 | A | 9/2000 | Heil | |
| 6,431,435 | B1 * | 8/2002 | Jones | B65D 5/029 229/109 |
| 6,932,266 | B2 | 8/2005 | Jones et al. | |
| 6,973,882 | B2 | 12/2005 | Baechle et al. | |
| 7,219,609 | B1 | 5/2007 | Utz et al. | |
| 7,328,833 | B1 | 2/2008 | Wiley | |
| 7,434,721 | B2 | 10/2008 | Feltz | |
| 7,516,706 | B2 | 4/2009 | Creighton et al. | |
| 7,644,665 | B2 | 1/2010 | Creighton et al. | |
| 7,793,828 | B2 | 9/2010 | Booth et al. | |
| 8,221,869 | B2 | 7/2012 | Pare | |
| 8,251,209 | B2 | 8/2012 | Shiao | |
| 8,256,621 | B2 | 9/2012 | Deiger et al. | |
| 8,397,916 | B1 | 3/2013 | Cassidy et al. | |
| 8,814,031 | B2 | 8/2014 | Graham et al. | |
| 8,978,964 | B1 * | 3/2015 | Ruggiere, Sr. | B65D 5/445 229/164.1 |
| 9,296,511 | B2 | 3/2016 | Jones et al. | |
| 10,065,782 | B1 | 9/2018 | Jones et al. | |
| 10,071,842 | B2 | 9/2018 | Jones et al. | |
| 2002/0048415 | A1 | 4/2002 | Derby et al. | |
| 2003/0123757 | A1 | 7/2003 | Cholsaipant | |
| 2004/0081374 | A1 | 4/2004 | Richardson, Jr. et al. | |
| 2005/0045639 | A1 | 3/2005 | Thorpe | |
| 2005/0196080 | A1 | 9/2005 | Stone et al. | |
| 2006/0027638 | A1 | 2/2006 | Jones et al. | |
| 2008/0083354 | A1 | 4/2008 | Markert et al. | |
| 2008/0196633 | A1 | 8/2008 | Ho | |
| 2008/0251654 | A1 | 10/2008 | Campbell | |
| 2013/0228574 | A1 | 9/2013 | Hill | |
| 2018/0126661 | A1 * | 5/2018 | Dunlap | B29C 66/8163 |

OTHER PUBLICATIONS

New Wood Pallets http://uline.com/BL_817/New-Wood-Pallets retrieved Dec. 4, 2018.

Block Wood Pallets http://uline.com/BL_718/Block-Pallet retrieved Dec. 4, 2018.

Rackable Pallets http://uline.com/BL_8204/Rackable-Pallet retrieved Dec. 4, 2018.

Aluminum Pallets http://uline.com/BL_367/Aluminum-Pallets retrieved Dec. 4, 2018.

Galvanized Steel Pallet http://uline.com/BL_2298/Galvanized-Steel-Pallet retrieved Dec. 4, 2018.

Heavy Duty Nestable Pallet http://uline.com/BL_8208/Heavy-Duty-Nestable-Pallet retrieved Dec. 4, 2018.

Solid Top Rackable Pallets http://uline.com/BL_1417/Solid-Top-Rackable-Pallets retrieved Dec. 4, 2018.

* cited by examiner

COLLAPSIBLE BULK MATERIAL SLEEVE AND CONTAINER

FIELD OF THE INVENTION

This invention relates generally to shipping and storage containers for bulk, liquid, granular or semi-fluid materials that are collapsible and/or reusable or recyclable. More particularly, the invention relates to bulk material handling containers of the type generally shown and described in U.S. Pat. No. 6,932,266 entitled COLLAPSIBLE BULK MATERIAL CONTAINER, issued on Aug. 23, 2005; U.S. Pat. No. 9,296,511 entitled COLLAPSIBLE, REUSABLE STORAGE CONTAINER issued on Mar. 29, 2016; and U.S. Pat. No. 10,071,842 entitled APPARATUS, KIT AND METHOD OF ASSEMBLY OF A COLLAPSIBLE BULK MATERIAL CONTAINER issued on Sep. 11, 2018, all fully incorporated herein by reference.

BACKGROUND OF THE INVENTION

General descriptions of known configurations of bulk material containers are detailed in the above-referenced U.S. Pat. Nos. 6,932,266; 9,296,511 and 10,071,842.

Several of such bulk material containers are illustrated herein in FIGS. 1-11, and are generally described below. Referring to FIGS. 1-10, a first configuration of a bulk material container 10 generally includes a forming member 12, a locking mechanism 12*a*, an outer sleeve 14 and optionally an inner liner 16. The forming member 12 is typically constructed of relatively inexpensive lightweight corrugated material that can be operatively configured to define an internal geometric volumetric shape that defines the bulk material storage portion of the container 10. The forming member and locking assembly are collapsible for storage and transport before use and are easily unfolded and shaped to form an operable box-like container configuration as shown in FIGS. 1-7, and also provides structural support for enabling stacking of loaded/filled containers.

The forming member 12 has a plurality of interconnected sidewalls 12*b* that are configurable to form a closed perimeter of the internal geometric volume. The bottom edges 17 of the sidewalls 12*b* are designed to be supported on and carried by a pallet. A locking assembly maintains the forming member sidewalls in predetermined fixed position relative to one another when the container is empty. While the locking mechanism can be physically separable from the sidewalls, in the embodiments shown in FIGS. 1-7, the locking assembly comprises lower extension portions 12*a* of the sidewalls 12*b* that fold inwardly along the bottom edges 17 of the sidewalls and overlap with one another to form a bottom surface of the container and of the internal geometric volume. At least some of the inwardly folded sidewall extensions 12*a* have slots generally shown at 18 for cooperatively receiving and interconnecting with edges or other portions of the folded sidewall extensions, forming a locking assembly of the sidewall extensions. The locking assembly initially maintains the sidewalls in predetermined fixed relationship to one another around the defined internal volume when operatively assembled, and prevents the sidewalls 12*b* from riding or sliding upward in a direction away from the bottom of the forming member during filling of the container.

As described in the U.S. Pat. No. 6,932,266, an optional bag/liner illustrated at 16 in FIG. 1 may be inserted within the internal geometric volumetric shape of the forming member to accommodate the particular bulk material with which the container will be used. The bag/liner 16 may, for example, protect the contents of the container system and/or prevent leakage or sifting of powders out of the forming member. Such bags/liners are well-known in the art.

A sleeve member 14 is sized to cooperatively and snugly engage and circumferentially surround all or substantially all of the entire outer peripheral sidewall portions 12*b* of the forming member 12. The sleeve 14 is preferably configured in a continuous manner from a flexible, woven fiber material known for its strength and light weight. The sleeve is sized to extend down to and beyond the lower edges 17 of the sidewalls 12*b*. In the container embodiment illustrated in FIGS. 1-3, the lower portion of the sleeve 14 that extends beyond the lower edges 17 of the sidewalls 12*b* is folded back up along the sidewalls, as shown at 15, to provide additional strength along the lower portions of the sidewalls.

In the container embodiments illustrated in FIGS. 4-7, those portions 19 of the sleeve 14 that extend beyond the lower edges 17 of the sidewalls 12*b* are folded inwardly under the lower edges 17 of the sidewalls 12*b* and engage the lower surfaces of the sidewall extension portions 12*a* forming the locking assembly and the bottom of the container. The sidewall extension members interlock with one another by means of angled slot configurations generally shown at 18. Referring to the container embodiments shown in FIGS. 4-7, it can be observed that when the lower extension members 12*a* are operatively folded to form the container bottom and locking assembly, portions of the extension members 12*a* horizontally overlap one another forming several vertical gaps or void areas G between overlapping surfaces of the extensions 12*a*. As the sleeve 14 is folded under the lower edges 17 of the sidewalls 12*b*, excess sleeve material gathers under the bottom of the container adjacent the corners of the forming member. The excess sleeve material is typically tucked into the gaps or void areas G as illustrated at 19*a*. As described in the U.S. Pat. No. 6,932,266, tucking the excess sleeve material under the forming member and into the gaps G helps to counteract undesired upward sliding movement of the sleeve 14 along the sidewalls 12*b* as upward pressure is exerted on the forming member and sleeve as bulk material is loaded into the container. As the weight of the bulk material loaded into the container increases, downward pressure exerted by the material on the lower extension members 12*a* of the forming member vertically compresses the sleeve material in the gaps G between the overlapping extension members 12*a*, tightly sandwiching and holding the sleeve member there between as the pressure from the bulk material increases.

The bulk container embodiment of FIGS. 4 and 5 illustrates the lower portion 19 of the sleeve 14 being directly folded under the locking assembly sidewall extension 12*a* and into the gap G as shown at 19*a*. In the cross-sectional view of the bulk material container embodiment illustrated in FIG. 6, the length of the sleeve portion 19' that extends beyond the lower edge 17 of the forming member sidewalls 12*b* is significantly longer than that of the previously described embodiment such that the lower folded part of the extended sleeve 19' can be folded back upon itself before being tucked into the gap G as shown at 19*a*' before the free end of the sleeve is returned along the bottom of the container and back up the outer sidewall as shown at 15'. The double sleeve layer 15' along the container sidewall provides added sleeve strength adjacent the bottom portion of the container, where the bulk material applied forces are the greatest. The folded up sleeve portion 15' preferably extends from about 20% to 50% of the height of the sidewalls 12*b*, and more preferably from about 20% to 30% of the height of the sidewalls.

Yet another bulk container configuration wherein the sleeve 14" is tucked into the gap G is illustrated in FIG. 7. Referring to FIG. 7, the lower sleeve portion 19" is first folded back upon itself and back up along the outer sidewall 14" as illustrated at 15" and then returned back along the bottom surface of the container as a solo layer of sleeve material that is tucked into the gap G as illustrated at 19*a*. This configuration provides a triple layer of sleeve material that extends upward along the lower portions of the sidewalls to provide additional strength along the lower surface area portions of the sidewalls. Understandably, the sleeve configurations illustrated in FIGS. 6 and 7 require considerably more sleeve 14 material than the sleeve configuration illustrated in FIGS. 4 and 5.

The above described containers 10 of FIGS. 1-7 all have the same general configurations of forming members 12, locking assemblies 12*a*, and sleeves 14. They only differ in how the lower excess sleeve material (15, 19) that extends beyond the bottom edge 17 of the forming member sidewalls 12*b*, is folded, either under the container bottom (19, 19', 19") and/or back up along the lower portion of the sidewalls (15, 15', 15"). The general construction of the woven fabric sleeve, however, remains the same. The U.S. Pat. No. 10,071,842 describes an improved variation of the container configuration of FIGS. 4 and 5 which provides a securement feature for insuring that the folded-over sleeve portion 19 remains secured to the bottom locking assembly 12*a* surface during moving and handling of the assembled container prior to its loading with bulk material. In the embodiment described in the U.S. Pat. No. 10,071,842, that sleeve securement feature is provided by pairs of cooperatively engageable fasteners on the sleeve and locking assembly portions of the container. That structure is shown in the container configuration 10A of FIGS. 8-10. For ease of comparison the same number designations for similar portions of the containers 10 of FIGS. 4, 5 and the container 10A of FIGS. 8-10 have been used, with added numerical designations being provided for the sleeve securement coupling portions of the container 10A.

Referring to FIGS. 8-10, the cooperatively coupled connectors are located on the inwardly folded locking assembly extension members 12*a* and on the lower portion 19 of the sleeve 14. The sleeve 14 illustrated in FIG. 8 extends between upper 14*a* and lower 14*b* edges and has a plurality of slots 6 peripherally strategically spaced adjacent the lower portion 19 of the sleeve 14, which extends below the lower edges 17 of the forming member sidewalls 12*b*. The lower extension portions 12*a* of the forming member sidewalls 12*b*, which are folded inwardly in interlocking manner to form the locking assembly of the container 10A have a plurality of outwardly projecting tab members 7 that are arranged, sized and configured to cooperatively slide within the sleeve slots 6 so as to retainably engage and hold the lower portion 19 of the sleeve 14 when it is inwardly folded under the locking member segments 12*a*, as described more fully in the U.S. Pat. No. 10,071,842. FIG. 9 illustrates the container 10A in inverted position, portraying the bottom of the container with its interlocked locking assembly segments 12*a* and the sleeve 14 pulled downwardly and cooperatively engaging the forming member sidewalls 12*b* with the sleeve lower portion 19 containing the slots 6 extending beyond the bottom edges 17 of the sidewalls 12*b* prior to folding of the sleeve inwardly against the bottom surfaces of the locking assembly segments 12*a*, and prior to cooperative engagement of the locking assembly tab portions 7 with the sleeve slots 6. FIG. 10 illustrates the bottom of the container 10A with the tabs 7 of the locking assembly portions 12*a* cooperatively engaging the sleeve 14 through its slots 6 and tautly securing the lower portion 19 of the sleeve 14 to the bottom of the container. As explained in the U.S. Pat. No. 10,071,842, the excess sleeve material that gathers between adjacent facing tabs 7 along the bottom of the container after the sleeve is folded under and secured to the locking assembly segments, is tucked into the gaps formed by the overlapping locking assembly segments 12*a*, in the areas generally illustrated by the arrows G in FIG. 10. The tab 7 and slot 6 fasteners retain the sleeve in its operative position and prevent the sleeve from being dislodged and allowed to ride up along the container sidewalls prior to loading of bulk material into the container.

The examples of known bulk material containers described above, employ forming members, typically of corrugated material, surrounded and engaged by a woven fabric sleeve. The forming member defines the geometric volumetric shape and configuration of the container and prevents structural rigidity and stabilizing support for enabling stacking of loaded containers. The sleeve material that snugly engages the forming member sidewalls assumes the defined geometric shape of the engaged outer surface areas of the forming member and provides the necessary strength for containing the bulk material within the container, by counteracting the outward radial forces applied by the contained bulk material against the inner surfaces of the forming member.

In the above examples, the sleeve surrounds the forming member. However, the present invention is not limited to bulk material containers having such configurations. The forming member component can also be arranged and configured externally of the strength providing woven fabric, such as for example, shown and described in the inventor's prior U.S. Pat. No. 9,296,511. The U.S. Pat. No. 9,296,511 describes a collapsible reusable bulk material container having an outer open architecture forming member framework that defines the outer geometric shape and volumetric properties of the container, into which is inserted a continuously woven fabric sleeve or bag material that provides the primary bulk material containment strength of the container. Such external framework container can be used, for example, in place of conventionally used solid wall drum containers and as was the case of the previously described bulk containers with outer sleeve members, provides collapsibility for compact storage or space saving shipment to use sites.

FIG. 11 generally illustrates in exploded view, one example of a collapsible bulk material container 10B having an external forming member framework that surrounds an internal sleeve or bag of continuously woven material, described in more detail in the U.S. Pat. No. 9,296,511. Referring to FIG. 11, the container 10B generally includes an external framework forming member assembly 12' and a woven fiber sleeve or bag 14''' cooperatively insertable and contained within the forming member assembly 12', to contain a volume of bulk material. As with the previously described prior art bulk material container configurations, the forming member assembly 12' defines the geometric configuration and shape of the container, while the internal sleeve 14''' provides the container's primary bulk material containment strength for counteracting the outward radial forces applied by the bulk material to the container. The forming member assembly 12' includes a lower base member 50, an upper ring member 52, an intermediate band member 59, a plurality of lower post members 55 and a plurality of upper post members 57. The components forming the framework 12' are cooperatively detachably connected together and interlocked to form a generally rigid framework structure. The bottom portions of the lower support post members 55 mount to the lower base member 50 and are guided by and pass through inside portions of the intermediate band member 59. The lower ends of the upper post members 57 have receptor portions that receive and connect to upper portions of the lower post members 55, and form rigid longitudinal extensions of the lower post members. The upper/distal ends of the upper post members 57 are peripherally secured to inner post receptor portions of the upper ring member 52 to complete formation of the generally rigid, open architecture forming member framework 12'. The woven fiber support sleeve or bag 14''' is operatively positioned within the internal cavity defined by the forming member framework 12' and is attached to and hung from fastener portions of the upper ring 52 by cooperatively aligned fastener loops 8 of the sleeve/bag 14'''. The sleeve 14''' can be open bottomed and have a length sufficient for its bottom portion to be folded over in resting manner on the upper surface of the base member 50, to form a bottom of the sleeve's internal cavity. A bottom panel of woven material can alternatively be sewn to the lower portion of the tubular sleeve to form a bag-like bottom of the sleeve that would rest upon the upper surface of the base member 50. As with previously described bulk material containers, an optional poly bag (not shown) may be inserted within the woven fiber support sleeve/bag 14''' to isolate contained bulk material from direct contact with the sleeve/bag material. A top cover 60 is detachably secured to the upper ring 52 by means of a tightening band 65 to close external access to the support sleeve/bag 14''', providing sealing closure to the bulk material container.

Bulk container assemblies of the type generally described above with respect to prior art configurations have been well received in the marketplace and have been used by a wide variety of customers for containing a wide range of different bulk materials. Such diversified use has uncovered aspects of embodiments, configurations and features of the bulk material container assemblies that could be improved upon for improved operation and/or for meeting competitive marketplace demands.

As described above, a number of such bulk material container improvements have already been made. Proper positioning of the support sleeve relative to an underlying forming member has been addressed. Folding over portions of the sleeve below the container bottom and tucking portions of the sleeve between overlapping portions of the locking assembly helps to keep the sleeve from riding up the container sidewalls during and after filling of the container. Positively securing underlying portions of the sleeve to the container bottom using cooperatively engaging fasteners helps to prevent the sleeve from moving out of its preferred operative position due to handling and moving of an assembled container before it is filled with bulk material. Arranging portions of the sleeve to form multiple overlapping sleeve layers along lower portions of the container sidewalls have addressed the issue of strengthening sleeve support where the sleeve strength is most required, to prevent rupture of the container sidewalls or sleeves.

Even in view of such improvements, there is still room for improving bulk material container configurations. One such area relates to improvement of the support sleeve. The sleeve material has traditionally been woven from material of uniform strength. No known bulk material containers have employed continuously woven support sleeves having material of selectively varied strength, configured to provide increased strength in those sleeve regions where additional strength is most required. The present invention addresses this unmet need of bulk material containers.

SUMMARY OF THE INVENTION

This invention uses existing industry accepted packaging materials to form a unique bulk material container system that is universally applicable to the packaging of solid, semi-solid, granular or liquid materials. The bulk material container system of this invention comprises the advantageous features of known packaging techniques in a unique manner, without suffering their respective shortcomings.

The bulk material container generally includes a forming member that provides shape to the container and structural support for enabling stacking of loaded/filled containers, and also defines an internal geometric volumetric cavity of the container that is configured to receive the bulk material to be contained.

A tubular sleeve or bag of continuously woven fabric provides the primary strength support of the container and counteracts the radial forces applied by the contained bulk material, to the forming member, and also enables the forming member components to be constructed of lighter weight and less costly materials. The sleeve is operatively configurable to engage the forming member either externally or internally. Since the contained bulk material necessarily exerts larger radial outward forces near the lower sidewall portions of the container's forming member than are exerted on those portions of the forming member sidewalls located closer to the top of the container, it is desirable for the sleeve to be configured to counteract such variably applied radial forces. To address this concern, the sleeve is selectively woven with zones of fabric of differing strength or weight and is configured such that the fabric zones of greatest strength are operatively positioned along lower portions of the sleeve which are configured to operatively support the forming member in those portions thereof lying adjacent the lower outer walls of the container. The sleeve fabric is preferably woven from a polypropylene material that can be embedded with a resin coating of either polypropylene or polyethylene. The bulk material container is preferably configured to be operatively collapsible from an assembled configuration for containing bulk materials, to a disassembled collapsed configuration for ease of transport or storage or recycling.

According to one aspect of the invention, there is provided a collapsible bulk material container for containing a load of bulk material, comprising: (a) a collapsible forming member arranged and configured to provide a desired rigidity and shape to the container, comprising: (i) vertical support members extending between lower and upper ends; and (ii) a locking assembly cooperatively engaging the vertical support members to operatively configure and fix predetermined peripheral relative positions of the support members and to form therewith an internal geometric volumetric cavity to receive a load of bulk material; and (b) a support sleeve of continuously woven fabric material operatively engaging the forming member and configured to surround the internal geometric volumetric cavity to provide primary containment support for the bulk material container in countering outward radial forces applied to the forming member by the bulk material contained within the cavity, wherein the sleeve has a plurality of transverse contiguous zones of the continuously woven fabric extending from an upper edge to a lower edge of the sleeve, wherein the zones have selective fabric weights and strengths, with at least one fabric zone of greater strength than other zones, which extends along the sleeve location that operatively engages the forming member vertical support members adjacent a lower end thereof and extends upwardly therefrom to a sleeve location that engages the vertical support members at an intermediate position between the lower and upper ends of the vertical support members, to provide larger containment strength along lower portions of the container.

According to another aspect of the invention, the forming member locking assembly at least in part, engages the vertical support members along their lower edges, and is configured to form a bottom of the forming member and of the internal cavity of the container. According to it a further aspect of the invention, the woven sleeve fabric comprises polypropylene material which can be impregnated with a coating of polypropylene or polyethylene resin to provide added strength and waterproofing properties to the sleeve material.

According to a further aspect of the invention, the support sleeve is configured to snugly engage and overlie substantially the entire outer surfaces of those portions of the vertical support members of the forming member, that form the internal geometric volumetric cavity of the container. Further, the vertical support members of the forming member may comprise interconnected sidewalls extending between the lower and upper edges, such that the support sleeve snugly engages and overlies substantially the entire outer surfaces of the sidewalls. The sidewalls may comprise a single piece of material such as a corrugated material.

According to yet a further aspect of the invention, the forming member may comprise a detachable rigid framework of open architecture, and wherein the support sleeve is arranged and configured to lie within the internal cavity created by the framework so as to operatively engage inner surfaces of the framework. According to one configuration of such forming member framework, the framework resembles a drum shaped container having rigid upper and lower surface portions that enables stacking and movement of the containers, without requiring a supporting pallet. The component portions of the framework are preferably detachable from one another such that the upper and lower surface forming portions of the framework, when detached, can be operatively connected to one another to form a collapsed container configuration that can house the remaining detached components of the container to provide a unified collapsed container that can be easily handled and stacked for storage or transport.

According to further aspects of the invention, the support sleeve zone woven with fabric of heaviest weight and strength is preferably configured to extend upward from a bottom portion of the container to a distance up along the sidewalls of the container that is from about at least 20% to 50% of the overall sidewall length or height. The zoned sleeve configuration applies to sleeves that extend below the bottom of the container, which can be folded under and secured to the bottom of the container, including such configurations wherein the folded under portion of the sleeve may be configured with couplable fastener members that can be secured to cooperatively matable fasteners on the outer bottom portion of the forming member of the container. The sleeve material may also include other features such as longitudinally extending inner sleeve circumference adjustment tails of material formed by post weaving bonding of inner surfaces of the sleeve to one another in face-to-face relationship to form one or more adjustment tails of material longitudinally extending along the outer surface of the sleeve, wherein the adjustment tail(s) accurately size the inner circumference of the sleeve to insure snug engagement of the sleeve with the underlying forming member.

According to yet another aspect of the invention there is provided a support sleeve of continuously woven fabric material for supplying the primary containment strength of a collapsible bulk material container of a type having a forming member surface portion arranged and configured to provide the container with a desired rigidity and shape, and to form an internal geometric volumetric cavity for receiving the bulk material to be contained by the container, wherein the sleeve comprises: (a) a sleeve of fabric material having a sleeve length longitudinally extending between upper and lower edges, that is sized to substantially engage the forming member surface portion that forms the internal cavity of the bulk material container; (b) wherein the sleeve is continuously woven from longitudinally extending warp threads of a uniform weight and strength, intertwined with weft threads woven generally perpendicularly to the warp threads and having selectively varying weights and strengths; (c) wherein the sleeve has a plurality of contiguous fabric zones of selectable fabric weights and strengths along the sleeve length, wherein the fabric zones have width dimensions measured in the longitudinal sleeve length direction; and wherein the fabric weights of at least two of the fabric zones differ from each other; and (d) wherein the collective sleeve fabric zone weights are selected and arranged to sufficiently counter radial forces applied by contained bulk material of the bulk material container for which the sleeve is designed to provide primary strength support. According to yet a further aspect of the invention, the fabric weight of that fabric zone extending up from the lower edge of the sleeve is greater than that of the contiguous fabric zone positioned above it along the length of the sleeve, such that the containment strength of the sleeve is selectively greater along the bottom portion of the sleeve, which receives the greatest radial forces from the contained bulk material. According to yet a further aspect of the invention, the fabric zone containing sleeve described above can be configured with a sleeve length that includes a lower extension portion sized to extend below a lower edge of the container forming member surface portion that defines the bulk material containment cavity, wherein the lower extension portion of the sleeve is intended in use to be folded inwardly along a bottom portion of the container. According to a further aspect of the invention, the lower sleeve extension portion may include fastener portions for securing the sleeve lower extension portion to the bottom of the container. According to yet a further aspect of the invention, the woven support sleeve comprises a bag having a bottom that closes the sleeve at its lower sleeve edge. The sleeve fabric is preferably woven from polypropylene material, which may be further embedded with either polypropylene or polyethylene resin materials to enhance the strength and waterproof properties of the sleeve fabric. That fabric zone portion of the sleeve having the greatest strength peripherally extends from the lower edge of the sleeve that is coterminous with the bottom of the container, up to at least from about 20% to 50% of the total longitudinal length of the sleeve. According to yet a further aspect of the invention, the support sleeve woven with a plurality of selective weight fabric zones may include one or more longitudinally extending circumference adjustment tails formed by the continuous sleeve material and extending along the sleeve length, wherein the adjustment tail(s) are formed by a bonding strip extending along one longitudinal edge of the sleeve when in a flattened configuration, with opposed inner surfaces of the sleeve engaging one another in face-to-face relationship with the bonding strip fixedly bonding the opposed engaged inner surfaces of the sleeve to one another to accurately define an adjusted inner circumference dimension of the sleeve that is less than an initial sleeve inner circumference dimension that existed prior to forming of the adjustment tail(s) of the sleeve.

According to yet another aspect of the invention there is provided a support sleeve of continuously woven fabric material for providing primary containment strength to a collapsible bulk material container of a type having a forming member surface portion arranged and configured to provide a container with a desired rigidity and shape, and to form an internal geometric volumetric cavity for receiving the bulk material to be contained by the container, wherein the sleeve comprises: (a) a sleeve of fabric material having a sleeve length longitudinally extending between upper and lower edges, that is sized to substantially engage the forming member surface portion that forms the internal cavity of the bulk material container; (b) wherein the sleeve fabric is continuously woven from longitudinally extending polypropylene warp threads of a first uniform weight and strength, intertwined with polypropylene weft threads woven generally perpendicularly to the warp threads and having a second uniform weight and strength that are greater than those of the warp threads; and (c) wherein the sleeve fabric has a woven material strength sufficient to counter radial forces applied by contained bulk material of the bulk material container for which the sleeve is designed to provide strength support. According to yet a further aspect of the invention, the polypropylene woven sleeve material can be embedded with a coating of polypropylene or polyethylene resin material.

These and other features of the invention will become apparent from a more detailed description of preferred embodiments of the invention, as described below.

BRIEF DESCRIPTION OF THE DRAWING

Referring to the Drawing, wherein like numerals represent like parts throughout the several views.

DETAILED DESCRIPTION OF THE PREFERRED EMBODIMENTS

One embodiment of a bulk material container assembly incorporating the principles of this invention will be described below with reference to FIGS. 12-25. Descriptions of alternative bulk material container embodiments, of their use and construction, of the materials that are usable to construct the container assembly, and other alternatives applicable to the invention are described in more detail in the fully incorporated by reference U.S. Pat. Nos. 6,932,266; 10,071,842 and 9,296,511.

Figure 12:
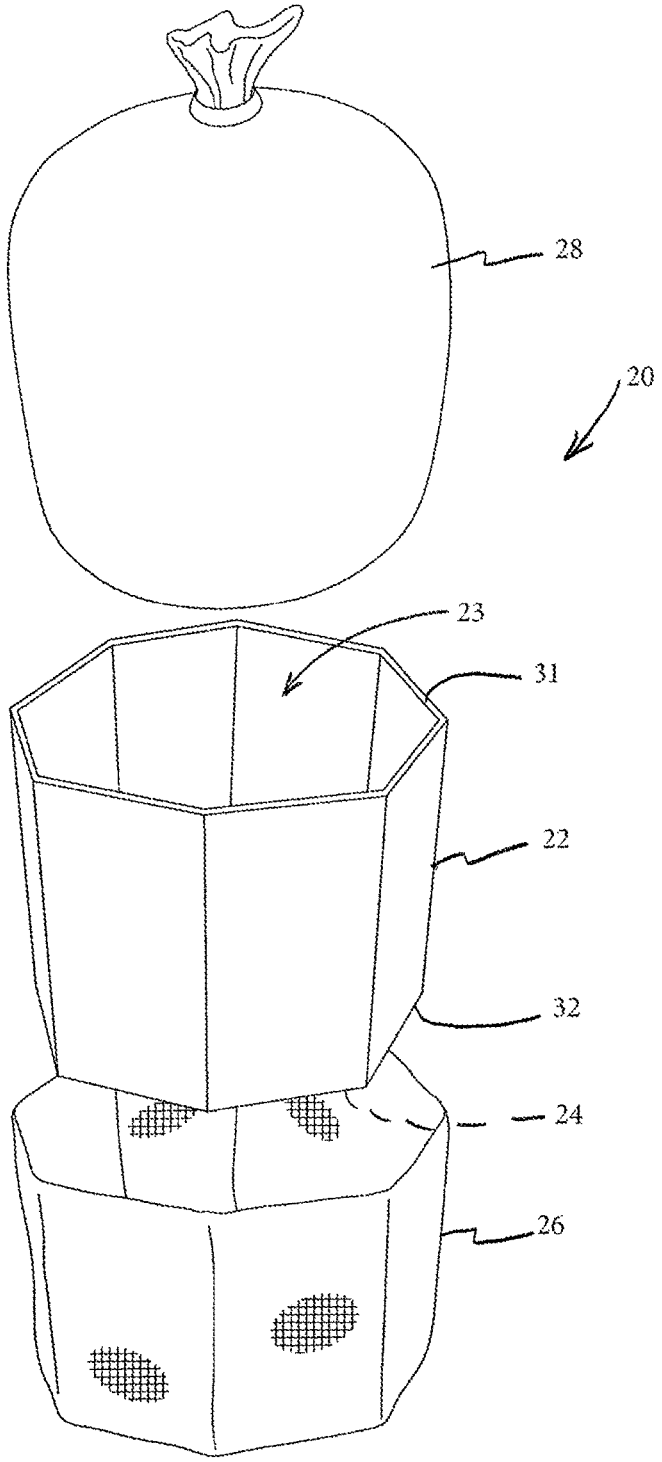
FIG. 12 is an exploded perspective view of one embodiment of a bulk material container assembly configured according to this invention, having a forming member with a shape defining locking assembly, an outer sleeve member and an optional bag/liner.

Referring to FIG. 12, a bulk material container assembly is generally illustrated at 20. For ease of description, the bulk material container assembly will hereinafter be referred to as "the container". The container 20 generally includes a forming member 22, a locking assembly or mechanism 24, an outer support sleeve 26 and an optional inner liner 28. The forming member 22 provides a defined geometric shape and structural stability to the container, while the sleeve 26 is sized to cooperatively and snugly engage and circumferentially surround at least substantially the entire outer surface area of the forming member sidewalls 22 and provides the primary bulk material containment strength for the container. An optional inner bag/liner 28 is generally placed within the forming member 22 and directly contacts the contained bulk material, to protect the container contents from contamination and/or to retain flowable or liquid contents from leaving or leaking out of the container. Except for the selective fabric weight weaving configuration of the sleeve material, hereinafter discussed in more detail, the bulk material container 20 is virtually the same as that of the container disclosed in U.S. Pat. No. 10,071,842 herein fully incorporated by reference.

The forming member 22 is preferably configured from a relatively light-weight corrugated material which can, for example, be either of cellulose or plastic construction. When collapsed for shipment to a user, the forming member can be configured as a single planar sheet (FIG. 13), or, depending upon the particular construction, folded over onto itself in a collapsed manner (FIGS. 17 and 18). The forming member is folded along a plurality of fold lines, shown as dashed lines 30, 32 in FIG. 13 to form a plurality of adjoining upright sidewalls configured to form a closed perimeter shell as shown in FIG. 12. Closed perimeter forming member sidewalls define with a lower surface, an internal geometric 23 volumetric shape that defines the bulk material storage portion of the container. The bottom edges 32 of the forming member sidewalls are designed to be supported and carried by a pallet. While a pallet can contain more than one of the containers, typically the container is sized and configured to be carried by a single pallet. The locking mechanism maintains the forming member sidewalls in predetermined upright fixed position relative to one another when the container is empty. While the locking mechanism can be physically separable from the sidewalls, in the embodiment illustrated FIGS. 12-25, the locking mechanism or assembly comprises lower extension portions of the forming member's sidewalls, generally illustrated at 24 in FIG. 13. The lower extension locking portions 24 of the sidewalls fold inwardly along the bottom edges 32 of the sidewalls and overlap and interconnect with one another to fix and maintain the forming member sidewalls in predetermined spatial relationship with one another when operatively assembled, hereinafter described, around the defined internal geometric volumetric shape or cavity 23. The interlocking lower locking assembly portions 24, when operatively assembled, also form and define a bottom surface of the container. Besides fixing the geometric footprint formed by the sidewalls, the locking assembly also prevents the sidewalls from riding or sliding upwardly, away from the bottom of the forming member during filling or transporting of the container. For additional details, description of materials and design considerations relating to bulk material containers of the general type described herein, the reader is referred to U.S. Pat. No. 6,932,266.

Figure 13:
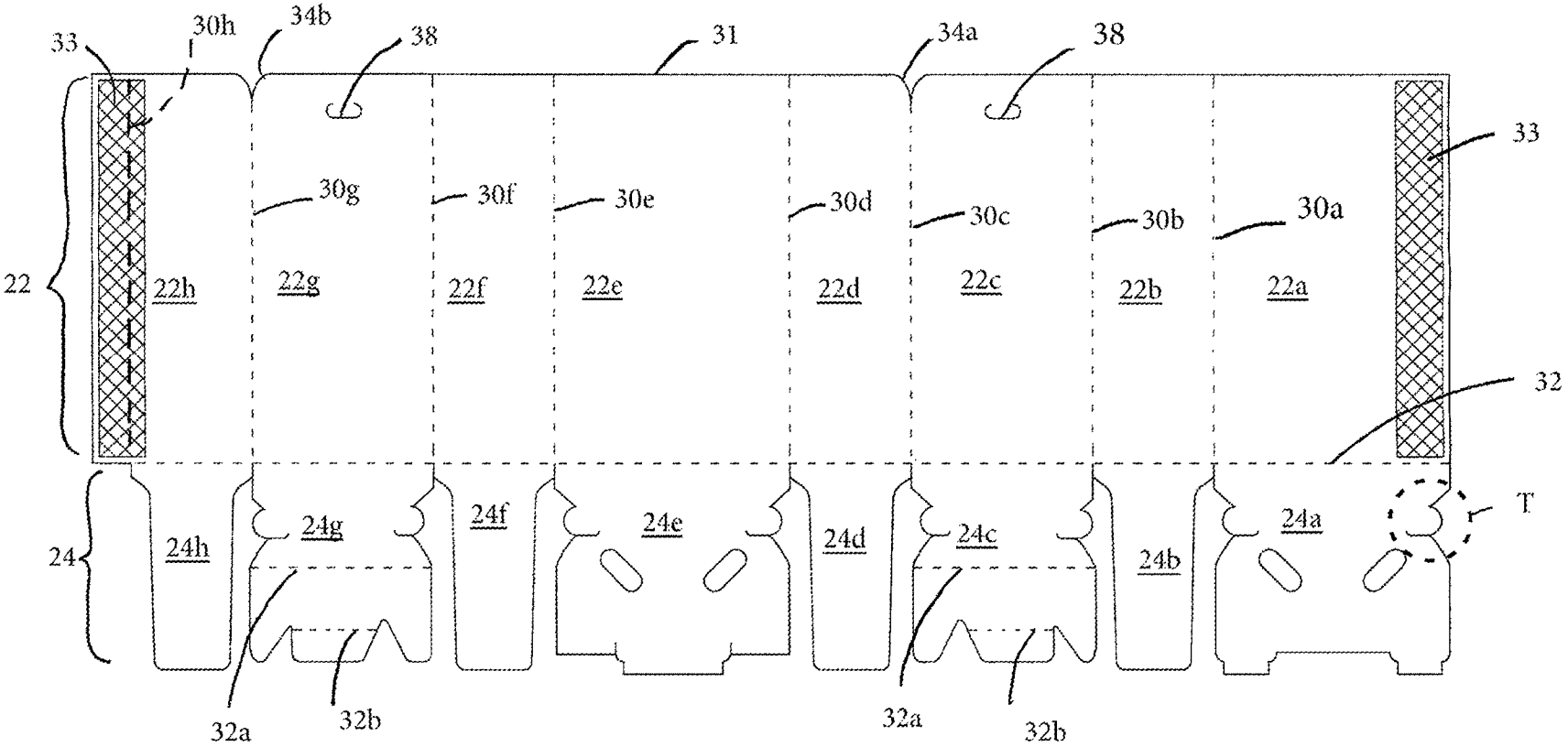
FIG. 13 is a view illustrating on a planar sheet, a pattern and folding configuration of the forming member and locking assembly of the bulk material container assembly of FIG. 12.

FIG. 13 is a view illustrating on a planar sheet, the cut and fold patterns of the embodiment of the forming member and locking assembly portions of the container of FIG. 12. In the embodiment illustrated, the pattern is die cut from a corrugated substrate material, however as discussed above and in the incorporated U.S. Pat. No. 6,932,266, other substrate materials can be used.

Referring to FIG. 13, the substrate is scored along vertical fold lines 30*a*-30*h* that divide the forming member 22 into eight adjacent and integrally connected sidewalls 22*a*-22*h*. The sidewalls 22 extend between an upper edge 31 to a horizontal lower fold line 32 which also defines the upper boundary (as shown in FIG. 13) of the locking assembly member projections 24*a*-24*h*. Locking assembly member projections 24*a*-24*h* continuously extend respectively from sidewalls 22*a*-22*h*, and are joined thereto along the horizontal fold line 32. When the corrugated material which forms the forming member sidewalls 22 and the locking mechanism extensions 24 of the sidewalls 22 are folded along the fold lines 30 and 32 and interconnected to form the octagon shaped forming member configuration 22 of FIG. 12, the material at the fold line 32 defines the lower edges of the forming member sidewall segments 22*a*-22*h* as well as the outer edges of the locking assembly member projections 24*a*-24*h* that interconnect to form the locking mechanism of the container 20. The locking assembly members 24*c* and 24*g* also include secondary horizontal folding lines 32*a* and 32*b*, as illustrated in FIG. 13, that facilitate interconnection of the locking members during assembly of the container. The two end sidewalls 22*a* and 22*h* each has a vertical bonding strip portion, generally designated at the cross-hatched portions 33. The bonding strip portions 33 are sized, shaped and configured to overlap with and to be glued to one another when the forming member is operatively folded along the vertical fold lines 30*a*-30*h*, to operatively form a peripherally continuous three-dimensional forming member as illustrated in FIG. 12.

Figure 14A:
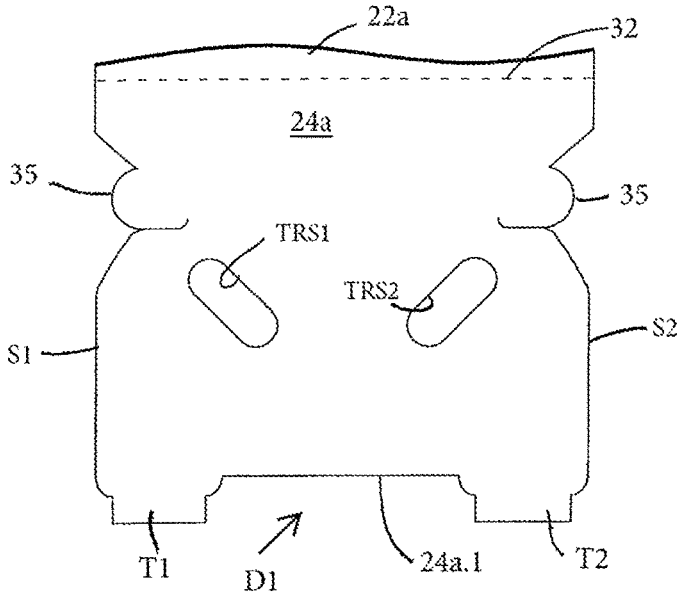
FIGS. 14A and 14B are enlarged views of two segments of the locking assembly portion of the bulk material container configuration of FIG. 13.

FIG. 14A is an enlarged view of the locking assembly member extension portion 24*a*. Referring thereto, the locking segment 24*a* is shown as extending between its proximal connection to the sidewall 22*a* along the fold line 32, and a distal end D1. The distal end D1 is configured to define a primary tab receptor slot 24*a*.1 and a pair of projecting tab portions T1 and T2 extending distally outward from the locking segment 24*a* on opposite sides of the primary tab receptor slot 24*a*.1. The locking segment 24*a* also has oppositely disposed side edges S1 and S2. Each of the side edges S1 and S2 has an outwardly projecting sleeve retaining tab member 35.

Figure 14B:
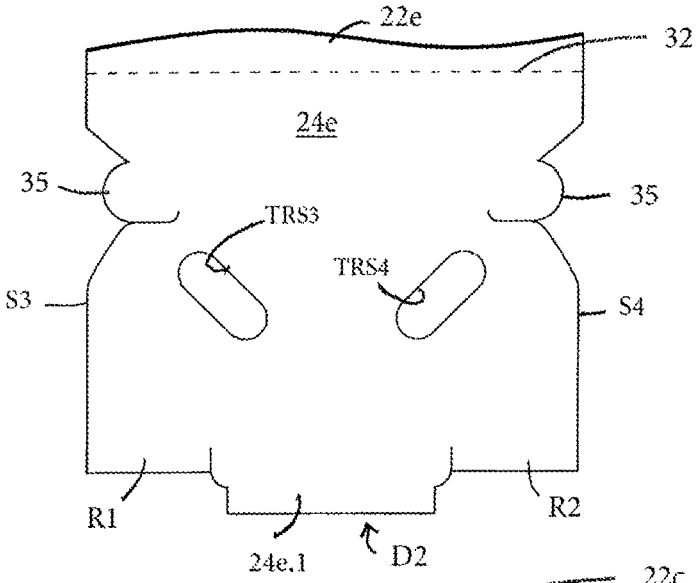

FIG. 14B is an enlarged view of the locking member extension portion 24*e*. Referring thereto, the locking segment 24*e* is shown as extending between its proximal connection to the sidewall 22*e* along the fold line 32, and a distal end D2. The distal end D2 is configured to define a primary tab 24*e*.1 outwardly projecting from the distal end D2, and a pair of tab receptor seat portions R1 and R2 spaced inwardly back from the distal end of the primary tab 24*e*.1 of the locking segment 24*e*, on opposite sides of the primary tab 24*e*.1. The locking segment 24*e* also has oppositely disposed side edges S3 and S4. Each of the side edges S3 and S4 has an outwardly projecting sleeve retaining tab member 35 of the same configuration as the same numbered sleeve retaining tab members of the locking segment 24*a* of FIG. 14A.

The locking segment 24*a* has a pair of laterally aligned and spaced, oppositely angled tab receptor slots TRS1 and TRS2, spaced back from the distal end D1 of the locking segment 24*a*. Similarly, the locking segment 24*e* has a pair of laterally aligned and spaced, oppositely angled tab receptor slots TRS3 and TRS4, spaced back from the distal end D2 of the locking segment 24*e*.

Figure 15:
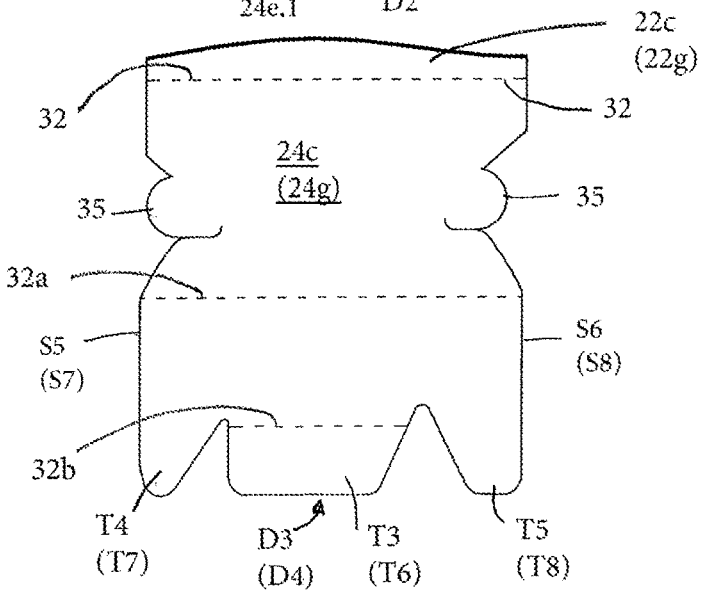
FIG. 15 is an enlarged view of a third segment of the locking assembly portion of the bulk material container configuration of FIG. 13.

FIG. 15 is an enlarged view of the locking member extension portions 24*c* and 24*g*, which are identically shaped. The numerical designations for the locking segment 24*g* are enclosed in parentheses in FIG. 15, and below the corresponding numerical designations for the locking segment 24*c*, which are not enclosed by parentheses. Referring thereto, the locking segments 24*c* (24*g*) are shown as extending between their proximal connection to the sidewalls 22*c* (22*g*) along the fold line 32, and a distal end D3 (D4). The locking segments 24*c* (24*g*) each has a primary tab portion T3 (T6) extending distally outward from the central portion of the locking segment 24*c* (24*g*). The locking segments 24*c* (24*g*) each also has a pair of projecting tab portions T4 (T7) and T5 (T8) extending distally outward from the locking segment 24*c* (24*g*) on opposite sides of the centrally located primary tab T3 (T6). The tab receptor slots TRS1-TRS4 of the locking member segments 24*a* and 24*e* are similarly sized and configured to matingly cooperatively receive and retainably engage the projecting tab members T4, T5, T7, and T8 of the locking member segments 24*c* and 24*g*, as hereinafter described in more detail.

The locking member segments 24*c* (24*g*) also have oppositely disposed side edges S5 (S7), S6 (S8). Each of the side edges S6-S8 as an outwardly projecting sleeve retaining tab member 35 of the same construction as those sleeve retaining tab members of like number of the locking segments 24*a* and 24*e*, previously described.

The sidewall lower extension segments 24*b*, 24*d*, 24*f* and 24*h* are identically shaped and are included within the designation of "locking assembly segments" since they share a common physical location below the lower fold line 32 and are cooperatively inwardly folded along with the other locking assembly segments, as hereinafter described, to define the 3-dimensional shape of the container. It will be noted that even though referred to as "locking" segments, while the lower extension segments 24*b*, 24*d*, 24*f* and 24*h* cooperatively slidably engage others of the locking assembly segments, they do not include any specific "interlocking" mechanisms like, for example, those of locking segments 24*a*, 24*c*, 24*e* and 24*g* previously described with reference to FIGS. 14A, 14B and 15.

Figure 5:
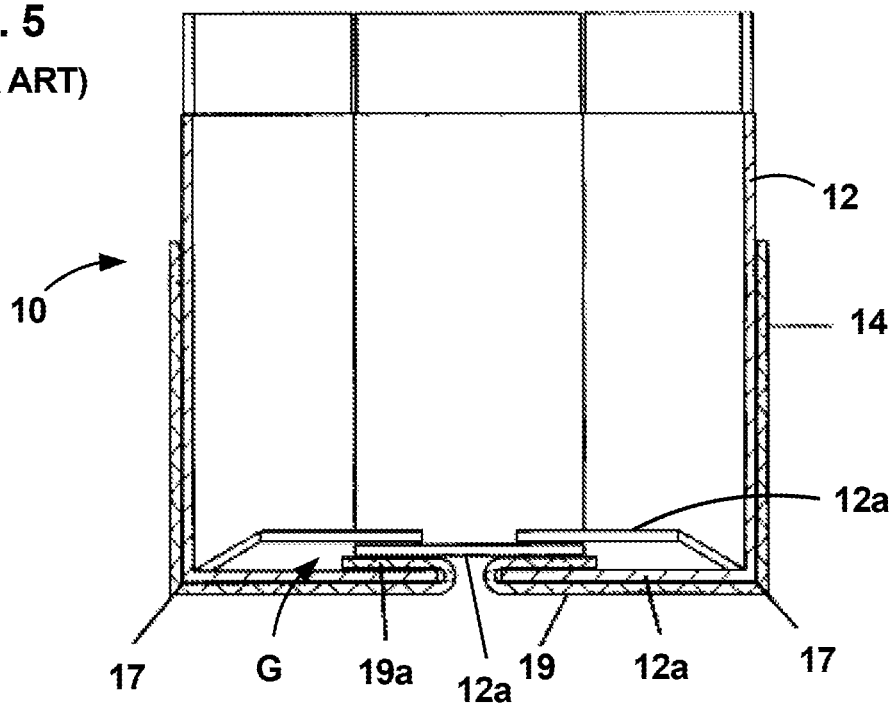
FIG. 5 (PRIOR ART)
FIG. 5 is a sectional view generally taken along the Line 5-5 of FIG. 4.
Figure 16:
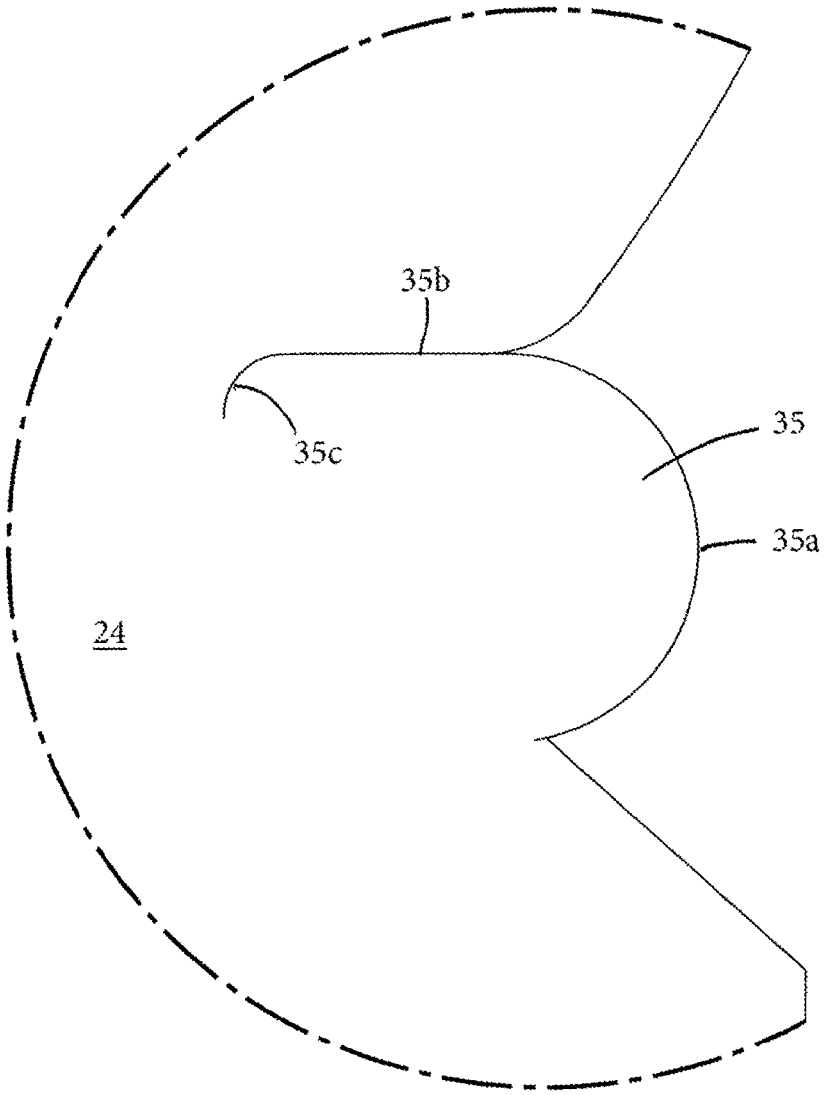
FIG. 16 is an enlarged fractional view of a sleeve retaining tab member of the locking assembly portion enclosed within the dashed circle "T" of FIG. 13.

An enlarged fragmentary view of one of the sleeve retaining tab members 35 illustrated within the dashed circle T of FIG. 5, is illustrated in FIG. 16. The tab 35 has an outwardly projecting arcuately-shaped edge portion 35*a*. The tab 35 has a second inwardly projecting edge portion 35*b* formed by a slit that projects into the base material of the extended locking member portion 24 from which the tab 35 is formed. The second edge portion 35*b* is formed by the same die-cutting operation that forms the tab 35, which cuts a slit through the locking member 24 base material. The slit forming the second tab edge portion 35*b* continuously extends into the body of the locking member segment 24 and terminates within the locking member 24 in a hook-shaped configuration illustrated at 35*c*. The second and third slit-formed portions 35*b* and 35*c* of the tab 35 are configured to retainably pinch and hold material of the sleeve 26 being retained by the tab 35, as hereinafter described in more detail. In one embodiment, the arcuately shaped edge portion 35*a* has a radius of about one inch and the combined length of the second and third slit-formed edge portions 35*b* and 35*c* is also about one inch. For the embodiment illustrated in FIG. 13, the die cutting operation also forms a pair of inverted retainer tab members 38 adjacent the top edge 31 of the forming member 22. The tabs 38 are used to retainably hold the upper end of the inner liner 28 in an operative open position within an assembled container 20 prior to and during loading of bulk material into the liner.

It is common practice in the industry for the forming member 22 and locking mechanism 24 as shown in FIG. 13 to be manufactured separately from the outer support sleeve 26, and often by different manufacturers at different locations. The forming member 22/locking mechanism 24 configuration of the embodiment illustrated in FIG. 13 is formed by subjecting a planar substrate sheet of corrugated material to a die-cutting operation that defines the dimensions and shapes of the forming member 22 and the locking mechanism 24. The dimensioned and shaped corrugated panel then proceeds through various processing operations such as the forming (scoring) of fold line impressions, printing, folding, gluing operations, and the like, in manners well-known in the art.

Figure 17A:
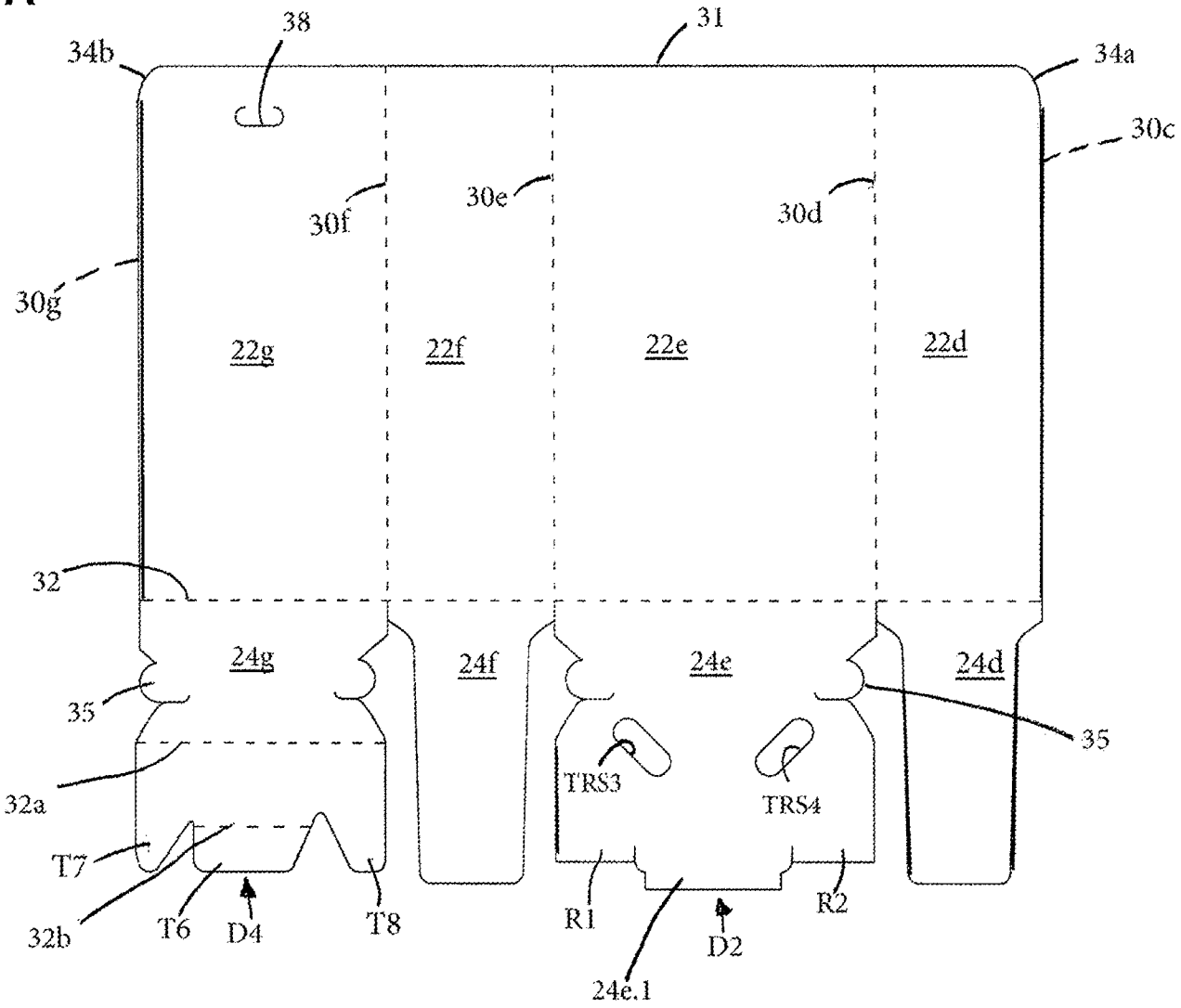
FIG. 17A is a view of one side of the forming member and locking assembly of FIG. 13 as it would appear when folded upon itself along the folding lines 30*c* and 30*g* of FIG. 13, with the opposite or back side thereof not shown.
Figure 17B:
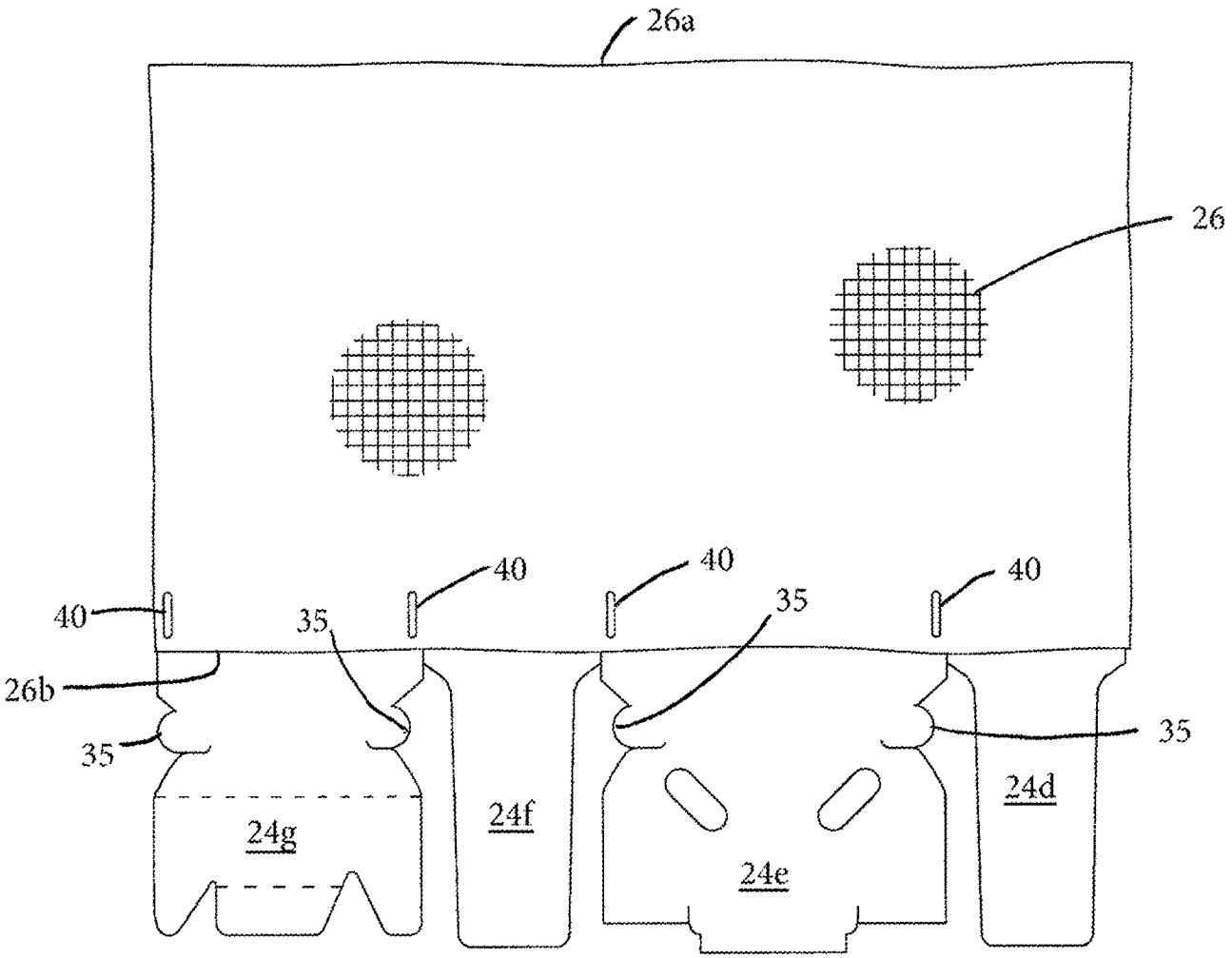
FIG. 17B is a view of the folded forming member and locking assembly of FIG. 17A shown with an outer sleeve pulled down over the top edge of the forming member and overlying the forming member, illustrating the vertical alignment of receptor slots in the sleeve with sleeve retaining tab members of the locking assembly.
Figure 17C:
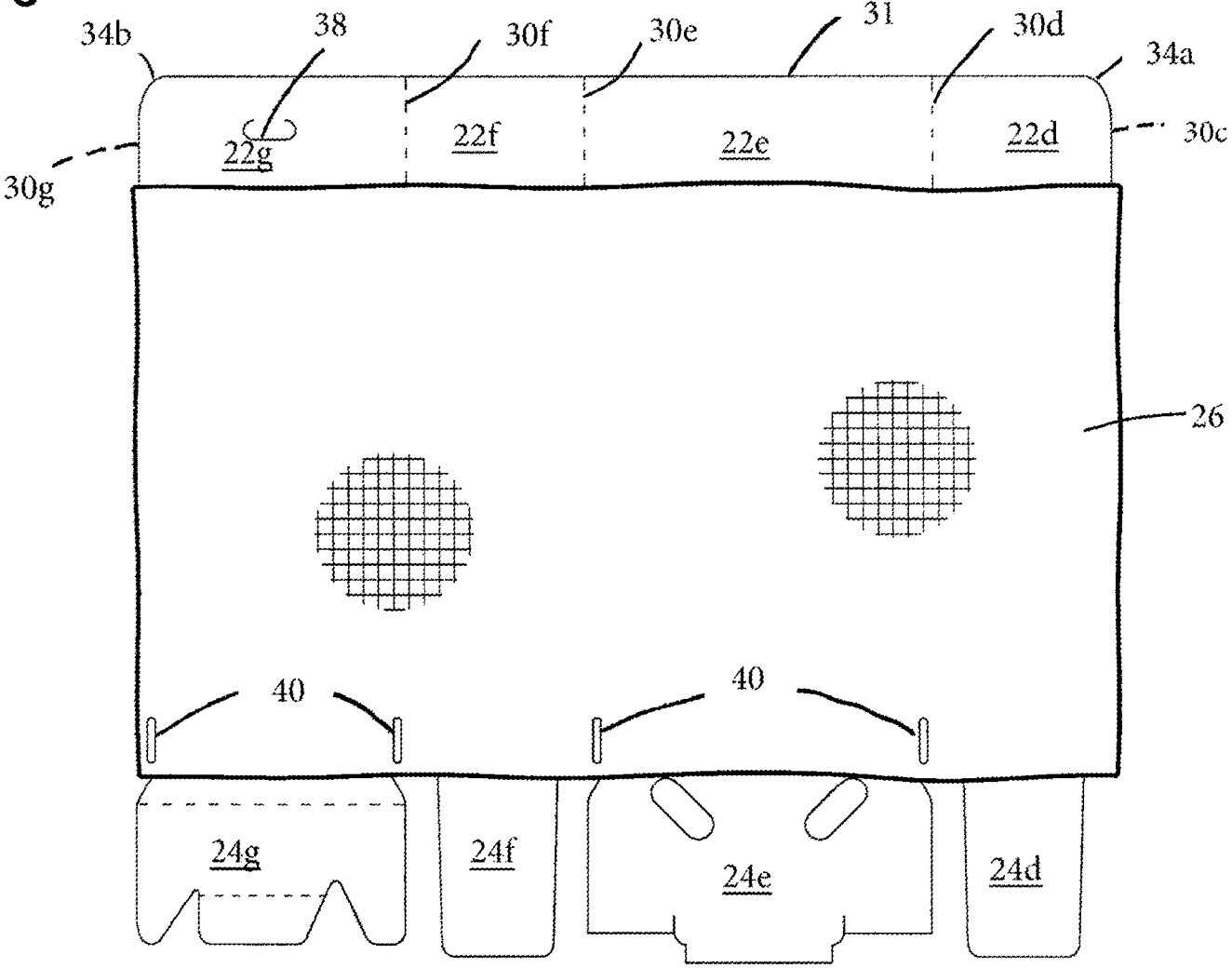
FIG. 17C is a view of the folded forming member and locking assembly of FIG. 17B, illustrating the outer sleeve pulled down to its operative position overlying the forming member, and partially overlying but not in operative engagement with the sleeve retaining tab members of the locking assembly.
Figure 18:
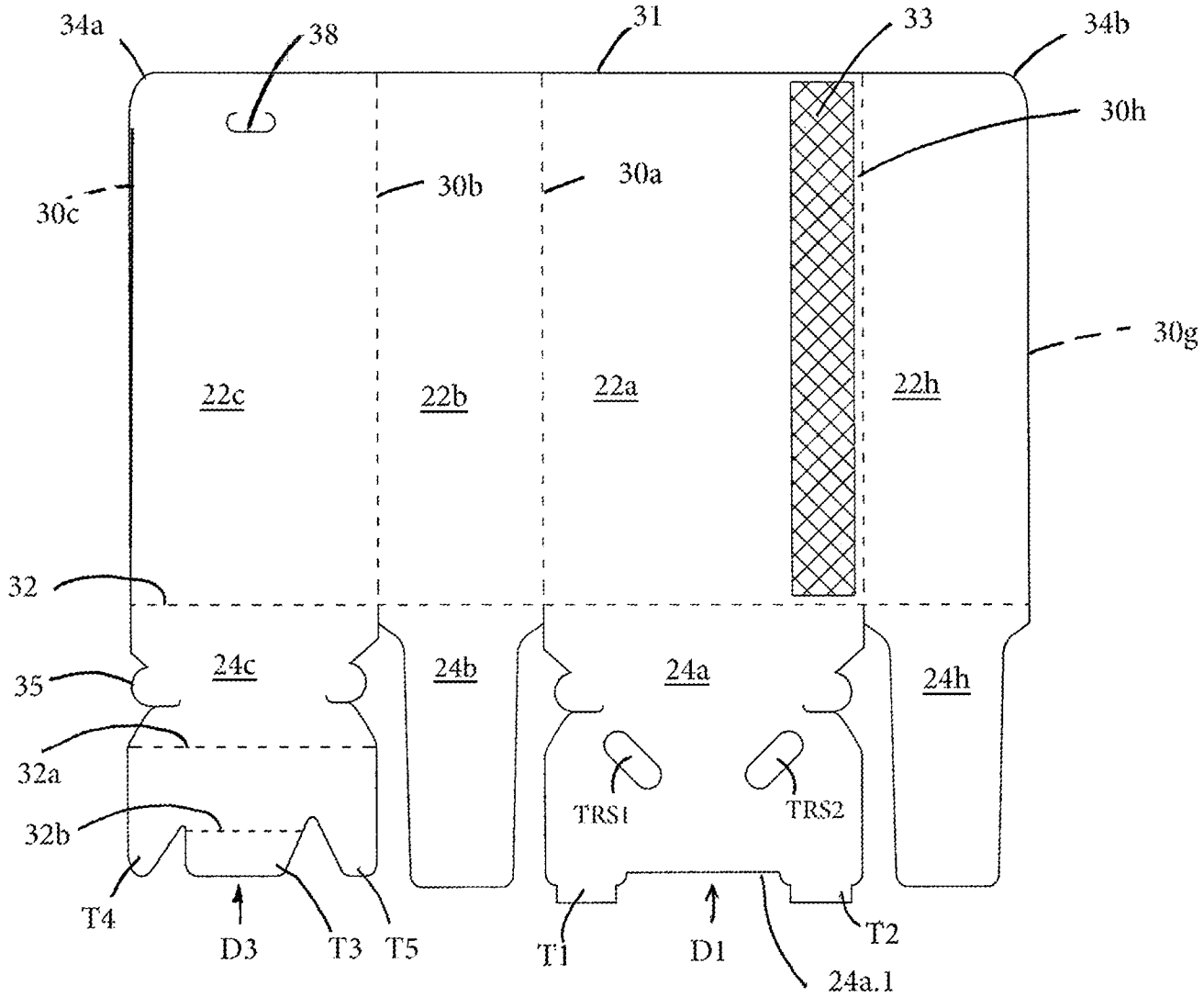
FIG. 18 is a view of the folded forming member of FIG. 17A, as viewed from the opposite side thereof, and with the back side thereof not shown.

For the embodiment illustrated in FIG. 13, the planar panel is folded in half along the fold lines 30*c* and 30*g* and glued along the bonding strip portions (33), to form the configuration shown in FIGS. 17 and 18. FIG. 17A is a view of one side of the folded assembly, showing the connected sidewall segments 22*d*, 22*e*, 22*f* and 22*g* of the forming member and their attached locking member extension portions 24*d*, 24*e*, 24*f* and 24*g* respectively. FIG. 18 is a view of the back or opposite side of the folded assembly of FIG. 17A, showing the sidewall segments 22*h*, 22*a*, 22*b* and 22*c* and their attached locking member extension portions 24*h*, 24*a*, 24*b* and 24*c* respectively. When viewing the folded configurations of FIGS. 17A and 18, the back or opposite sides of the folded panel are not illustrated in the respective Figures. FIG. 18 also shows the overlapping bonding strip portions 33 of the sidewalls 22*h* and 22*a*, which are glued together and compressed in a manufacture's joint in the glued/overlapped configuration, to form a continuously connected and folded forming wall structure that is ready for user assembly into an operable 3-dimensional structure. The folded and glued panel members as shown in FIGS. 17A and 18 can be readily stacked and bundled together for shipment to users thereof, or can have an outer sleeve attached thereto, as described below, before bundling and shipping.

Referring to FIG. 13, the upper edge 31 of the forming member 22 defines first and second triangular notches 34*a* and 34*b* die cut into the forming member panel and symmetrically centered respectively on the fold lines 30*c* and 30*g*. The first and second notches 34*a* and 34*b* reduce the effective width of the upper edge 31 of the half-folded assembly as related to the width of the folded assembly measured below the notches and between the side edges 30*c* and 30*g* of the folded assembly, as illustrated in FIGS. 17A and 18. This enhances/facilitates the placement and sliding assembly of the outer support sleeve 26 in overlying position onto and surrounding the forming member sidewalls.

The notches 34*a*, 34*b* can be shaped in a generally triangular manner with straight edges or with curved edges terminating in an apex along the fold lines 30*c*, 30*g* respectively. In a preferred embodiment of the forming member, the apex is positioned about 2 inches down from the top edge 31 of the forming member. The lateral positioning of the notches 34*a* and 34*b* along the upper edge 31 of the forming member is selected so as to coincide with those vertical fold lines 30 that will form the outer lateral edges of the forming member 22 when folded in half. As shown in the embodiment illustrated in FIGS. 17 and 18 those half-folded outer edges coincide with the fold lines 30*c* and 30*g*.

The outer support sleeve 26 is preferably constructed of the same types of materials, well-known in the art, that are used for making flexible intermediate bulk containers (FIBCs) for transporting large quantities (e.g. 2,000 lbs. or more) of bulk materials. The sleeve is preferably configured from flexible woven fiber materials, preferably woven polypropylene materials which are known for their strength and light weight. The sleeve 26 is preferably of tubular continuously woven and seamless construction, requiring no sewing or stitching. The woven fabric material can also be coated or embedded with a liquid polypropylene or polyethylene resin that enhances the fabric strength and provides it with waterproof properties. For assembly purposes, the sleeve material can simply be cut to a desired length by a shear or laser or by a hot knife technique that also conditions the woven material along the cut to prevent unraveling thereof. The sleeve 26 is sized to snugly engage and cover virtually the entire outer peripheral surface area of the forming member sidewalls 22*b*, and to extend slightly below the lower edge 32 of the assembled forming member for folding inwardly below the locking assembly, as hereinafter described.

The woven polypropylene materials of the types used in the FIBC industry have been single strength fabric material that has been supplied by companies such as B.A.G. Corp. of Dallas, Tex., or Tech Packaging Group of Joplin, Mo. or National Paperboard Group, Inc. of Burnsville, Minn. or Conitex Sonoco of Charlotte, N.C. The woven fabric materials strength rating is generally much greater than the load that it is required to support. For example, an FIBC specified to contain a bulk material weighing 2,000 lbs. may have a strength rating capable of holding 10,000 lbs. of material, giving it a working load strength ratio of 5:1. The woven polypropylene fabric has a mesh density of fabric weave measured as the number of yarns per inch in both the warp and weft directions (e.g. a 12×12 mesh) and is graded by a weight, typically by so many ounces per square yard (e.g., 5.0 oz. or 6.0 oz./sq. yd. of fabric material).

The woven polypropylene fabric sleeve sheet material is continuously woven and collected on large rolls of the material prior to shipment to customers, or cutting to length into smaller longitudinal lengths or segments of the material. The longitudinal running threads of the fabric are referred to as "warp threads", and the laterally oriented threads that are intertwined with or woven in a direction across or perpendicularly to the warp threads are referred to as the "weft threads". While the size or weight of the warp threads does not change during the fabric weaving process it is possible to change the size or weight of the weft threads relative to that of the warp threads during the weaving process, to selectively provide regions or zones of weft threads of differing weight as the fabric weaving progresses in the longitudinal direction along the warp threads.

Figure 19:
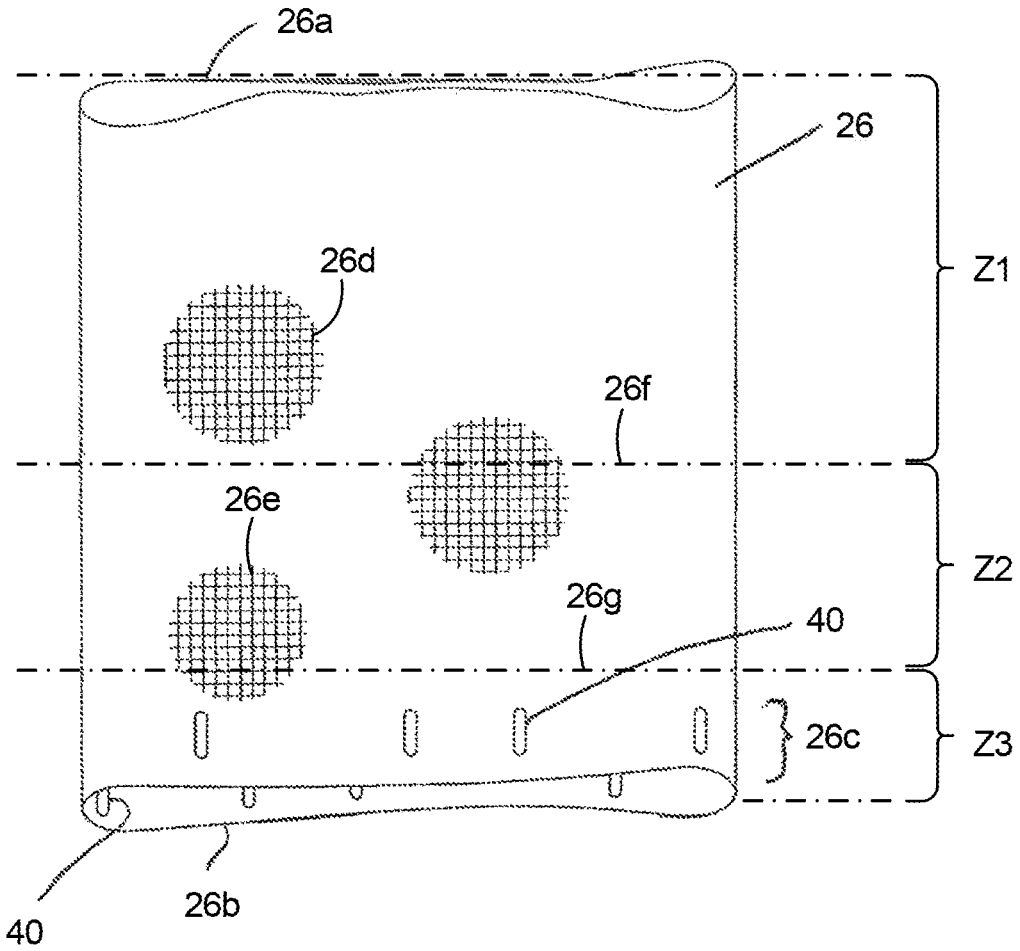
FIG. 19 is a diagrammatic pictorial view of a continuously woven outer sleeve member illustrating circumferentially spaced receptor slots formed through the sleeve material adjacent a lower end thereof, and designating locations of three contiguous fabric zones having selectively differing fabric weights and strengths.

A diagrammatic pictorial view of one embodiment of an outer sleeve member 26 described with respect to the container 20 herein is illustrated in FIG. 19. The sleeve 26 is generally the same in shape and outer configuration as the sleeve 14 of FIG. 8, and of the sleeve of the bulk material container of the U.S. Pat. No. 10,071,842 except for its woven fabric configuration. The sleeve 26 extends from an upper edge 26*a* to a lower edge 26*b*. The sleeve includes a plurality of circumferentially spaced generally vertical slits 40 adjacent to but vertically spaced up from the lower edge 26*b* of the sleeve 26. The vertical slits 40 are circumferentially spaced around the perimeter of the sleeve 26 to cooperatively identically align with and to be cooperatively engagable with the sleeve retaining tab members 35 of the locking mechanism and form tab receptor slots for the tabs 35 of the locking mechanism 24. The slits 40 are preferably cut through the poly coated sleeve's surfaces and material with a hot blade or wire that results in no unraveling of the exposed sleeve threads, in a manner well-recognized by those skilled in the art. The sleeve fabric's longitudinally running warp threads are indicated at 26*d*, and its' horizontally running weft threads are generally indicated at 26*e*. The ability to selectively weave weft threads of varying sizes and/or weight enables the sleeve 26 to be woven with contiguous bands, zones, or regions of material along the length of the sleeve, to selectively provide regions of varied fabric strength where desired and particularly of greater strength in those regions requiring the greatest sleeve strength. Referring to FIG. 19, the sleeve 26 is illustrated as having three longitudinally contiguous fabric strength zones, Z1, Z2, and Z3. As used herein, the "width" of each of the zones Z1, Z2, Z3 is measured in the longitudinal direction between its respective lower and upper boundaries.

The upper fabric zone width Z1 extends from the upper edge 26*a* of the sleeve, down to a mid-portion of the sleeve (indicated at 26*f*) which also represents the upper boundary of the second zone Z2 of fabric. In the embodiment illustrated, the warp and weft threads within the upper zone Z1 are of equal weight. The width of zone Z2 extends from its upper boundary 26*f* down to that portion or upper boundary of the sleeve portion that will operatively extend below the lower edge 32 of the forming member sidewalls 22 when the forming member is folded in operative position. The lower boundary of zone Z2 of the material is indicated at 26*g* in FIG.19. When the sleeve 26 is operatively positioned overlying the forming member 22, the boundary line 26*g* will overlie and align with the lower edge 32 of the forming member 22. Zone Z2 of the sleeve represents that portion of the sleeve that requires the greatest material fabric strength, since the bulk material contained by the container exerts its greatest radial outward pressure to the forming member sidewalls 22 and its overlying sleeve 26 in zone Z2. To provide the extra sleeve strength in zone Z2 the weft threads in zone Z2 are larger or heavier than the weft thread weight of zone Z1, to selectively provide the sleeve 26 with its greatest containment strength in zone Z2. The width of zone Z2 as longitudinally measured between its lower (26*g*) and upper (26*f*) boundaries is preferably from 20% to 50% of the height of the container, as measured between the lower (32) and upper (31) edges of the forming member 22. When the top 26*a* of the assembled sleeve coincides with the top edge 31 of the container 20 the height of the container will be the same as the combined widths of zones Z1 and Z2 (as measured between the zone boundary lines 26*g* and 26*a*). The boundary 26*g* represents both the lower boundary of zone Z2 and the upper boundary of zone Z3. The width of the zone Z3 fabric extends from its upper boundary 26*g* down to the bottom edge 26*b* of the sleeve, and represents that portion of the sleeve 26 that will be operatively folded under the bottom of the assembled container. Since the sleeve fabric of zone Z3 is not required to counter the outward radial forces applied by the bulk material to the container, it does not require the strength of the fabric of either zones Z1 or Z2 and can have its weft threads equal to or less than those of the warp threads. The lighter weight of the zone Z3 fabric can also facilitate folding of the zone Z3 material under the container, and securement thereof to the connector tabs 35 of the locking assembly, and tucking of excess zone Z3 material into containment gaps G formed in the bottom of the container, as hereinafter described in more detail. However, to facilitate weaving of the sleeve by minimizing the number of sleeve zones of differing fabric weights, the weights of weft threads of zones Z2 and Z3 may be selected to be the same.

Figure 6:
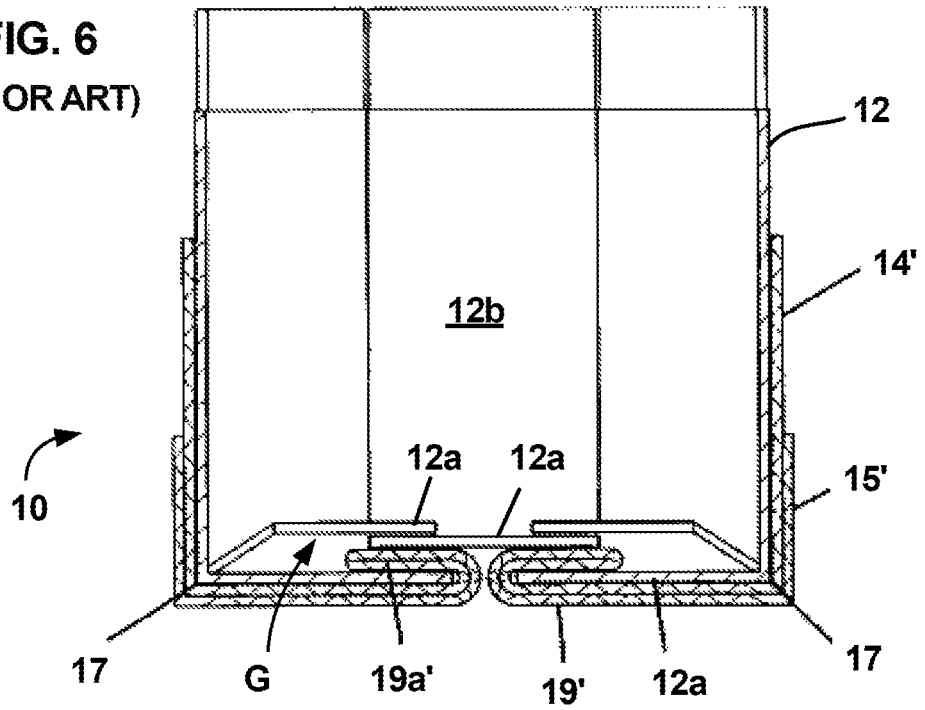
FIG. 6 (PRIOR ART)
FIG. 6 is a sectional view similar to that of FIG. 5 illustrating one prior art method of folding the sleeve material against itself before tucking it into underlying gaps formed by the locking assembly at the bottom of the container, and then folding the distal end of the sleeve back against itself under the container bottom and up along the lower sidewall portion of the container.
Figure 7:
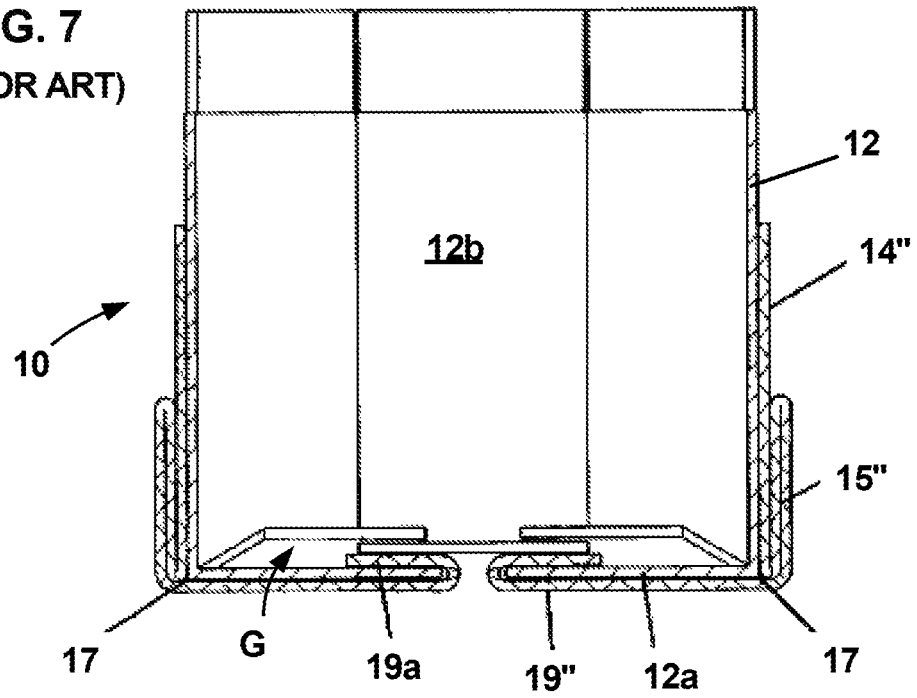
FIG. 7 (PRIOR ART)
FIG. 7 is a sectional view similar to that of FIG. 5, illustrating another prior art method of folding the sleeve material against itself and up from the bottom sidewall edge and partially along the sidewall, and then back down against itself, to the lower edge of the sidewall and subsequently folding it under along the bottom of the container to a tucked in position within the underlying gaps formed by the locking assembly.

It will be appreciated that a sleeve configuration having fabric zones of selectively different fabric weights and strength, eliminates the need for excess sleeve material and cumbersome folding of the sleeve material back up along the lower sidewall portions of the container to achieve the desired sleeve containment strength, such as those described with respect to the containers illustrated in FIGS. 6 and 7. It will also be appreciated by those skilled in the art, that while the sleeve embodiments illustrated and described in this specification show three zones of selective fabric weight, sleeves having more or less zones can be configured by those skilled in the art, depending on the uses to which the sleeves will be put. It will also be appreciated that the ability to provide a sleeve having selectively different strength zones enables the sleeve to be configured so as to provide the greatest sleeve strength where it is required, as opposed to using a potentially more expensive sleeve having a uniformly heavy fabric weight equal to the maximum weight required to counteract the largest bulk material forces submitted to only portions of such heavier sleeve.

By way of example only, for a bulk material container suitable for use with a 2,000 lb. bulk material load, the sleeve material weight in zones Z1 and Z3 may have a weight of 3 oz./sq. yd. and a larger weight of 4-5 oz. or more/sq. yd. in zone Z2, where the greatest strength is required. Those skilled in the art will appreciate that the specified zone fabric weights will be determined by a number of factors, including but not limited to such parameters as type and nature of bulk material being contained, weight of the bulk material, internal cavity size of the bulk container, weight/strength of the forming member material, migratory nature of the contained load, shape of the container, etc.

It will be appreciated that while the sleeve configuration of FIG. 19 employs a sleeve securement mechanism of cooperatively engagable connectors, the principles of using selective sleeve zone weaving strengths applies equally well to sleeve configurations not having any coupling fasteners such as those that simply tuck the excess sleeve material of fabric zone Z3 below the bottom of the container as, for example, illustrated in FIGS. 4 and 5.

It will also be understood that the term "threads" used herein to describe the pieces of material that are being woven together in the warp and weft directions to form the woven fabric of a sleeve or bag structure portions of bulk material containers, is intended to be generic and not a limiting term to imply any particular string-like structure. Such term, for example, includes elongated filaments or strands of material which need not be cylindrical in shape but could comprise, for example, narrow elongated ribbon-like strips or pieces of material or even filaments or group of filaments twisted together in continuous or drawn out strands, as well as others.

FIG. 17A illustrates the folded forming member 22/locking mechanism 24 as it would appear when folded upon itself along the folding lines 30*c* and 30*g* of FIG. 13, with the opposite or back side thereof not shown and without any overlying sleeve 26. In the embodiment illustrated, the sleeve 26 is slidably secured in overlying manner to the folded FIG. 17A assembly by sliding it over the top edge 31 of the forming member 22 and downwardly along its sidewalls. The notches 34 formed in the upper edge 31 of the forming member assist in orientating and guiding the sleeve 26 over the forming member 22 and help to prevent the sleeve from catching on the upper corner edges formed by the folds 30*f* and 30*b* of the forming member as it is pulled down over the forming member.

FIG. 17B illustrates the folded forming member 22/locking mechanism 24 of FIG. 17A with the sleeve 26 as it would appear after being partially pulled down over the folded panel member, and illustrates the vertical alignment of the tab receptor slits 40 with the sleeve retaining tab members 35. FIG. 17C illustrates the sleeve 26 as it would appear when pulled down to an operative position relative to the underlying folded forming member 22/locking mechanism 24 panel of FIG. 17A, with the tab receptor slits 40 being cooperatively positioned in overlying manner to the sleeve retaining tab members 35, but without operative engagement between the tab receptor slits 40 and the sleeve retaining tab member 35. Sleeve attached assemblies as shown in FIG. 17C can be stacked and bundled for shipment to an end user who needs only to open the folded assembly of FIG. 17C, to erect it to form a 3-dimensional box-shaped configuration, to lock it into position by interlocking the lower locking member portions 24*a*-24*h* with one another, and to secure the sleeve 26 to the sleeve retaining tab members 35 as described below. Alternatively, as described above, the folded forming member 22/locking mechanism assemblies could also be shipped to a user without the attached sleeve 26 in cases wherein the user would first attach on overlying sleeve to the forming member while it is still configured in its flat folded-in-half condition, and prior to the user's 3-diminsional assembly of the container.

Figure 20A:
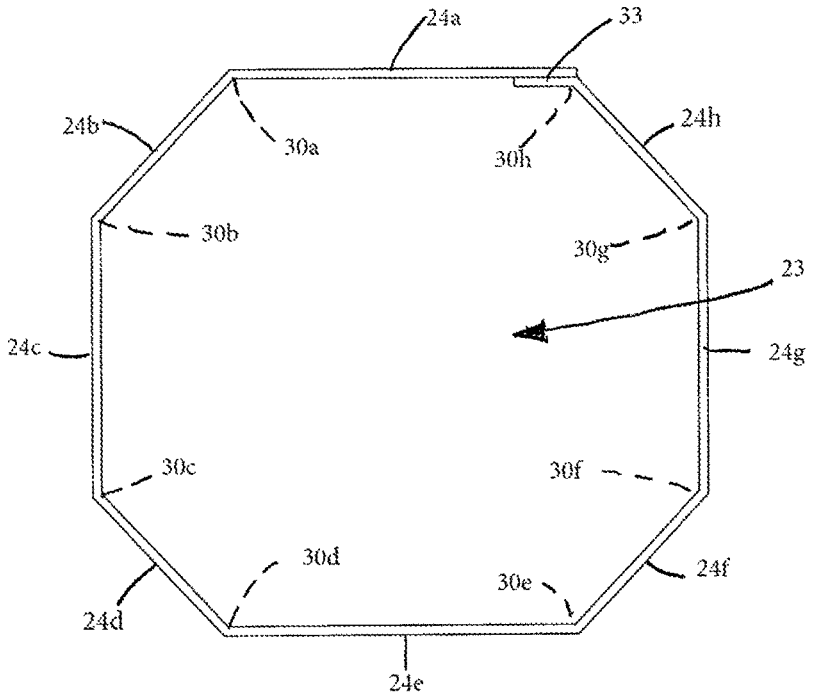
FIGS. 20A-20D illustrate bottom diagrammatic views of the forming member and locking assembly of FIGS. 17A and 18, showing progressive stages of folding and interconnection of the locking assembly portions to form a closed bottom locking configuration for the container that locks the sidewalls of the forming member in fixed relative spaced positions; that define the peripheral footprint of the container.

Assembly of the container into 3-dimensional form will be described with reference to the diagrammatic FIGS. 20-25. If the sleeve 26 is not yet been assembled to the folded forming member 22/locking member 24 as shown in FIG. 17C, the user or assembler would first slide the sleeve 26 over the forming member 22/locking mechanism assembly 24 as described above with respect to FIGS. 17A-17C. The forming member 22/locking member assembly 24/sleeve combination is then inverted and placed on a generally planar support surface with the upper edge 31 of the forming member resting on the support surface, and its sidewalls 22 are pulled "open" or apart, to define an internal geometric solid shaped cavity 23, as shown in FIG. 20A. FIG. 20A is a view of the inverted forming member 22/locking mechanism 24 assembly of FIG. 17 as it would appear looking down at the bottom of the assembly and folded along the fold lines 30*a*-30*g*. In the embodiment shown, since there are eight sidewall portions 22*a*-22*h* and connected locking member extension portions 24*a*-24*h*, the internal geometric volume enclosed by the assembly is an eight sided octagon shape. It will be noted that the diagrams of FIG. 20 are diagrammatic only and not true cross-sectional or plan views of the container. FIG. 20A is a view of the bottom edges of the locking member extensions 24 as they would appear "coming out" of the plane of and generally perpendicular to the plane of the paper. It will also be noted, that the outer support sleeve 26 is not illustrated in FIG. 20.

Figure 20B:
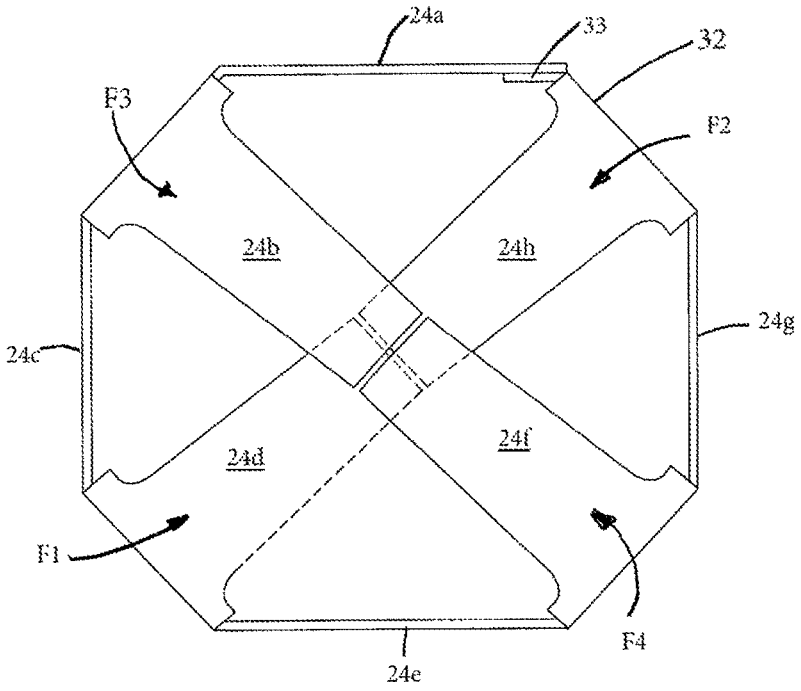
Figure 20C:
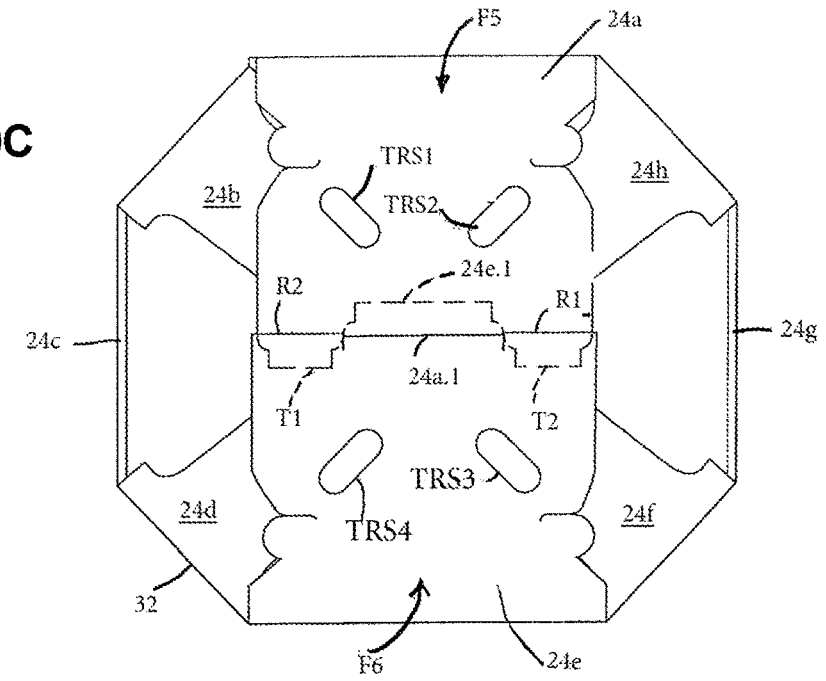
Figure 20D:
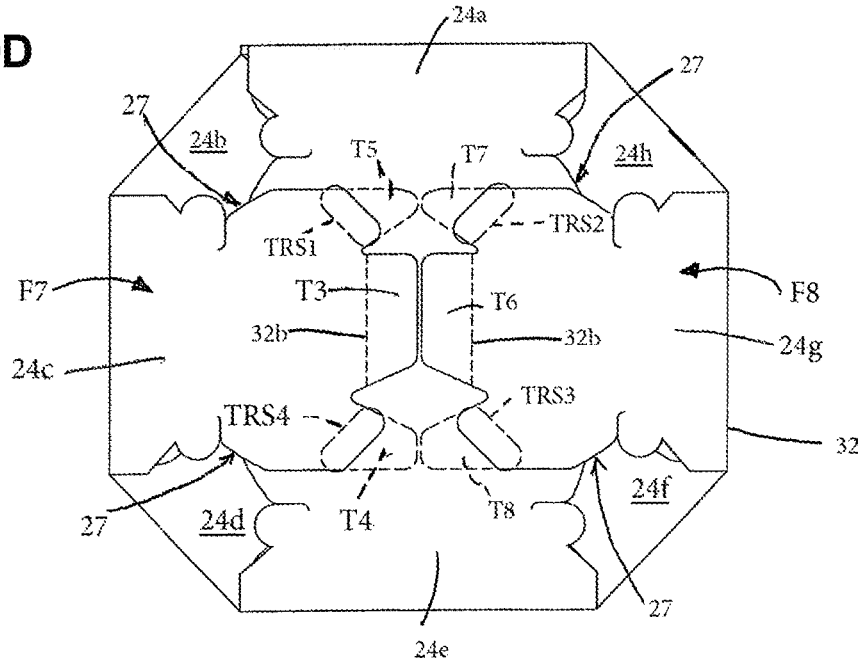

Referring to FIG. 20B, the first segments of the locking assembly to be inwardly folded as shown by the arrows F1-F4, are the four identically shaped segments 24*b*, 24*d*, 24*f* and 24*h*. When folded inwardly toward the center of the container as shown in FIG. 20B, their distal ends overlap near the center of the container footprint. These segments form the innermost members of the bottom of the container and of the enclosed internal geometric volume 23. Continuing the container assembly, as shown in FIG. 20C, locking segments 24*a* and 24*e* are folded inwardly toward one another as shown by the arrows F5 and F6 respectively. The distal ends D1 and D2 respectively of the locking segments 24*a* and 24*e*, cooperatively retainably engage one another near the center of the container such that the primary tab 24*e*.1 of the segment 24*e* is received by the primary tab receptor slot 24*a*.1, and tucks under the locking segment 24*a*. The outer tab members T1 and T2 of the locking segment 24*a* are cooperative respectively received by and slide under the tab receptor seat portions R2 and R1 of the locking segment 24*e*. Referring to FIG. 20D, the final two locking segments 24*c* and 24*g* are folded inwardly toward each other as shown by the arrows F7 and F8 respectively and interlock with the underlying locking segments 24*a* and 24*e*. The primary tab portions T3 and T6 of the locking segments 24*c* and 24*g* respectively, overlie the upper surfaces of locking segments 24*a* and 24*e*. The outer tab portion T4 of the locking segments 24*c* is cooperatively retainably received by the tab receptor slot TRS4 of the locking member 24*e*, and the outer tab T5 of the locking segment 24*c* is cooperatively retainably received by the tab receptor slot TRS1 of the locking member 24*a*. Similarly, the outer projecting tabs T7 and T8 of the locking member 24*g* are cooperatively retainably received by the tab receptor slots TRS2 and TRS3 receptively of the locking segments 24*a* and 24*e*, to complete the locking configuration of the locking assembly segments, as illustrated in FIG. 20D. The fold lines 32*a* and 32*b* of locking member segments 24*c* and 24*g* provide bending flexibility of the locking segments 24*c* and 24*g* when being maneuvered during assembly of the container, to engage their respective tab members T4, T5, T7 and T8 within that tab receptor slots of the locking segments 24*a* and 24*e*.

The interconnected locking members as described above and as shown in FIG. 20D form vertical gaps generally depicted at 27, between the first folded corner segments 24*b*, 24*d*, 24*f* and 24*h* and the overlying locking member segments 24*a*, 24*c*, 24*e* and 24*g* into which portions of the folded over sleeve 26 can be tucked as described below. It will be noted that when the completed container is inverted from the inverted "assembly" positions shown in FIGS. 20-22, to its upright, operative position for receiving bulk material as shown in FIG. 12, that the corner segments 24*b*, 24*d*, 24*f* and 24*h* of the locking assembly will be positioned so as to "overlie" the locking member segments 24*a*, 24*c*, 24*e* and 24*g*.

Figure 21:
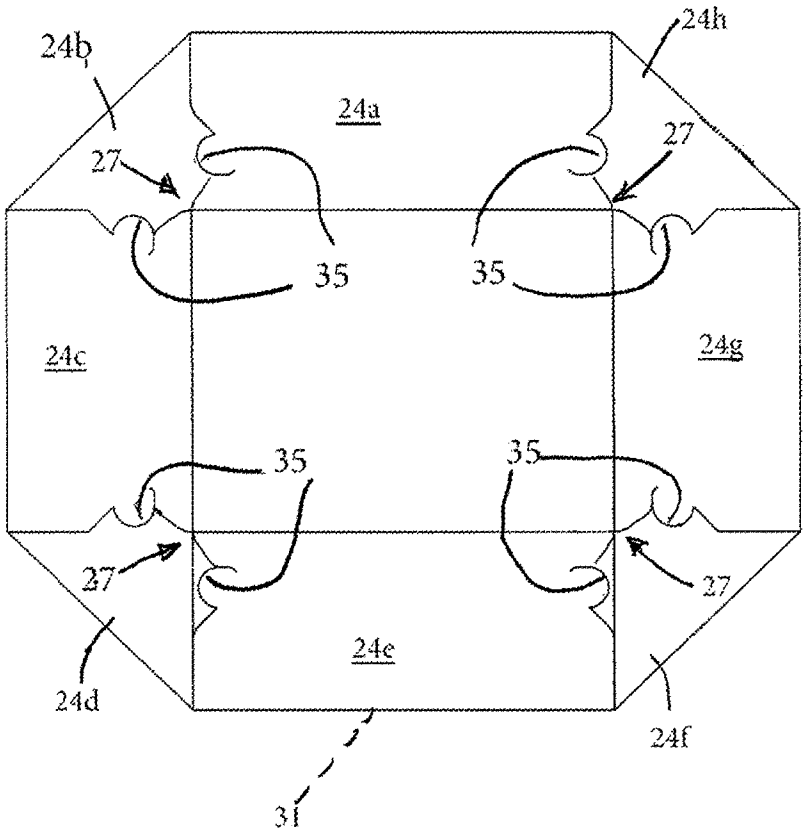
FIG. 21 is a diagrammatic bottom view of the assembled and interconnected locking assembly segments, illustrating the sleeve retaining tab members and their positioning relative to one another and to the corner sleeve receiving gap portions formed by the locking assembly.

FIG. 21 is a simplified diagrammatic bottom view of the assembled locking member segments, illustrating the relative opposed operative spaced positions of the sleeve retaining tab members 35 and of the positions relative thereto of the sleeve retaining gaps 27. The terminology "opposed operative positions" of the tab members 35 refers to each pair of the tab members 35 that are on the same locking member segment, and to the fact that the outward directions (i.e., the directions in which the arcuate end portions 35*a* of the tabs point) of the tab pairs point in "opposite" lateral directions relative to the locking segment from which they are formed, so as to tautly secure a segment of the outer sleeve 26 secured therebetween, as hereinafter described in more detail. Each of the locking segments 24*a*, 24*c*, 24*e* and 24*g* has a pair of operatively opposed and accurately spaced tab members 35.

As shown in FIG. 21, each of the corner segment locations 24*b*, 24*d*, 24*f* and 24*h* that provide access to the sleeve retaining gaps 27 has an adjacent pair of the sleeve retaining tabs 35 aligned to face each other on opposite sides of the triangular shaped gaps 27. These tabs 35 are positioned near the apex of the triangular shaped gaps 27.

Figure 22:
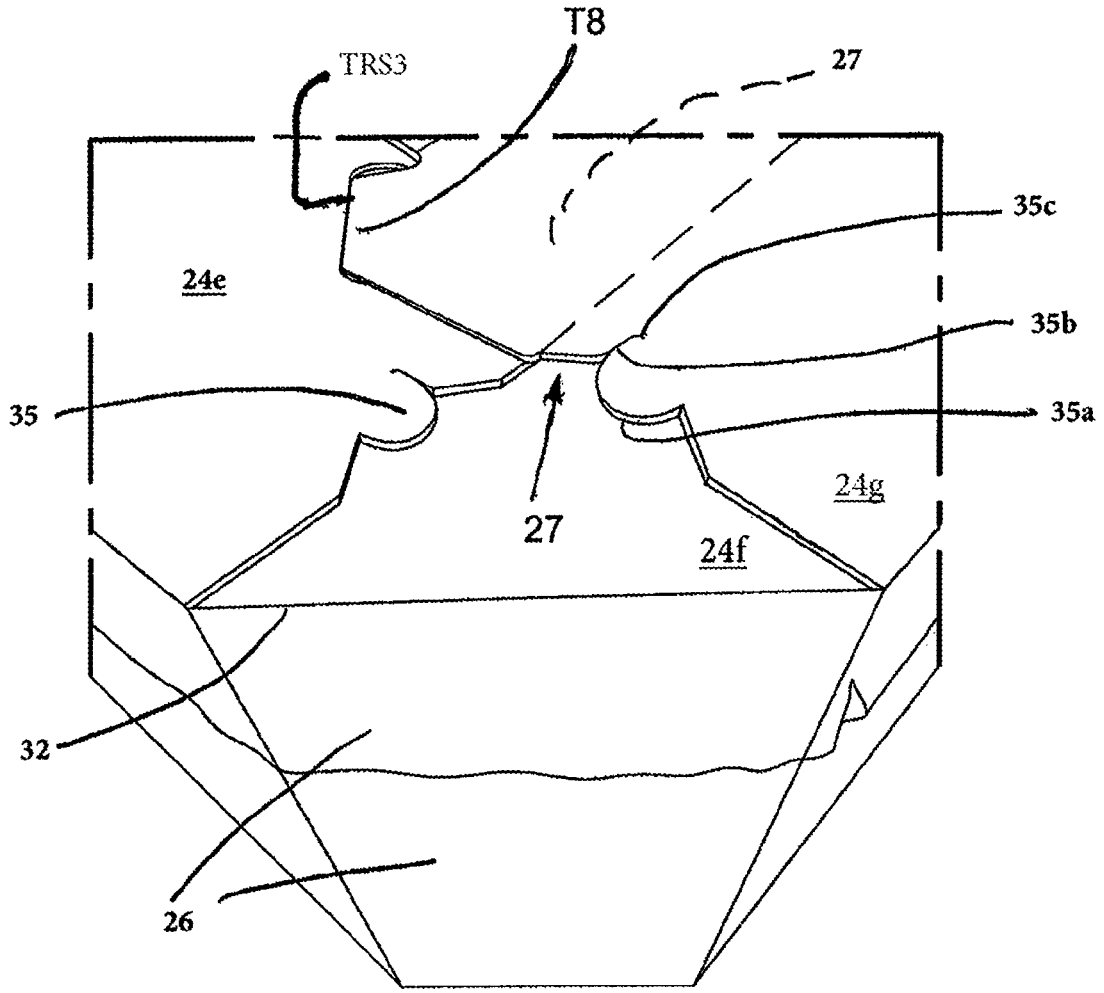
FIG. 22 is an enlarged perspective view of one of the sleeve receiving gap portions of the locking assembly of FIG. 21.

FIG. 22 is an enlarged perspective pictorial view of one of the sleeve receiving gap portions 27 of FIG. 21, illustrating the adjacent pair of sleeve retaining tabs 35, and illustrating a portion of the sleeve 26 shown folded down from the lower folded edge 32 of the sidewall 22 and along the sidewall 22, prior to folding the sleeve 26 in the up direction as viewed in FIG. 22, and inwardly over the locking assembly segments 24. The gap 27 illustrated in FIG. 22 is the one formed between the lower folded segment 24*f* and the overlying locking members 24*e* and 24*g*.

Figure 1:
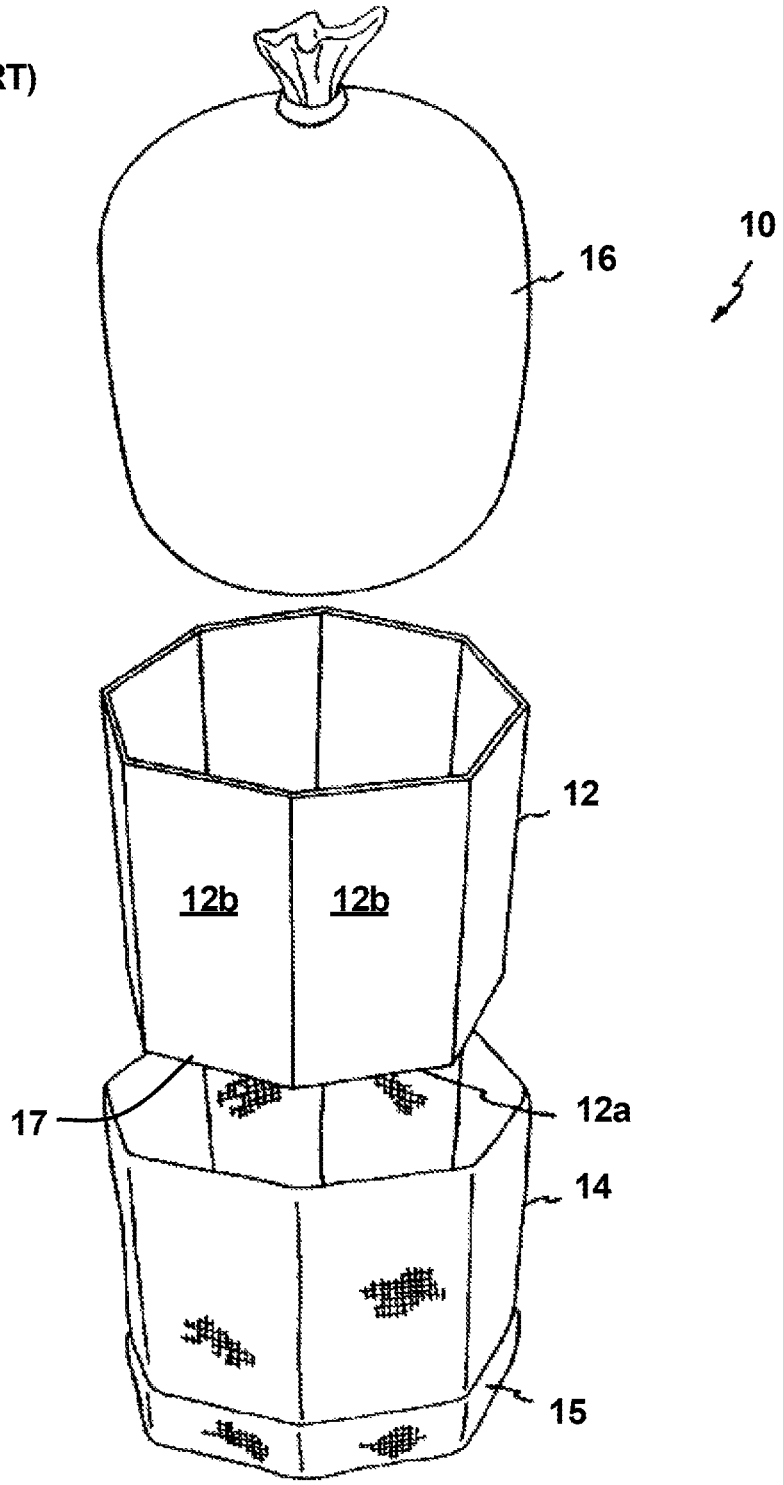
FIG. 1 (PRIOR ART)
FIG. 1 is an exploded perspective view of one embodiment of a bulk material container assembly of the prior art, having a forming member, an outer sleeve member and an optional bag/liner of impervious material.
Figure 2:
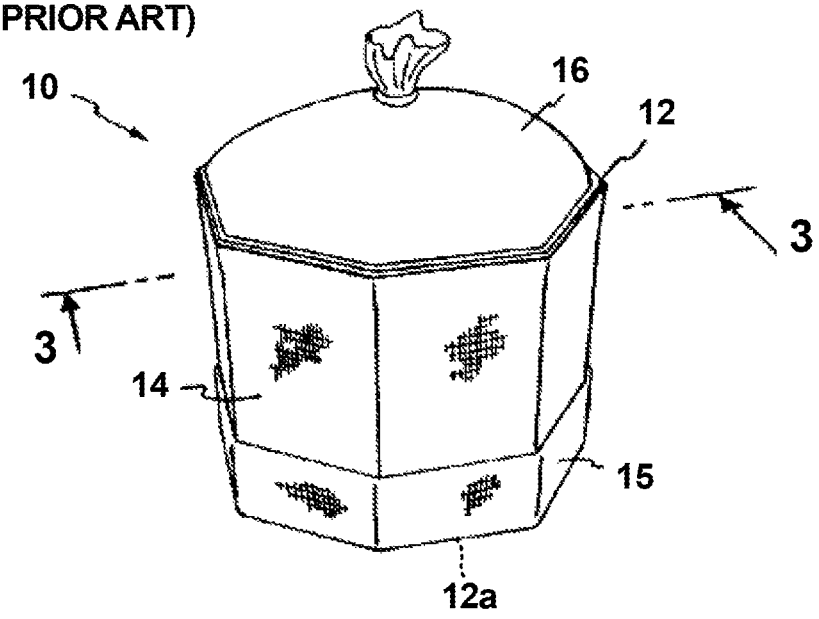
FIG. 2 (PRIOR ART)
FIG. 2 is a perspective view of the container assembly of FIG. 1, illustrated as it would appear assembled.
Figure 3:
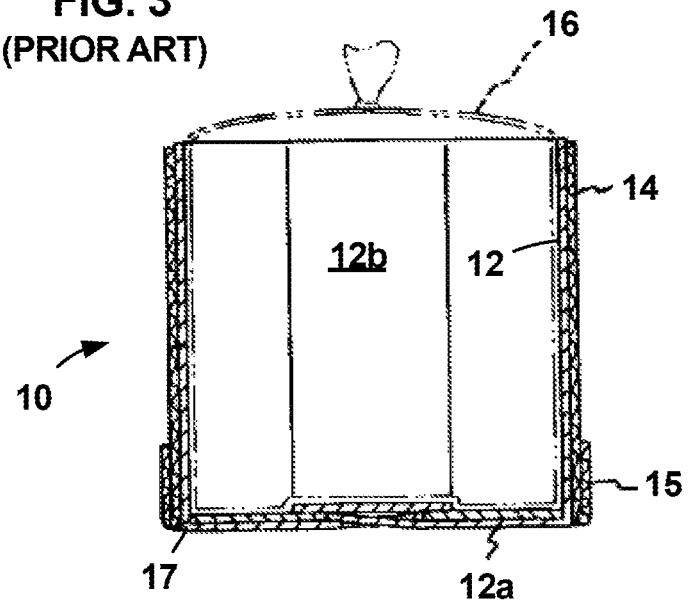
FIG. 3 (PRIOR ART)
FIG. 3 is a sectional view generally taken along the Line 3-3 of FIG. 2.
Figure 4:
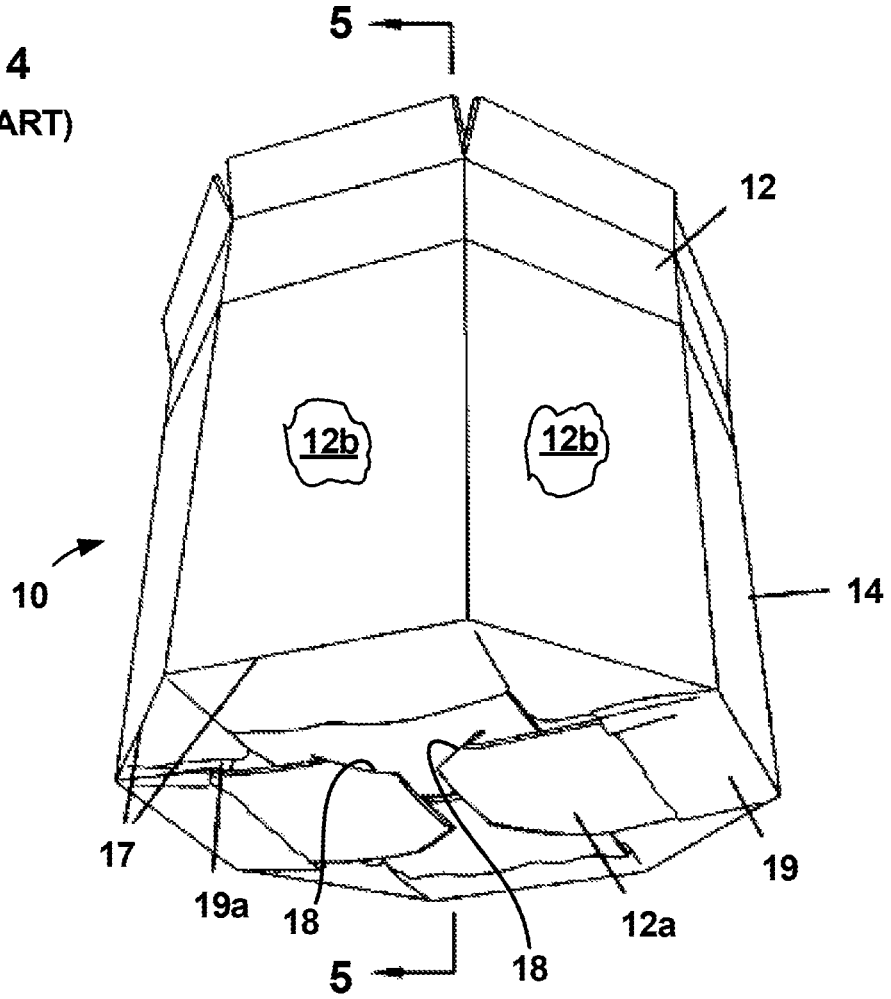
FIG. 4 (PRIOR ART)
FIG. 4 is a bottom perspective view of another prior art bulk material container embodiment illustrating how the outer sleeve member may be folded under the forming member and locking assembly and tucked into gaps formed by the locking assembly at the bottom of the forming member when it is fully assembled.
Figure 8:
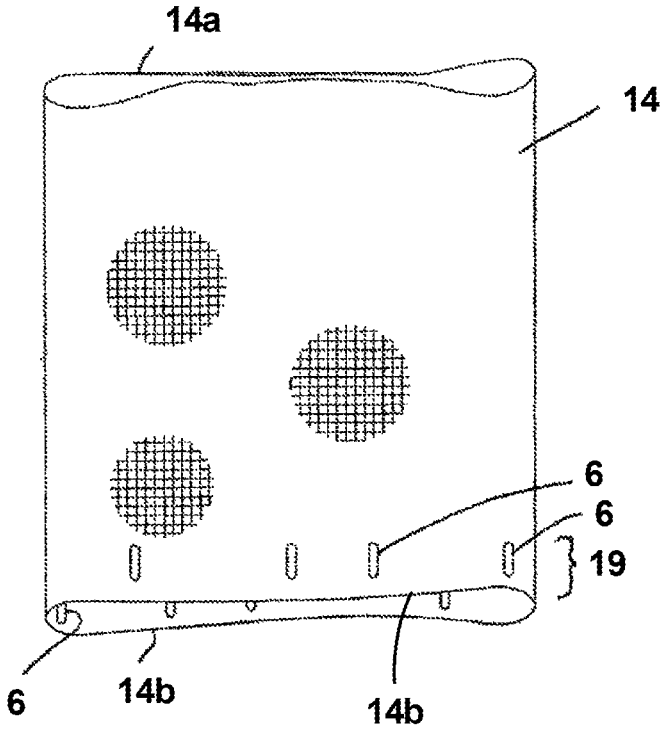
FIG. 8 (PRIOR ART)
FIG. 8 is a diagrammatic pictorial view of a prior art outer sleeve member of a bulk material container illustrating circumferentially spaced connector receptor slots formed through the sleeve material adjacent a lower end of the sleeve.
Figure 9:
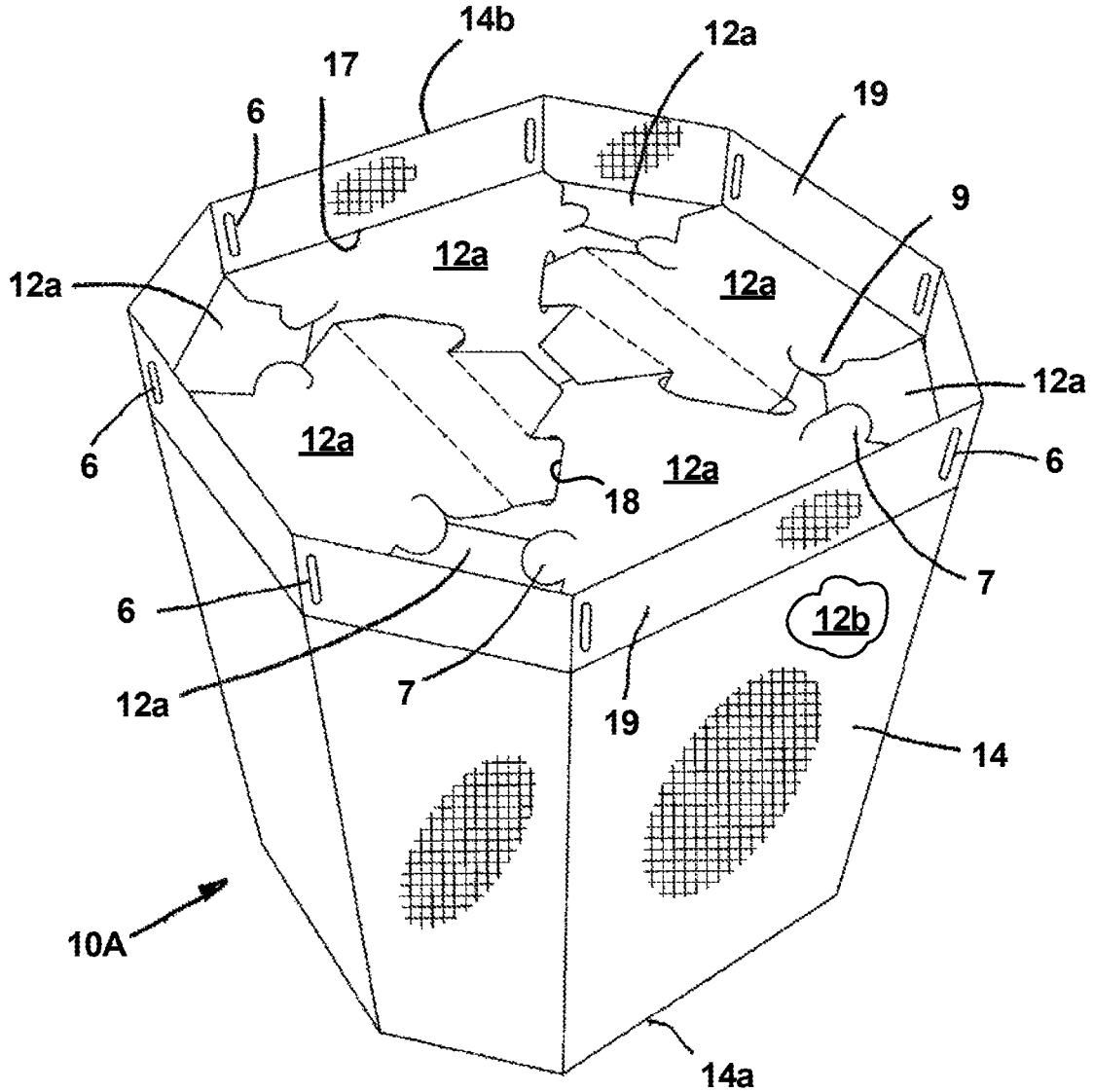
FIG. 9 (PRIOR ART)
FIG. 9 is a pictorial bottom side perspective view of a prior art bulk material container during assembly having the sleeve of FIG. 8 and illustrating the bottom portion of the sleeve positioned in an extended manner below the general plane of an assembled locking assembly bottom of the container, as the sleeve would appear prior to folding it inwardly against and operatively connecting it to sleeve retaining tab members of the locking assembly.
Figure 10:
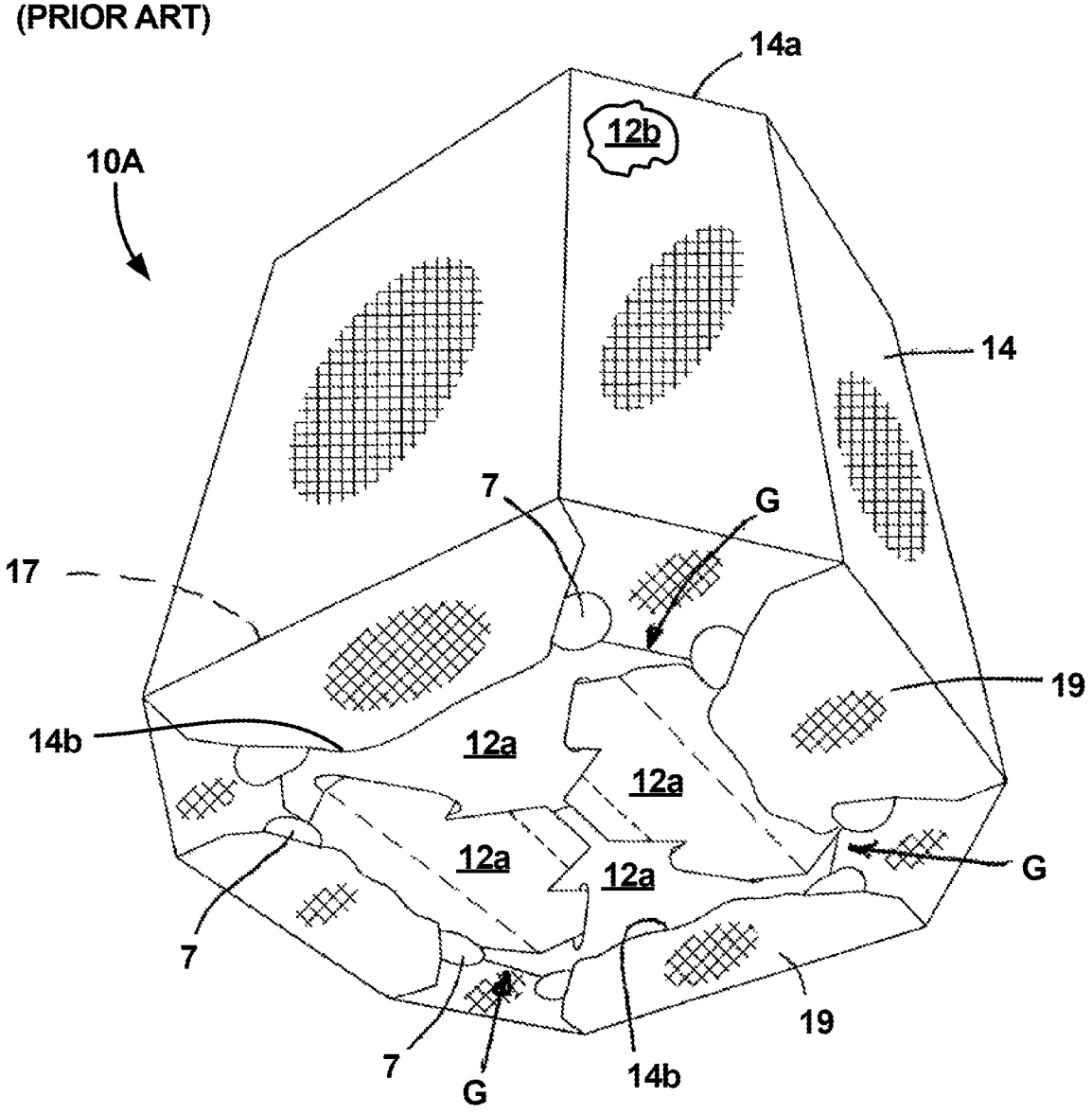
FIG. 10 (PRIOR ART)
FIG. 10 is a pictorial bottom/side perspective view of the completed assembly of the bulk material container of FIG. 9, illustrating the sleeve folded against the bottom of the container with its receptor slots operatively engaging and retainably connected to the sleeve retaining tab members of the locking assembly, and with excess sleeve material at the bottom corners of the forming member tucked into and retained within the sleeve receiving gap portions of the locking assembly.
Figure 23:
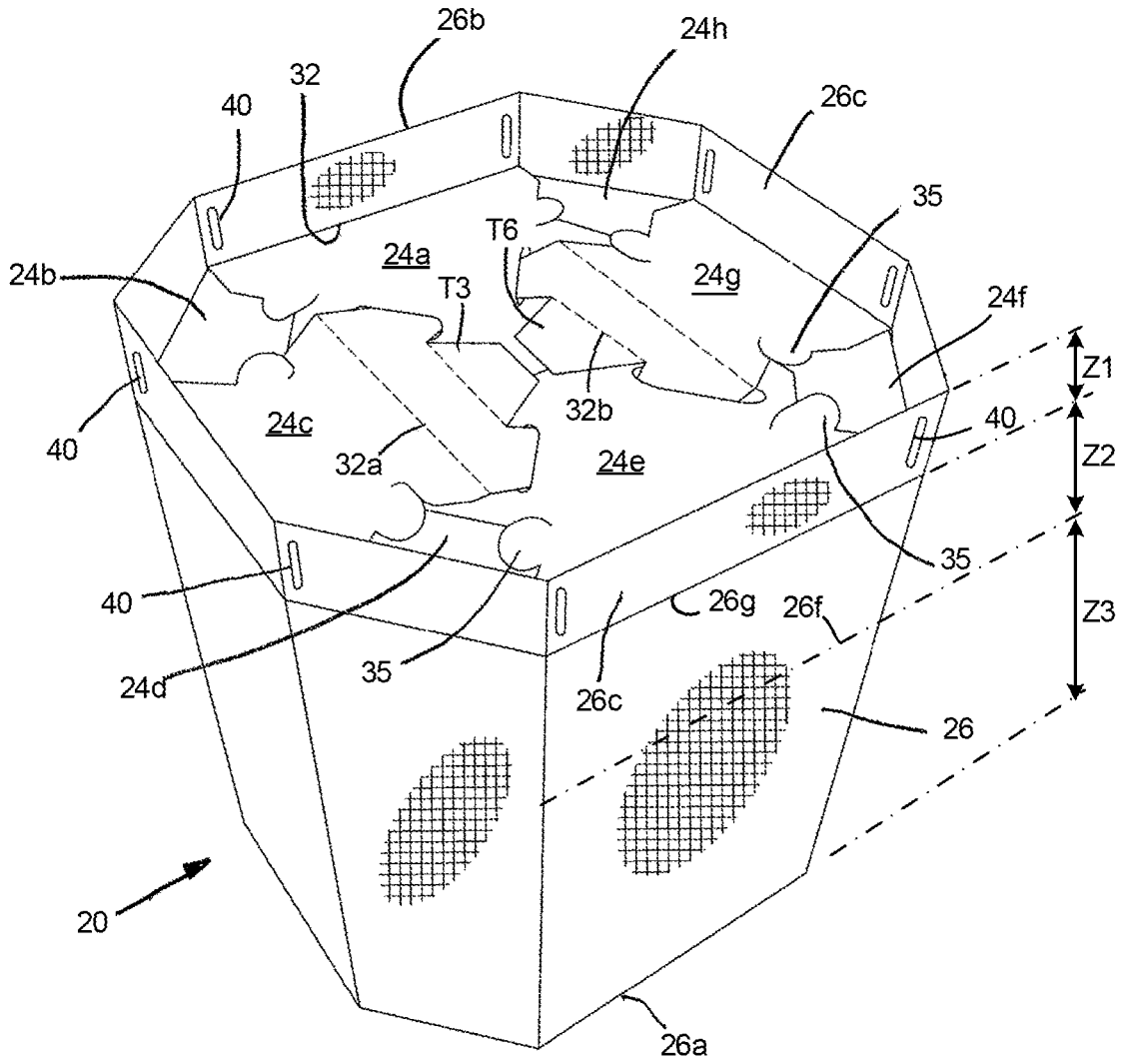
FIG. 23 is a pictorial bottom side perspective view of the bulk material container during assembly, illustrating the bottom portion of the sleeve positioned in an extended manner below the general plane of the assembled locking assembly bottom of the container, as it would appear prior to folding it inwardly against and operatively connecting it to the sleeve retaining tab members of the locking assembly.
Figure 24:
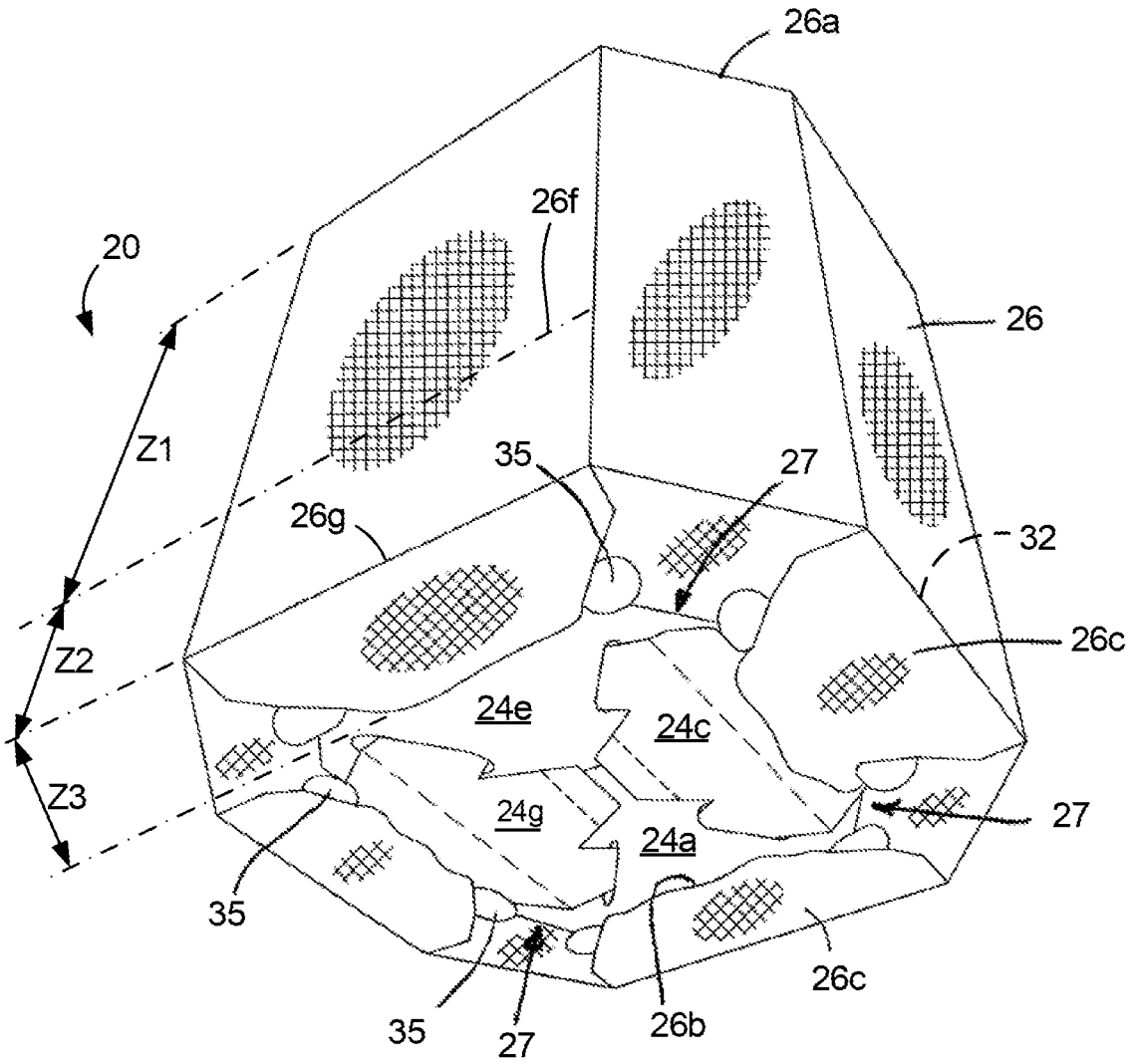
FIG. 24 is a pictorial bottom side perspective view of the completed assembly of the bulk material container of FIG. 23, illustrating the sleeve folded against the bottom of the container with its receptor slots operatively engaging and connected to the sleeve retaining tab members of the locking assembly and with the excess sleeve material at the bottom corners of the forming member tucked into and retained within the sleeve receiving gap portions of the locking assembly.
Figure 25:
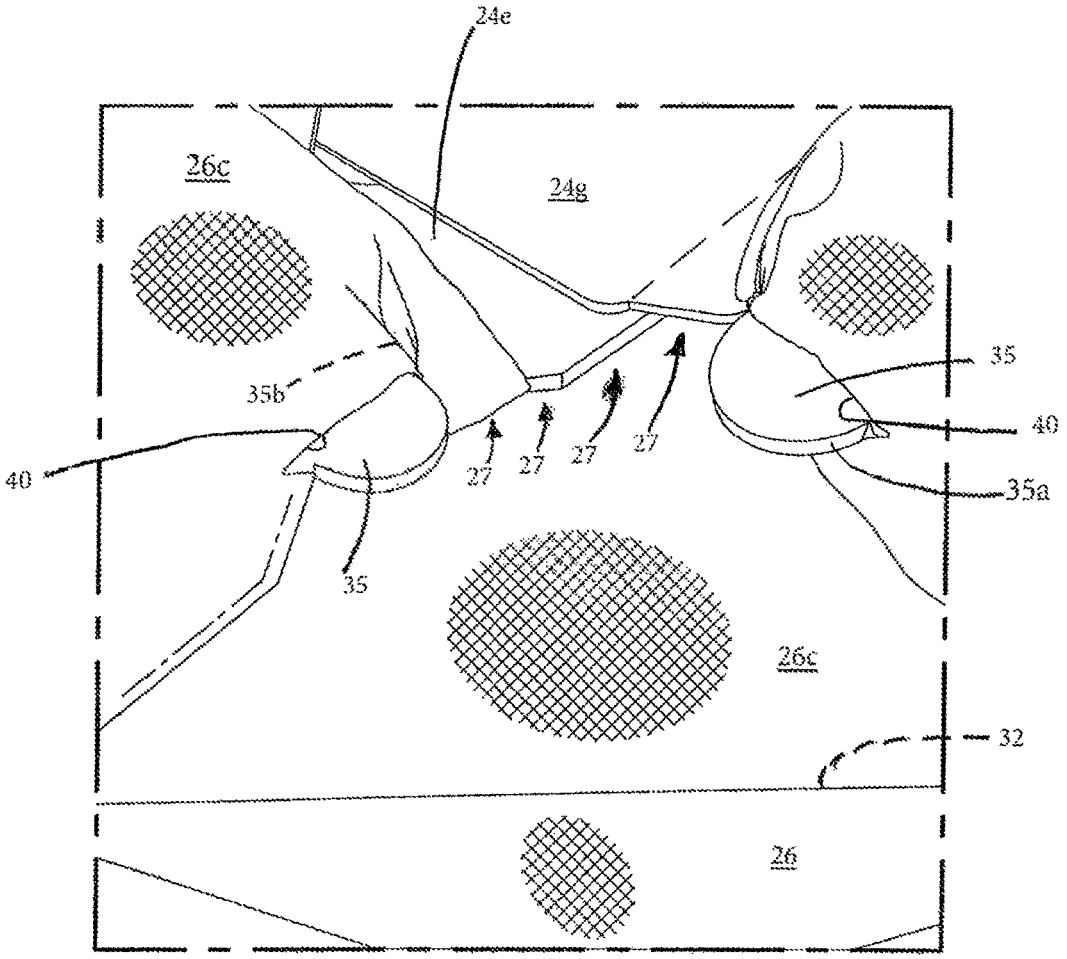
FIG. 25 is an enlarged perspective fractional pictorial view of one of the bottom sleeve retaining tab and gap portions of the assembled bulk material container of FIG. 24.

As shown in FIGS. 4 and 5, it is known to fold a lower portion 19 of a sleeve 14 over the lower edges 17 of a forming member sidewall 12*b* and inwardly toward the internal cavity. It also known to tuck excess portions of the folded undersleeve portion into the gaps "G" formed at the bottom of the fully assembled forming member, as shown at 19*a*. As shown in FIGS. 8-10 and in the U.S. Pat. No. 10,071,842, a securement system for ensuring that the outer support sleeve 26 remains in the desired fixed tucked-in position after operative assembly of the container, regardless of the extent of the movement, sliding or jarring of the assembled container, prior to being filled with bulk material is also known. The sleeve retaining tab members 35 and the spaced slits 40 along the lower portion of the sleeve 26 form a securement system for securing the sleeve 26 to the locking system tabs 35. The tabs 35 and slits 40 are cooperatively sized, shaped and positioned to precisely cooperatively retainably engage one another as the sleeve material is peripherally folded inwardly and along the bottom edge of the container during assembly thereof. FIGS. 23-25 illustrate the bulk container sleeve securement system for the sleeve 26 of this invention.

FIG. 23 is a pictorial illustration of the container 20 in inverted position after assembly of the locking members 24, as described with respect to FIG. 20, showing the outer support sleeve 26 operatively positioned over the sidewalls of the forming member 22 and having its lower portion 26*c* distally extending to its lower edge 26*b* beyond the general plane of the locking assembly 24. The lower sleeve portion 26*c* (which also is the zone Z3 material of the sleeve fabric) includes the plurality of vertical slits 40, each sized to cooperatively retainably engage one of the sleeve's retaining tab members 35. The slits 40 are peripherally spaced along the circumference of the sleeve so as to exactly align with the sleeve retaining tab members 35 formed on the locking member segments, as previously illustrated in FIGS. 17B and 17C. To engage the sleeve 26 to the sleeve retaining tab members 35, the assembler generally with one hand, pushes and folds one section of the bottom sleeve portion 26*c* extending distally from the bottom of one of the sidewalls 22*a*, 22*c*, 22*e* or 22*g* of the forming member 22, inwardly toward the center of the container and against the upper surface of the locking assembly (as viewed in FIG. 23). When folded against and into engagement with the corresponding generally planar locking assembly surface 24*a*, 24*c*, 24*e* or 24*g* the slots 40 of the sleeve bottom portion 26*c* will be positioned in overlying juxtaposition with two of the operatively opposed sleeve engaging tabs 35 extending from the corresponding locking segment 24*a*, 24*c*, 24*e* or 24*g*. After inwardly folding the section 26*c* of the sleeve over the locking segment, the assembly worker grasps opposed end portions of the sleeve extension 26*c* and slides a first end of the sleeve extension portion laterally outward along the top surface of one of the protruding sleeve retaining tab members 35 until the tab 35 begins to slide into the overlying slot 40 of the sleeve. As the tab edge 35*a* cooperatively proceeds into and through the slot 40, the sleeve material adjacent the slot 40 continues to slide into the slit portion 35*b* of the tab assembly and finally proceeds into the terminating hook-shaped end configuration 35*c* of the tab 35, securely pinching and retainably securing the sleeve portion 26*c* to the tab 35 engaged through the slot 40. The assembler performs the same sliding motion (in reverse in the opposite lateral direction) for the other, second end of the strip of sleeve material portion 26*c* he is grasping, securing the second end of the sleeve portion 26*c* to the tab assembly 35. The pair of opposed tabs 35 and their corresponding sleeve slits 40 are cooperatively spaced and aligned such that when both ends of the engaged sleeve strip 26*c* have been secured in opposite directions to the opposed tab members 35, the intermediate sleeve material 26*c* will be tautly stretched between the opposed pair of tabs 35. The assembler works his way around the inverted container, repeating this sleeve securing procedure for each of the distally extending sleeve portions 26*c* for the remaining sidewalls 22*a*, 22*c*, 22*e* and 22*g* as they are folded inwardly over the lower edge 32 of the sidewalls, until the sleeve material 26*c* adjacent the lower edge of each sidewall is securely and tautly fastened to the respectively opposed pairs of sleeve retaining tabs 35, of the locking assembly segments 24*a*, 24*c*, 24*e* and 24*g*. The excess sleeve 26*c* material that naturally bunches up between adjacent secured ends of the sleeve material 26*c* in the vicinity of the sleeve retaining gaps (indicated by the arrows 27), is then rapidly folded and tucked into the sleeve retaining gaps 27, of the locking assembly to complete the container assembly, as shown in FIG. 24, wherein the container 20 is shown inverted from that of the previous assembly steps, back to its normal operative position, for placement on a pallet and subsequent bulk material filling. As discussed above, the ability to selectively weave the fabric material 26*c* of zone Z3 of lighter weight than that of the zone Z2 and possibly zone Z1 sidewall engaging portions of the sleeve, facilitates the assembly steps of securing and tucking the sleeve 26*c* portion to the bottom of the container. While the illustrations in FIGS. 23 and 24 show the top 26*a* of sleeve 26 extending all the way to the top of the sidewalls 22, the top edge 26*a* of the finally positioned sleeve 26 is typically slightly below the top edge 31 of the sidewalls, as illustrated in FIG. 17C.

FIG. 25 is an enlarged pictorial view similar to that of FIG. 22 illustrating cooperative engagement of two adjacent sleeve retainer tab members 35 with slots 40 of the sleeve 26, and the tucking under of excessive sleeve material between the adjacent tab members 35 into the adjoining sleeve retaining gap 27.

The entire process of securing the lower portion 26*c* of the outer support sleeve 26 to that sleeve retaining tabs 40 is performed rapidly due to repetition of the process. Further, the assembly step does not add any significant time to prior container assembly processes since the prior assembly practice performed the same folding and tucking operations on prior bulk containers that did not contain any positive sleeve securement structures or procedures such as provided by this invention. The taut nature of the secured sleeve portions 26*c* against the bottom of the locking assembly and placement of the securing tabs adjacent the apex of the sleeve retaining gaps 27 combine to retainably hold and maintain the tucked-in sleeve material within the gaps 27, by the reducing the chance of the tucked-in sleeve material from being snagged and pulled out from the slot during handling of the assembled but unfilled container. As stated above, once filling of the container begins and the weight of the contained bulk material increases, downward pressure exerted by the material on the lower locking assembly portions forming the sleeve retaining gaps 27 increases, tightly sandwiching and retainably holding the sleeve material therebetween as the loading pressure continue to increase and is maintained during transport of the container.

Once assembled, the container can be inverted to its operative position and placed on a pallet for filling with bulk material as illustrated in FIG. 12 in conventional manner. If desired, an optional inner liner 28 can be inserted within the forming member 22 as is known in the art and described in more detail in the incorporated U.S. Pat. No. 6,932,266. The liner 28 can be secured along its open upper end by the tabs 38, to maintain it in an "open" position during its filling by the bulk material.

It will be appreciated by those skilled in the art that the inventive use of selective sleeve strength weaving of the weft threads of bulk container sleeves applies to other sleeve configurations than those previously described, and to variations of previously described sleeve configurations, as for example, to sleeve configurations described in U.S. Pat. No. 10,065,782 entitled BULK MATERIAL CONTAINER SLEEVE AND METHOD OF ASSEMBLY issued on Sep. 4, 2018, fully incorporated herein by reference. The U.S. Pat. No. 10,065,782 described techniques for modifying tubular woven sleeves to accurately reduce the inner circumference dimension of oversized sleeves to a desired nominal dimension along their entire length so that the sleeve can snugly operatively engage the outer forming member sidewall surfaces of a bulk material container. The sleeve configurations described in the U.S. Pat. No. 10,065,782 are similar to those previously discussed but include one or more post weaving formed adjustment tail portions that reduce an initially oversized inner sleeve circumference dimension to a desired adjusted inner circumference dimension. Creation of the adjustment tail(s) to size the sleeve inner circumference to the desired dimension can be incorporated into and form an operative step of an assembly line operation in which the tubular sleeve is first continuously woven, or can be later performed prior to the container assembly step of applying the sleeve in overlying engagement with the forming member.

Two sleeve configurations employing the size altering techniques disclosed in the U.S. Pat. No. 10,065,782 are illustrated in FIGS. 26A, 26B and 27A, 27B. Referring thereto, the initial configuration of the continuously woven sleeve 26 is of the same construction as that of FIG. 19 and employs the selective fabric strength weaving of this invention to provide three longitudinally contiguous zones Z1, Z2, Z3 of selectively differing fabric weights and strengths. In the embodiments illustrated, as with previously described selectively varying fabric weight zones, the fabric weight in zone Z1 has its weft threads of equal or less weight than its warp threads. The weight of the weft threads in zone Z2 is greater than that of the weft threads in zone Z1, and is preferably greater than the warp thread weight, to provide a fabric zone of significantly increased strength where it is most needed. The weft thread weight in zone Z3 can also be less than that of the zone Z2 weft threads.

Figure 26A:
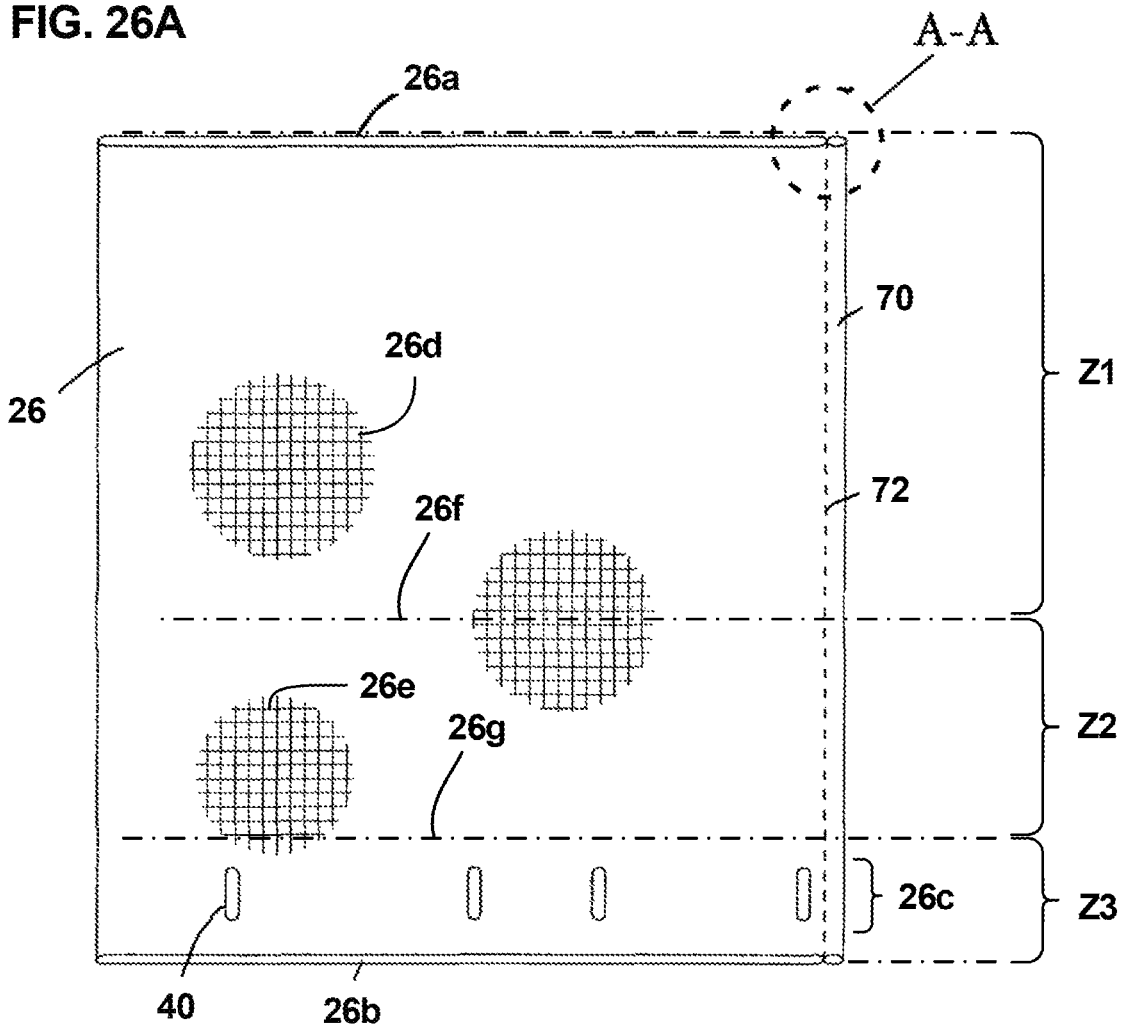
FIG. 26A is a diagrammatic pictorial view of an embodiment of a bulk material container outer sleeve member configured according to this invention, having an adjustment tail portion with an included stitched bonding strip longitudinally extending along one side of the sleeve member.
Figure 26B:
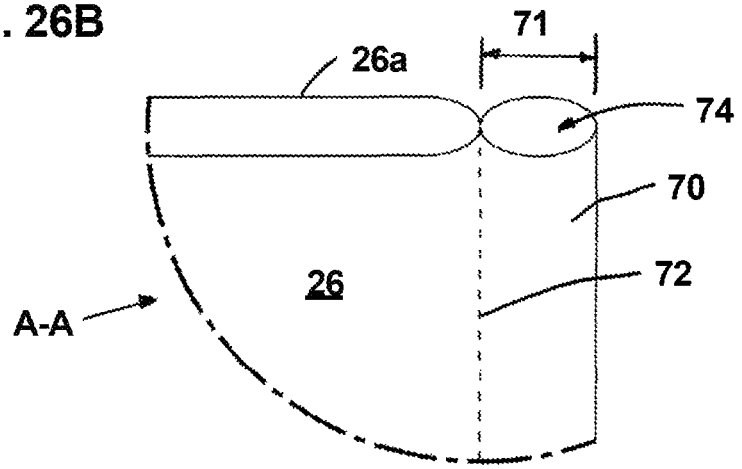
FIG. 26B is an enlarged fragmentary view of a corner end portion of the outer sleeve member of FIG. 26A that is enclosed within the dashed Circle A-A of FIG. 26A.

The initial inner sleeve circumference is reduced to a desired value by forming one or more adjustment tails from the woven sleeve fabric. FIGS. 26A and 26B illustrate a sleeve 26 with one adjustment tail. The adjustment tail 70 as shown, is formed by folding over and pinching together a portion of the sleeve material along a longitudinal edge of the sleeve and by securing the pinched engaged inner surfaces of the sleeve material together by stitching or other sleeve adhesion techniques, generally indicated at 72 to form a cross-sectional loop 74 and longitudinally extending tail of material 70 having a tail width 71 as measured in the lateral sleeve direction and longitudinally extending the length of the sleeve from its top 26*a* to its bottom 26*b* edges respectively. It will be noticed that since the woven weft threads continuously laterally run through the sleeve material forming the adjustment tail, the fabric material forming the adjustment tail is also included within the selective fabric weight zones.

Figure 27A:
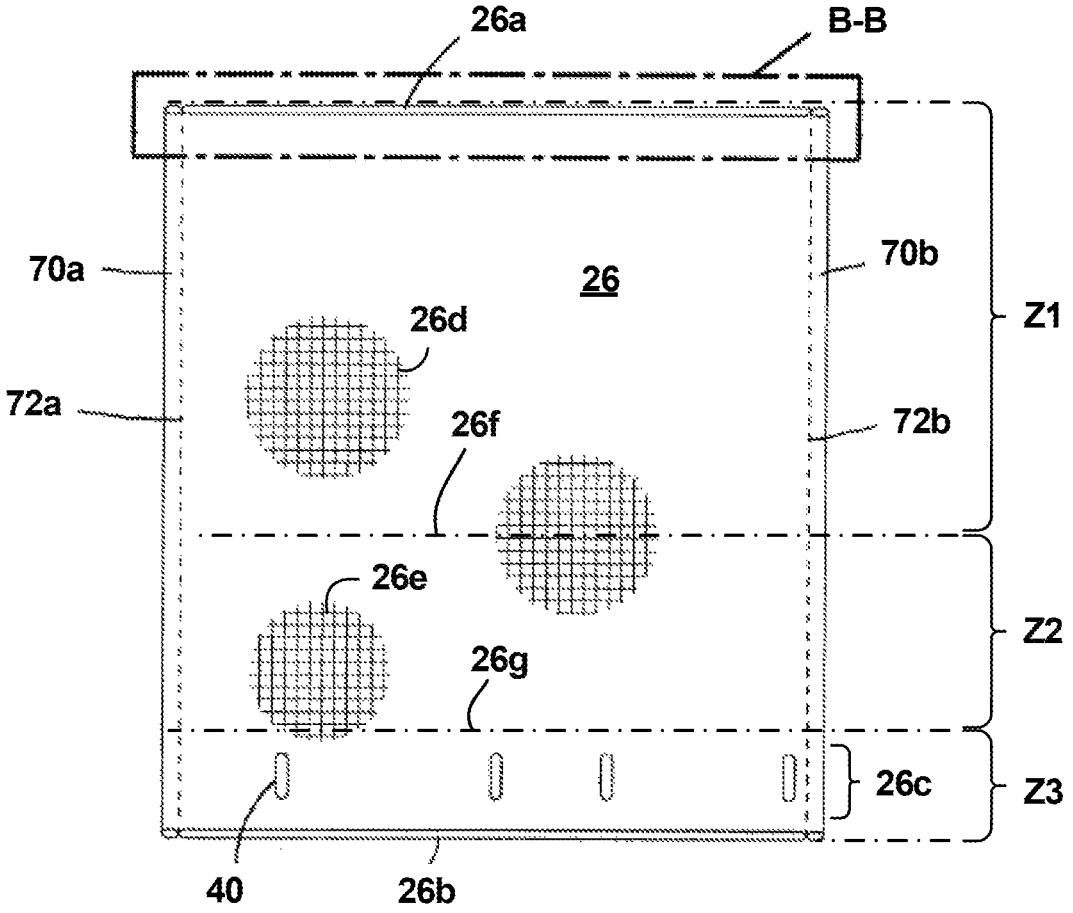
FIG. 27A is a diagrammatic pictorial view of a second embodiment of a bulk material container outer sleeve member configured according to this invention, having a pair of circumferentially spaced adjustment tail portions, each including a stitched bonding strip longitudinally extending along opposite sides of the sleeve member.
Figure 27B:
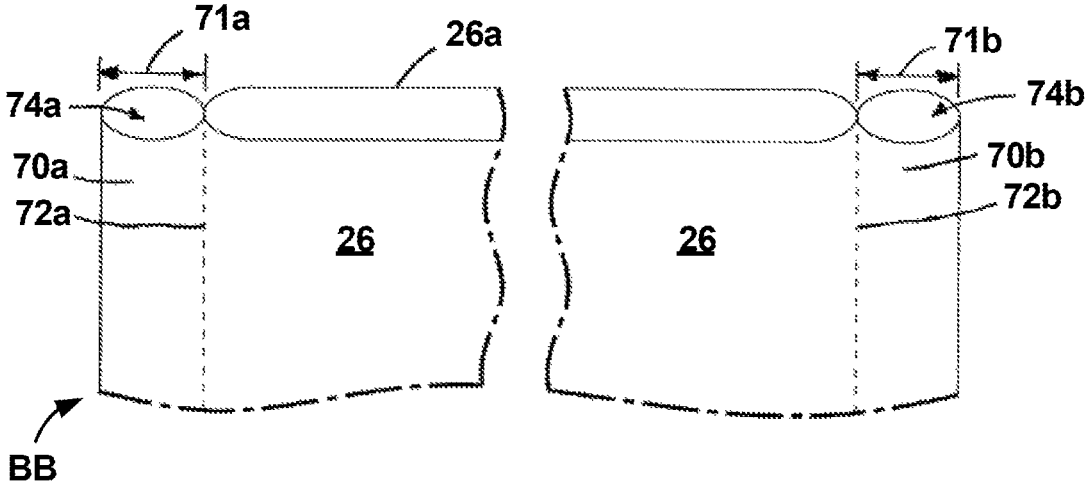
FIG. 27B is an enlarged fragmentary view of the upper end portion of the outer sleeve of FIG. 27A that is encircled within the dashed Lines B-B of FIG. 27A.

FIGS. 27A and 27B illustrate the sleeve 26 constructed according to principles of this invention, having a pair of oppositely laterally opposed adjustment tails 70*a* and 70*b* that are of the same configuration and construction as the adjustment tail 70, previously discussed with respect to the sleeve configuration of FIG. 26. Besides reducing the inner circumference dimension of the sleeve, the adjustment tail material can be physically used to facilitate manual or automated processes for assembly of the sleeve to the container forming member 22 and locking assembly 24, since the tail material provides an externally engagable piece of the sleeve that can be grasped and manipulated by hand and/or automated equipment. For a more detailed explanation of the configuration, design considerations, methods of forming and using adjustment tails, the reader is referred to the U.S. Pat. No. 10,065,782 which has been fully incorporated herein by reference.

The principles of this invention also apply to bulk material containers having a sleeve component located internally of the container forming member as opposed to those previously described which snugly engage the outer surfaces of the container forming members. As discussed previously, the herein incorporated U.S. Pat. No. 9,296,511 describes such a collapsible bulk material container having an outer open architecture forming member framework that defines the outer geometrical shape and volumetric containment properties of the container, into which is inserted a sleeve or bag of continuously woven material that provides the primary bulk material containment strength of that container. An example of such a bulk material container which incorporates the principles of this invention, is illustrated herein with reference to FIGS. 28-36.

Figure 11:
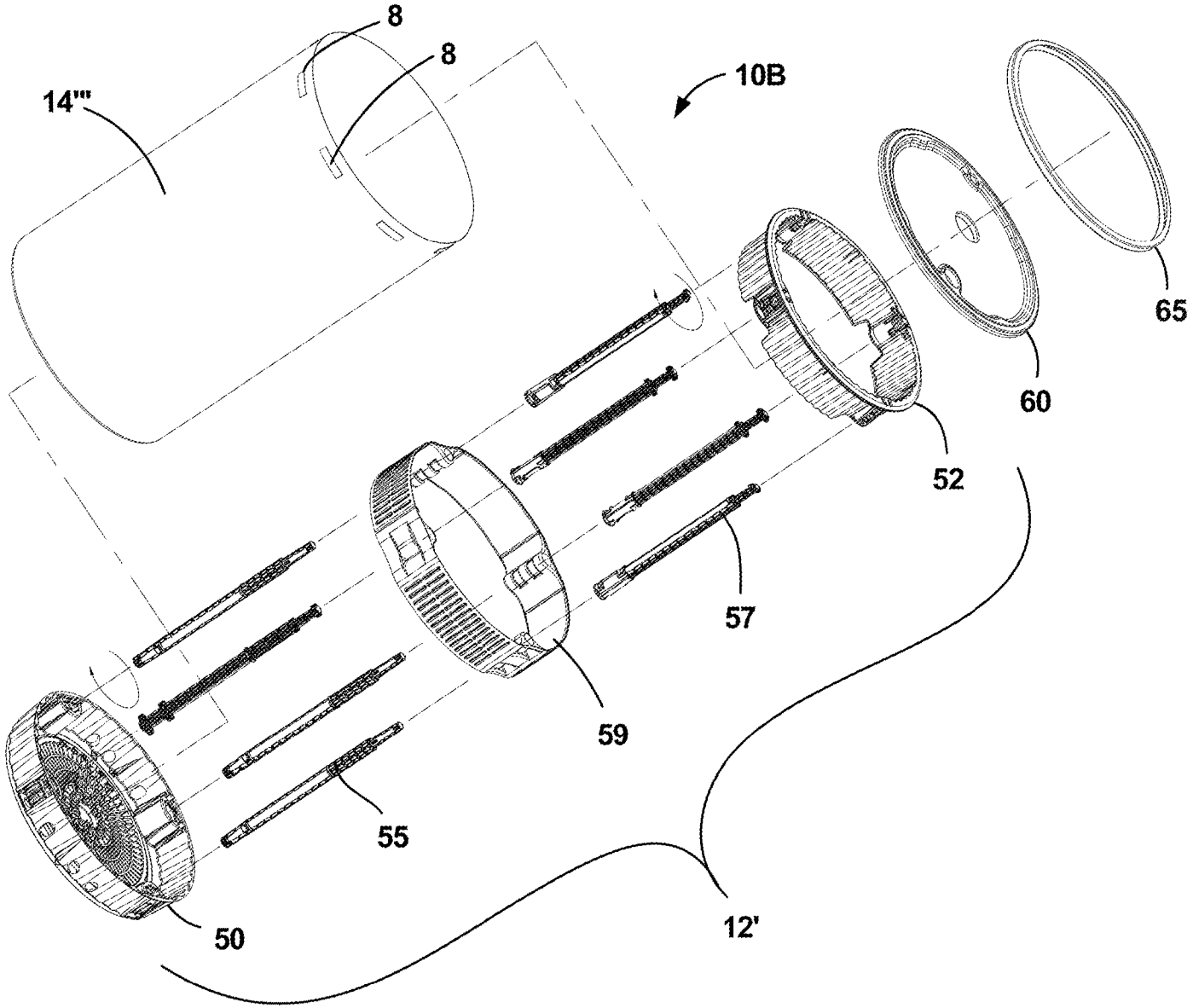
FIG. 11 is an exploded perspective view of a prior art bulk material container wherein the shape defining forming member and locking assembly define an outer frame configuration into which the strength providing sleeve material is inserted.
Figure 28:
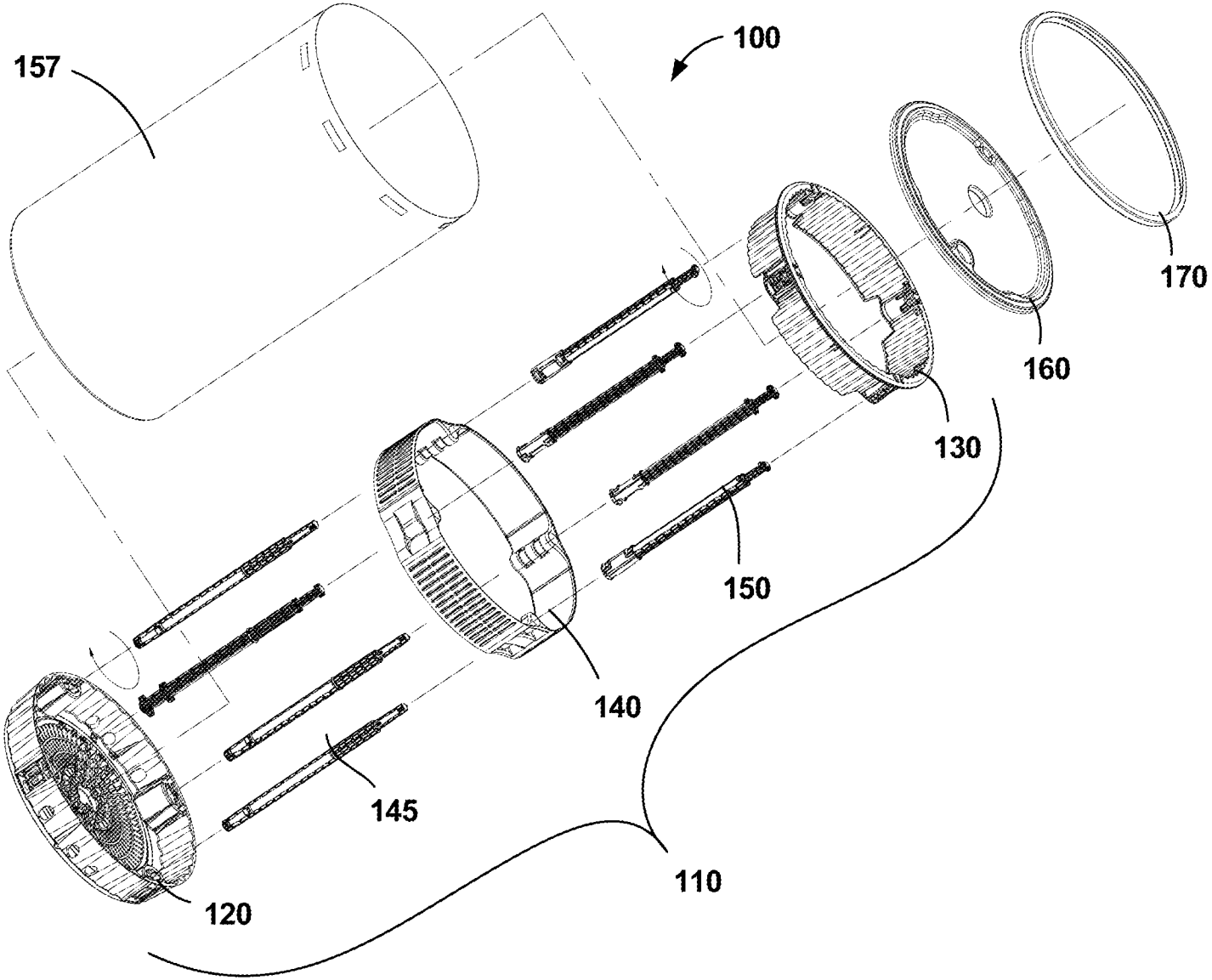
FIG. 28 is an exploded perspective view of a bulk material container wherein the shape defining forming member and locking assembly define an outer frame configuration into which a strength providing sleeve configured according to this invention, is inserted.

FIG. 28 generally illustrates in exploded perspective view, a collapsible bulk material container 100 having an external open architecture (not solid wall) forming member framework 110 that generally surrounds an internal sleeve or bag of continuously woven material. Except for the construction of the internal sleeve or bag of the container, the container 100 of FIG. 28 is generally the same as that of FIG. 11 and is described in detail in the U.S. Pat. No. 9,296,511. Referring to FIG. 28, the container 100 generally includes an external framework forming member assembly 110, and a woven sleeve or bag 157 cooperatively insertable and contained within and engaging the forming member assembly 110, to contain a volume of bulk material. While not limited to such configuration, the container 100 illustrated generally has an external cylindrical shape that would replicate or replace a cylindrical solid wall container such as that of a 55 gallon drum-type of container. Examples of other configurations are disclosed in the U.S. Pat. No. 9,296,511. As was the case with previously described bulk container configurations, the external framework forming member assembly 110 defines the geometric volumetric configuration and shape of the container, while the internal sleeve/bag 157 provides the container's primary bulk material containment strength for counteracting the outward radial forces applied by the bulk material to the container. The forming member assembly 110 includes a lower base member 120, an upper ring member 130, an intermediate band member 140, a plurality of lower post members 145 and a plurality of upper post members 150. The components forming the external framework assembly 110 are cooperatively detachably connected to one another but when operatively interlocked with one another form a generally rigid framework structure.

Figure 30:
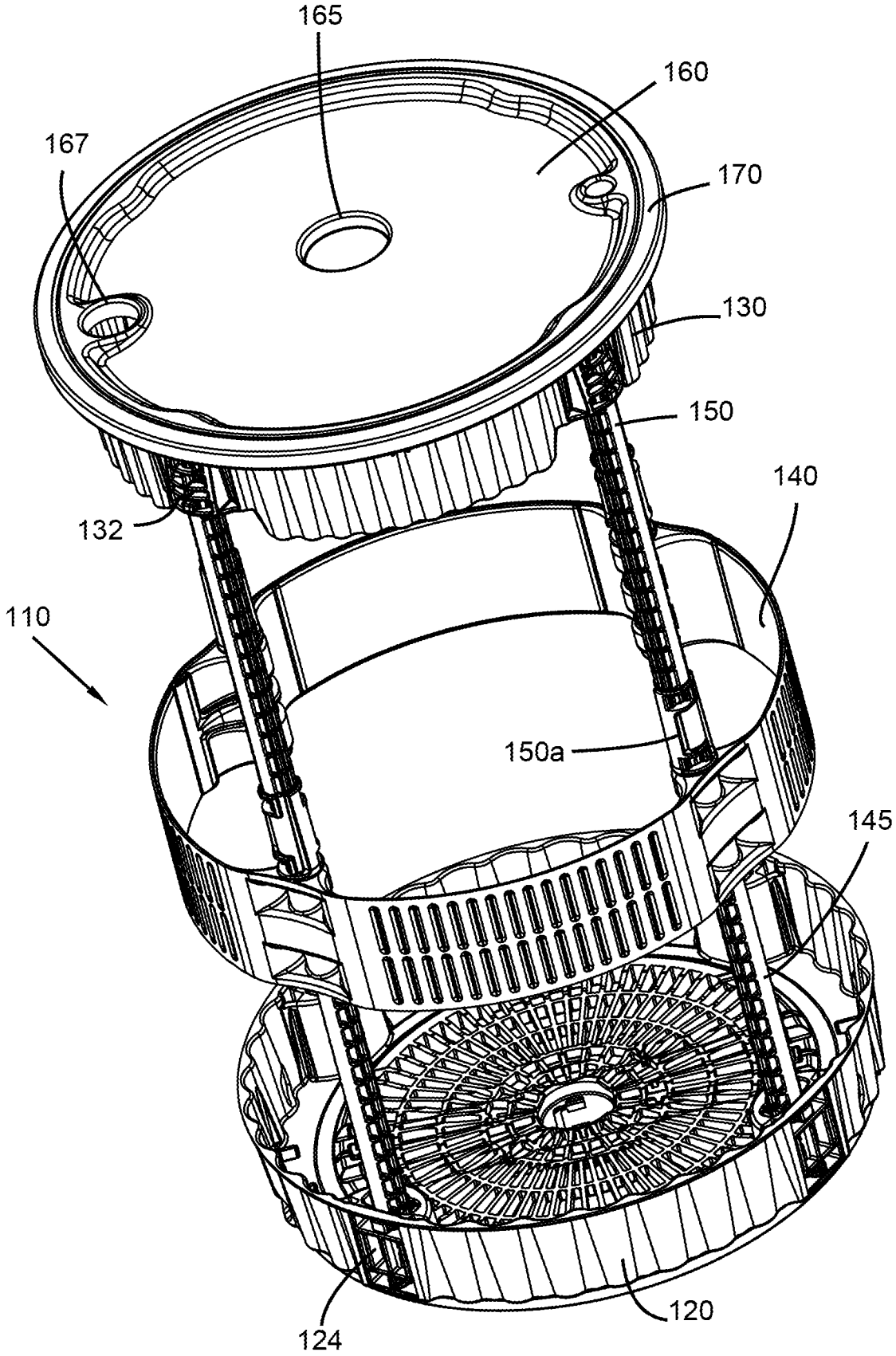
FIG. 30 is a top back perspective view of the assembled framework portion of the container assembly of FIG. 28 shown without the woven fabric bag and including the top cover and tightening band portions thereof.

The external framework forming member assembly 110 is shown in operatively connected configuration in FIG. 30. Referring thereto, the lower post members 145 are of identical construction, as are the upper post members 150. The lower base member 120 has a generally dish-shaped cylindrical configuration having an internal upwardly facing floor portion upon which a lower portion of the support sleeve or bag 157 can rest. The lower base member 120 has a plurality of peripherally spaced receptor configurations 124 arranged and configured to cooperatively receive the lower end portions of the lower post members 145 which interlock with the lower post receptors to rigidly secure the lower post members 145 in vertical orientation. The upper distal ends of the lower post members are guided by and pass through inner peripherally spaced portions of the intermediate band member 140, which is supported by the lower post members in parallel spaced manner with and overlying the lower base member 120, as illustrated in FIG. 30. The lower ends of the upper post members 150 are configured with hollow receptor portions 150*a* for cooperatively sliding over and retainably receiving the upper distal ends of the lower post members 145. When interlocked with the lower post members 145, the upper post members 150 form a rigid longitudinal extension of the lower post members. The body portions of the upper and lower post members are of generally similar construction and strength. The upper distal ends of the upper support post members 150 are configured to be cooperatively received by peripherally spaced upper post receptor portions 132 of the cylindrical upper ring member 130 and cooperatively interlock with the upper ring member 130 to form the rigid frame structure 110 therewith and with the lower post members 145 and the lower base member 120. When operatively rigidly secured to one another, the component members of the external framework assembly 110 provide a generally rigid open architecture framework that facilitates moving and handling of the bulk material container 100. The intermediate support band 140 is molded in a generally flat configuration and subsequently bent or formed into a circular configuration as shown in FIG. 30 and maintained in that configuration by a living hinge fastening structure. The intermediate band member 140 is vertically positioned relative to the lower post members 145 at a position to help counteract the outward radial forces applied to the forming member framework 110 by the contained bulk material, and at a lower position along the framework, where larger radial bulging forces are exerted by the bulk material.

A top cover 160 is configured to cooperatively seat upon and cooperatively seal the upper opening of the upper ring member 130 and is secured thereto by means of a tightening band 170 as shown in FIG. 30. The rigid top cover provides structural strength to the container 100 when the container is stacked with another container, and/or when the container is stacked in collapsed manner for transport or storage when not in operative use, hereinafter described. The cover 160 includes a pair of through-holes 165, 167, (referred to in the industry as bungholes) formed through the cover and internally threaded to receive standard threaded plugs to provide access to the container's internal cavity when the cover is attached to the container. The upper surface configuration of the cover 160 and the lower surface configuration of the lower base member 120 are cooperatively configured to engagably mate with one another to facilitate stacking of containers 100 upon one another, both in operatively assembled and in collapsed storage configurations. The upper ring member 130 includes a plurality of sleeve support hook members (not shown) equally spaced along and extending inwardly from the inner upper periphery of the upper ring 130. The sleeve support hook members are used to hold the support sleeve (described below) in position within the outer framework 110 prior to and during loading of bulk material into the container.

Figure 32:
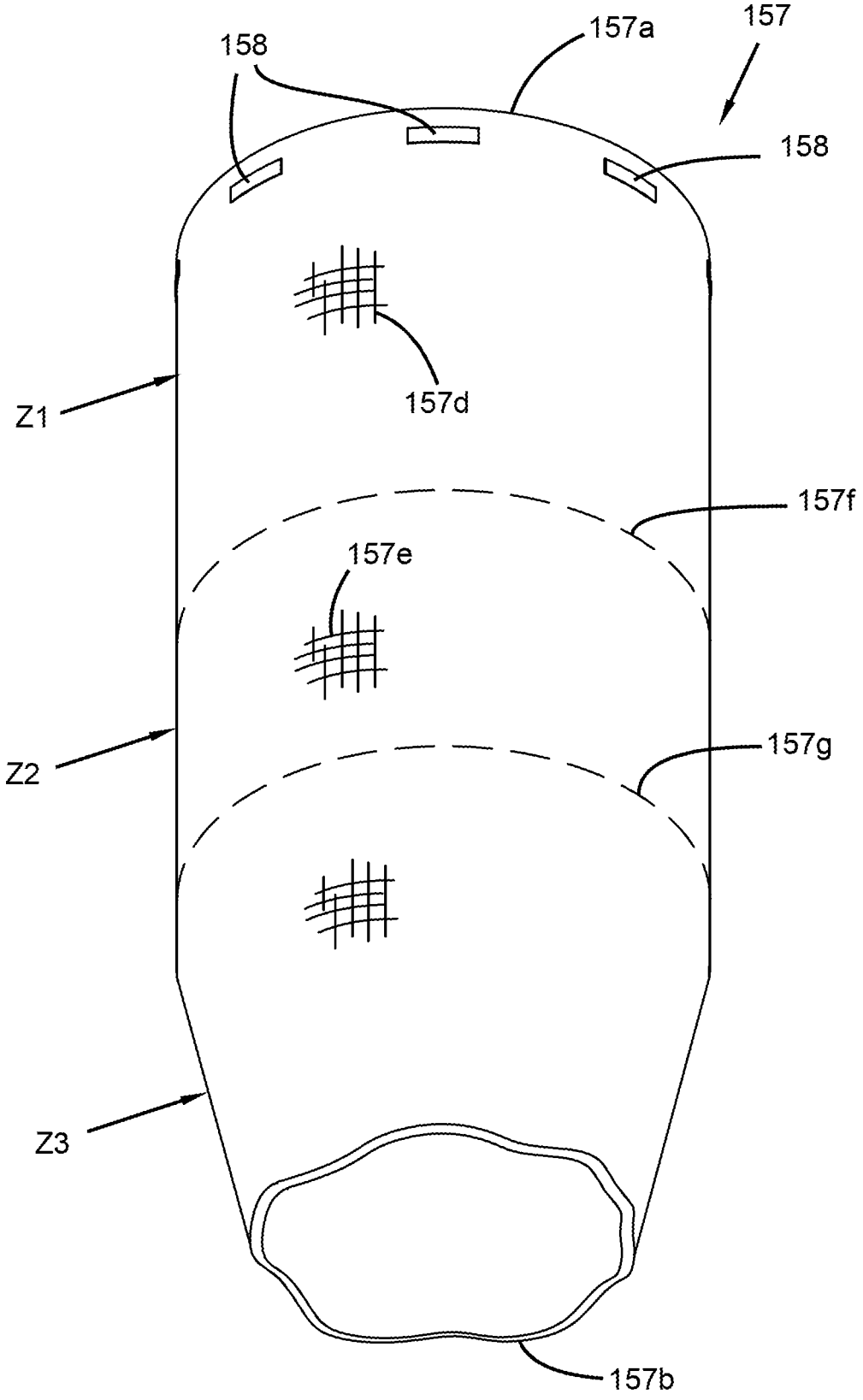
FIG. 32 is a bottom, side perspective diagrammatic view of a woven fabric sleeve portion of the container assembly of FIG. 28.

FIG. 32 illustrates a fabric support sleeve 157 that is inserted within and engages the forming member framework 110 and into which the bulk material is loaded. As previously described, an optional liner (not shown) may be inserted into the support sleeve to isolate the bulk material from directly touching the fabric of the sleeve, particularly for liquid bulk material loads. The sleeve is configured from a continuously woven fabric material of the type previously discussed with respect to open ended sleeves such as that shown in FIG. 19, without the tab retainer slots 40. The sleeve 157 extends between upper and lower edges 157*a* and 157*b* respectively, and as illustrated has three contiguous zones (Z1, Z2, and Z3) of selectively varying fabric weight. It will be understood that the sleeve could contain more or less zones than illustrated. The fabric warp threads are indicated at 157*d*, and the fabric weft threads are indicated at 157*e*. The zone Z1 fabric extends from the upper sleeve edge 157*a* to the boundary indicated at 157*f*. The zone Z2 fabric extends between the boundaries 157*f* and 157*g*. The zone Z3 fabric extends from the boundary 157*g* down to the lower edge 157*b* of the fabric. The fabric weight in zone Z1 has its weft threads of equal or less weight than its warp threads. The weight of the weft threads in Zone 2 is greater than that of the weft threads in zone Z1, and preferably greater than the warp thread weight, to provide a fabric zone of significantly increased strength where it is needed most. The weft thread weight in zone Z3 can be less than or equal to that of the zone Z2 weft threads. The sleeve 157 has a plurality of sleeve support straps or loops 158 that are sewn in spaced manner around the outer periphery of the sleeve adjacent its upper end 157*a*. The sleeve support straps 158 are arranged and configured to identically align with and to cooperatively engage the spaced sleeve support hooks inwardly extending from the upper ring member 130, to operatively hang the sleeve in open manner within the internal cavity defined by the outer forming member framework 110. It will be noted that the sleeve 157 of FIG. 32 is open ended at its bottom. The width (measured between the zone boundaries 157*g* and 157*b*) of the zone Z3 material is illustrated as being significantly longer than was the case with the FIG. 19 sleeve 26. The longitudinal length of sleeve 157 is sized such that the sleeve fabric of zone Z3 of the sleeve will engage and fold-over upon itself onto the upper surface of the lower base member 120 to form a closed bottom of the sleeve, and such that the lower boundary 157*g* of the zone Z2 material will also engage the upper surface of the lower base member 120, when the sleeve 157 is operatively hung from the upper ring member 130 by the sleeve support straps 158. In such operative position, the fabric material of zone Z2, which is woven with the heaviest and strongest fabric will be positioned to intercept the greatest radial outward forces applied to the sleeve by the contained bulk material, which generally occurs in the region from 20 to 50% up from the upper surface of the lower base member 120. Such folded-over bottom sleeve configuration operatively forms a closed bottom of the sleeve for retaining solid bulk materials such as granular or particulate materials. As with previously described sleeve configurations, the sleeve fabric is preferably woven from polypropylene material that can also be embedded with resin coatings of polyethylene or polypropylene materials.

Figure 33:
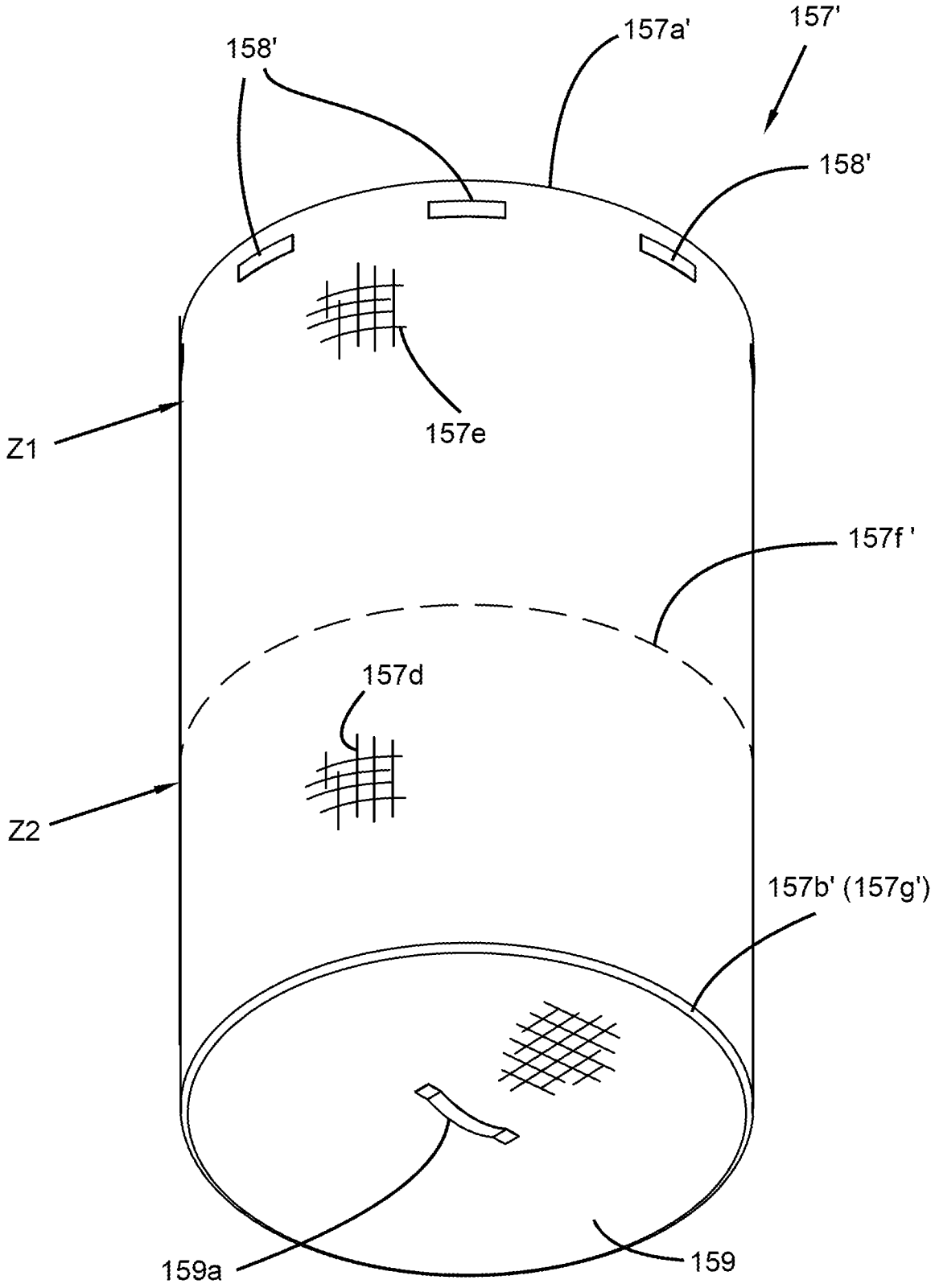
FIG. 33 is a bottom side perspective diagrammatic view of a woven fabric bag alternative for the woven fabric sleeve portion of the container of FIG. 32.
Figure 34:
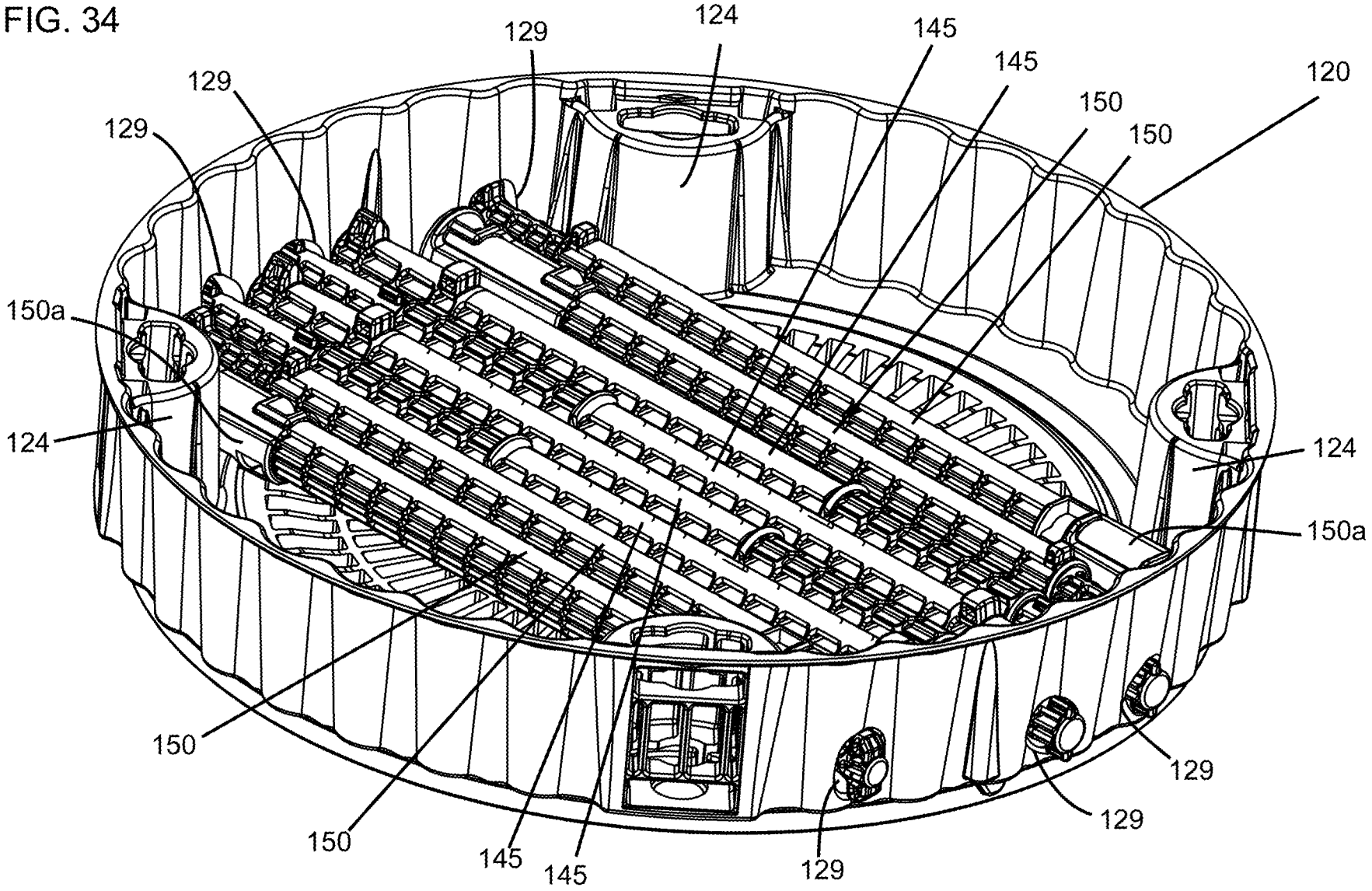
FIG. 34 is a top, side perspective view of the base member of the container in unassembled configuration, showing storage placement of the upper and lower post members of the container therein.

FIG. 33 illustrates a continuously woven sleeve member 157' which is generally the same as that of FIG. 32, without the lower zone Z3 forming a lower extension of the zone Z2 material but with a woven fabric panel 159 sewn to the bottom edge 157' of the sleeve material to form a bottom surface of the sleeve, converting it into a bag-like structure. The bag 157' has a first selective weight material zone Z1 extending from the upper edge 157*a*' of the bag to a lower boundary 157*f*', and a contiguous second zone Z2 of material extending between the upper boundary 157*f*' to a lower boundary 157*g*'. As with previously described sleeves of selectively woven weight fabrics the fabric weight of the zone Z2 material will be heavier/stronger than the weight of the zone Z1 fabric. When the bag 157' is operatively hung by its support straps 158' from the hook members of the upper ring 130, the bag bottom 159 will rest upon and be supported by the upper surface of the lower support base 120, and the lower edge 157*b*' of the bag 157' will be coterminous with the lower boundary 157*g*' of the zone Z2 material, as indicated in FIG. 33. In the bag embodiment illustrated in FIG. 33, a loop strap 159*a* is centrally secured to the bottom of the bag bottom 159 which can be secured to a corresponding hook 123*a* on the bottom of the lower base member 120 (accessible through a centrally located hole formed through the bottom of the lower base member 120) and is illustrated in FIG. 31B, to hold the bag member in operative position within the forming member framework 110 prior to loading of bulk material into the container.

Figure 29:
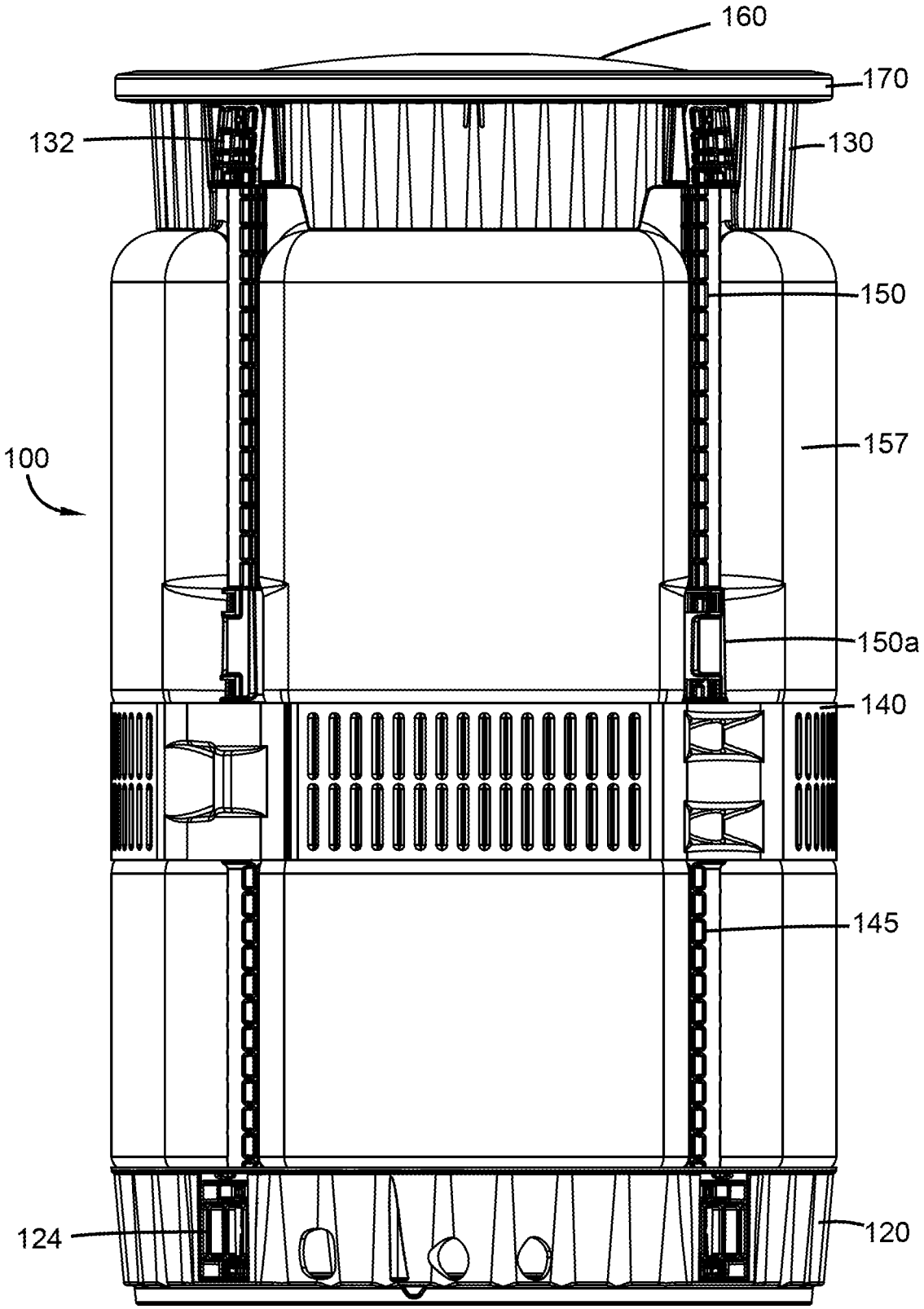
FIG. 29 is a diagrammatic front plan view of the container assembly of FIG. 28 in assembled configuration.
Figure 31A:
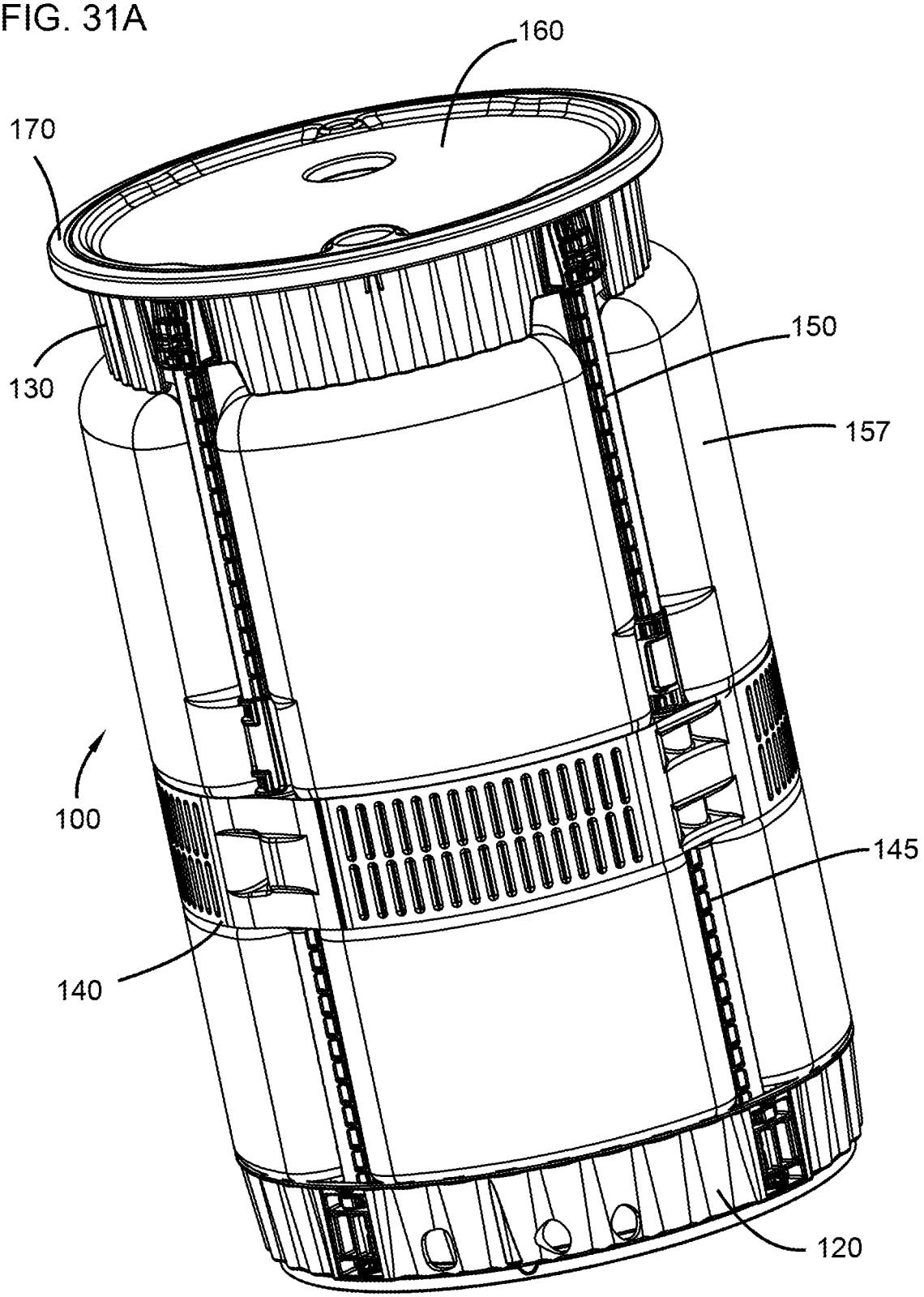
FIG. 31A is a diagrammatic top front perspective view of the container assembly of FIG. 29.
Figure 31B:
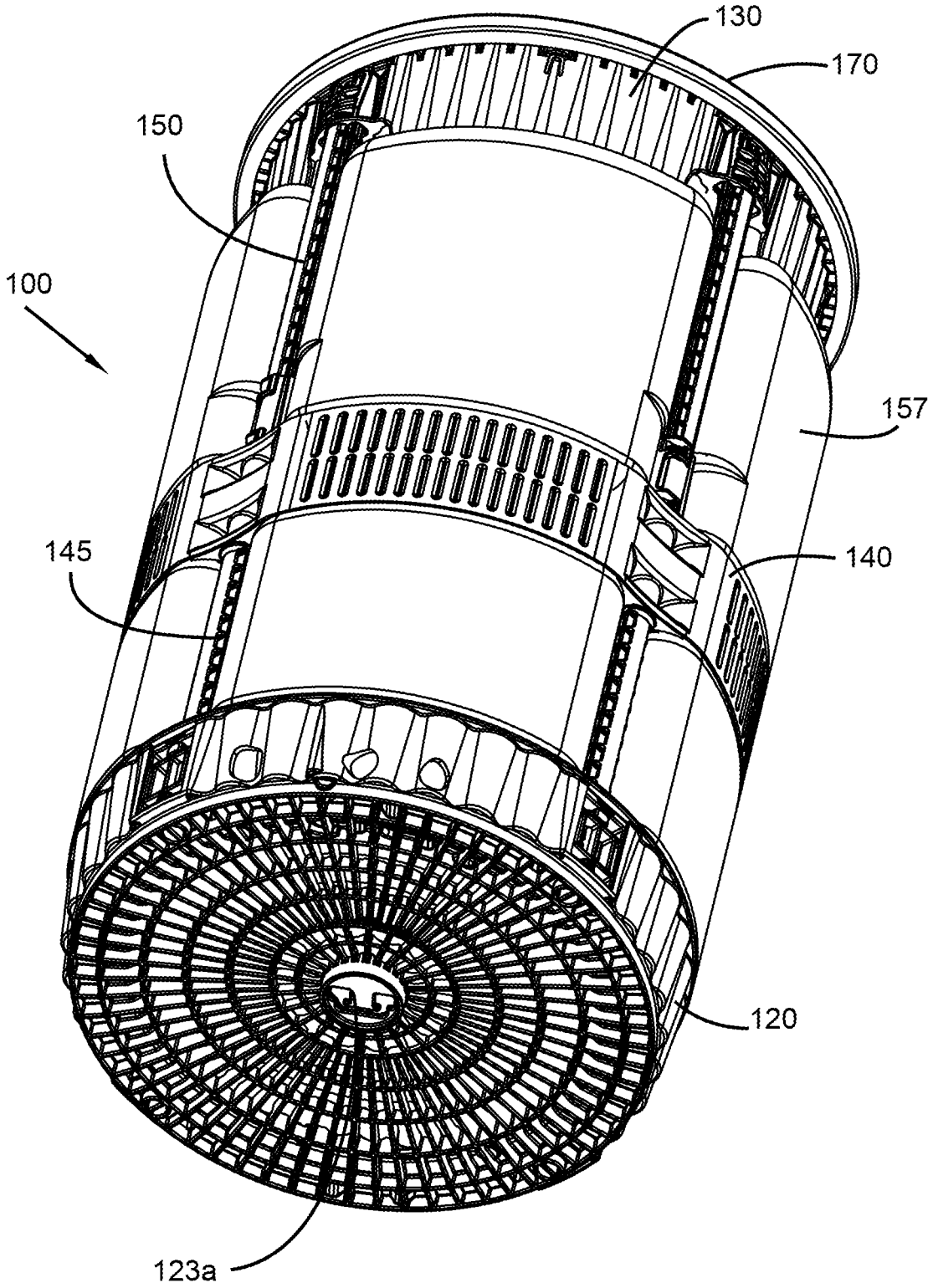
FIG. 31B is a diagrammatic bottom back perspective view of the container assembly of FIG. 29.

FIGS. 29, 31A, and 31B illustrate various views of the assembled bulk material container 100. While the selectable fabric weight zones of the sleeve/bag 157 are not illustrated in FIGS. 29, 31A or 31B, it will be understood that the selective fabric weight weaving principles discussed above apply to the illustrated sleeve/bag 157. While the selected fabric weights of the various sleeve zones can vary, when bulk containers of the type described in FIGS. 28-36 are used to contain liquid bulk materials the sleeve strengths of zone Z2 fabric may be, for example, from 5 oz.-6 oz./sq. yd., with lower fabric weights in those zones closer to the top of the container. Further, it will be noted that the illustrations of FIGS. 29, 31A and 31B are diagrammatic views that illustrate the sleeve/bag 157 as having various horizontal and vertical lines running across or along the sleeve material. Such lines are intended to show various curvatures of the sleeve/bag 157 material that might occur as a result of the outward radial forces that are applied to the sleeve/bag 157 by the bulk material being contained thereby. They do not represent any stitching or layering of the continuously woven sleeve/bag sidewall material.

Bulk material containers of the type described with reference to FIGS. 28-36, that are more in the nature of a drum configured container, may not require as much extra lower sleeve support than the larger bulk material containers previously described with reference to FIGS. 12-27. For the drum configured containers a selective weft yarn weaving along the entire longitudinal length of the sleeve could be used. In such case, the general selective weft weaving principles of this invention would still apply by selection of a weft thread weight for the weaving process, that is heavier/stronger than that of the warp thread, for weaving of the entire sleeve length.

A feature of all of the bulk material containers discussed herein is that they are collapsible both before and after use such that they are reusable and/or recyclable. When collapsed, they are configured to occupy a fraction of their sizes when operatively assembled to contain bulk materials. Such significant size reduction provides for economical transport of the collapsed containers back to a bulk material loading facility or to a storage facility for unassembled containers. In the case of those bulk material containers having foldable forming members engaged by an outer sleeve, such as discussed with respect to the containers of FIGS. 1-10 and 12-27, after the bulk material container is emptied, the container interlocking lower sidewall extension portions of the locking assembly can readily be separated and unfolded, allowing the sidewalls and locking assembly with overlying sleeve to be folded down to a flattened configuration that can be bundled with other disassembled containers for storage or shipment. Alternatively, after disassembly, the outer sleeve could also be slidably removed from the container's sidewalls, allowing the sidewall/locking assembly and sleeve materials to be completely recycled.

Figure 35:
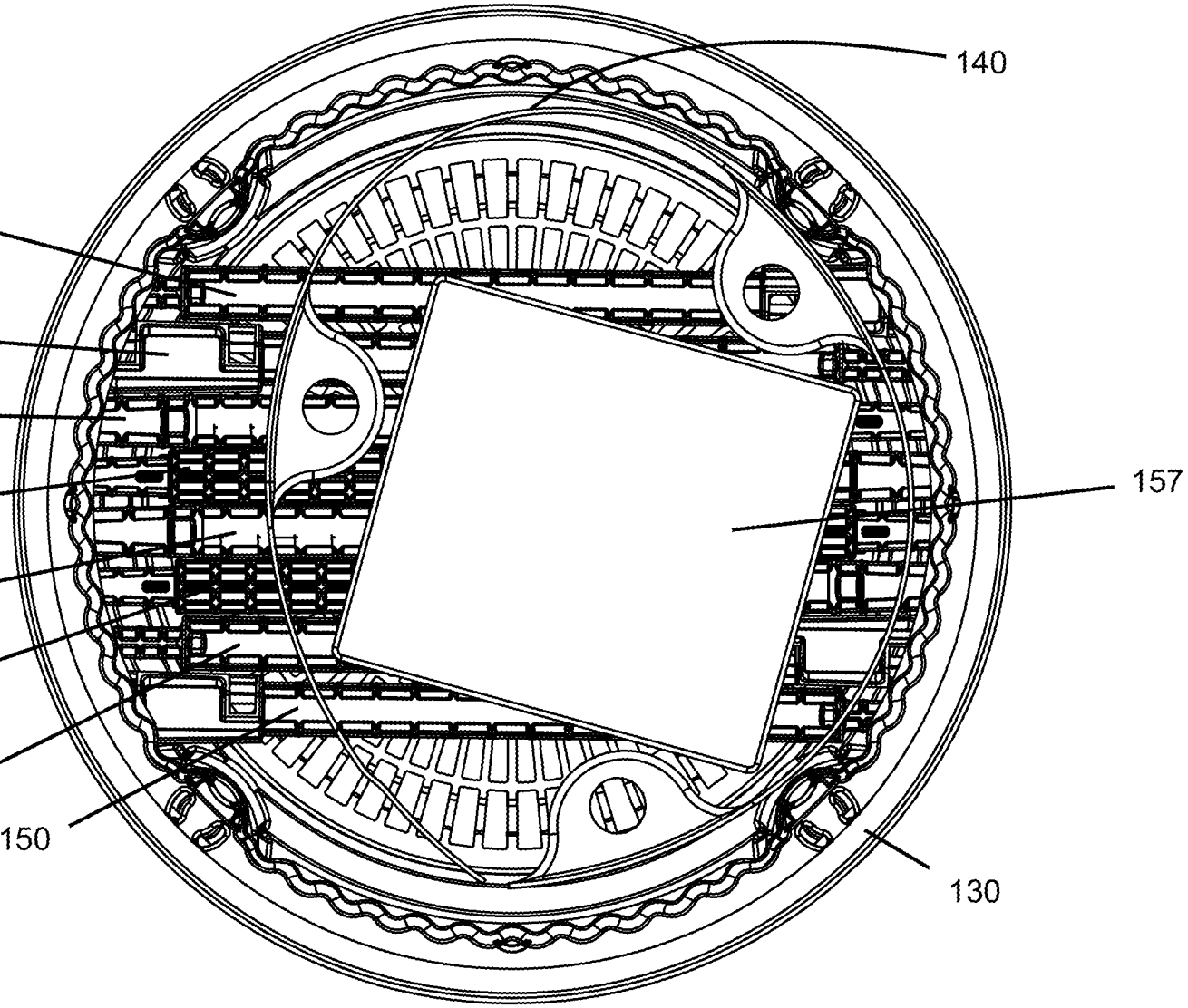
FIG. 35 is a diagrammatic top view of the container of FIG. 34 with the upper ring and lower base member portions connected together in collapsed configuration and also showing the intermediate band member and the folded woven sleeve/bag components packaged on top of the post members within the outer protective sheath formed by the base and upper ring portions of the container.

After emptying of the bulk material containers of the type described with respect to FIGS. 11 and 28-36, the tightening band 170 is loosened to allow removal of the top cover 160 and lifting of the sleeve/bag 157 from the forming member framework 110. The detachable components of the forming member framework 110 can then be readily disassembled by simple twisting unlocking motions. The upper 150 and lower 145 post members are disconnected from one another and from the lower base member 120, the upper ring member 130 and the intermediate band member 140. The disassembled parts of the collapsed bulk material container 100 can rapidly be collected and rearranged into a solid collapsed storage/transport configuration. The lengths of the upper and lower post members are sized when disassembled, to cooperatively snugly fit within and along the inner lower surface of the lower base member 120, as diagrammatically illustrated in FIG. 34. The upper ring member 130 is cooperatively configured to matingly engage the lower base member 120. The upper ring 130 is positioned in overlying manner with the lower base 140 such that the peripherally spaced upper post receptor portions 132 of the upper ring member 130 cooperatively align with operatively and engage the base member post receptor portions 124 of the lower base 120 to secure the upper ring member 130 to the underlying base member 120, to provide therewith an outer protective sheath for containing the post members, the intermediate ring member 140 and the sleeve/bag 157. FIG. 35 shows the interconnected upper ring and lower base configuration with secured disassembled post members and the intermediate band member 140 bent to lie on top of the post members and within the lower base member as well as the sleeve/bag 157 folded to overlie the post members within the protective sheath of the collapsed container.

Figure 36:
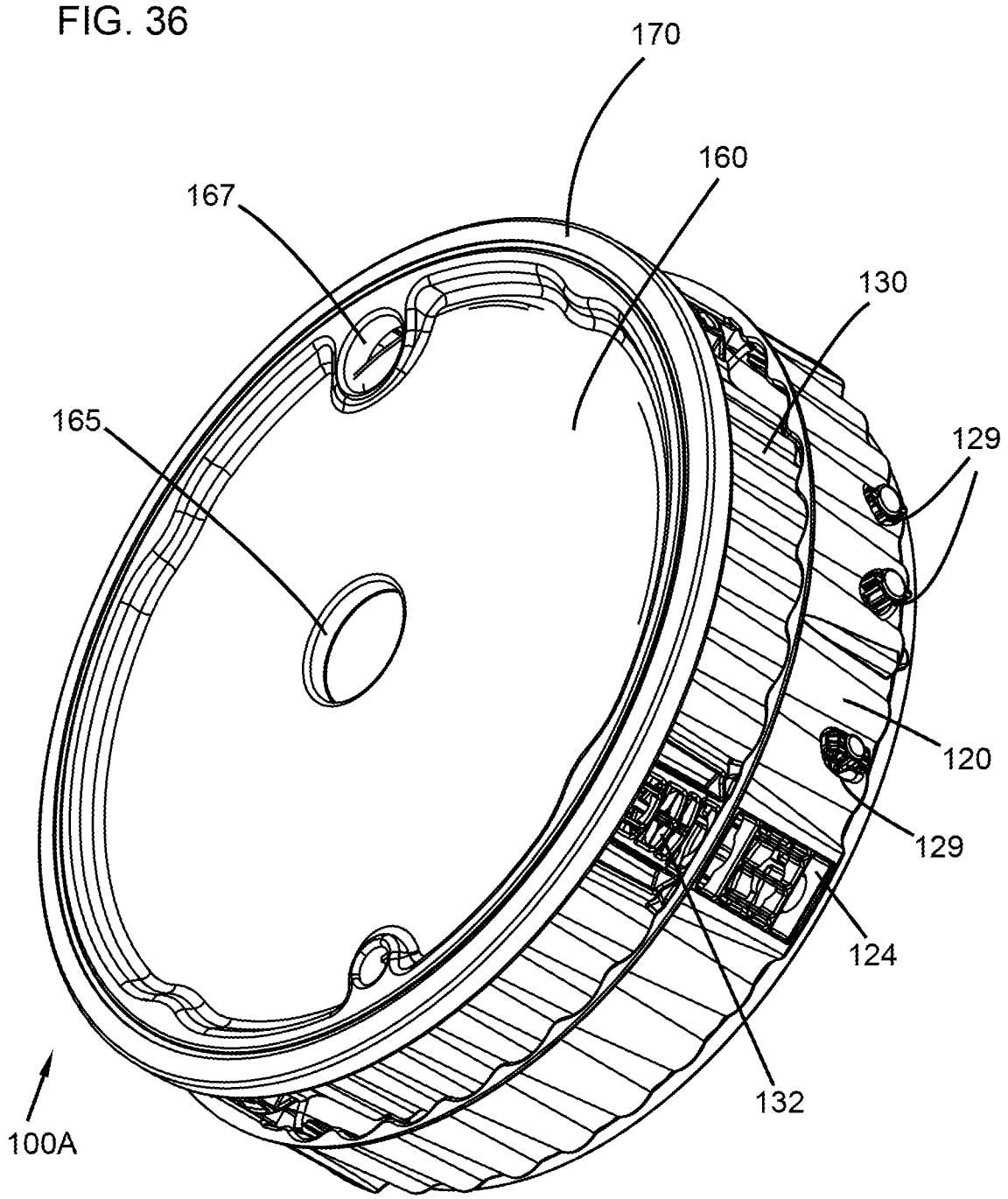
FIG. 36 is a top, side perspective view showing the container assembly of FIG. 35 in collapsed modular configuration with attached upper cover and tightening band, as it would appear for storage or transport.

The collapsed container is completed by resecuring the top cover 160 to the upper ring member 130 by the tightening band 170 to complete the collapsed container with disassembled bulk material container parts therein, as illustrated at 100A in FIG. 36. The assembled collapsed container is configured to be matably stacked upon other collapsed container units of like construction, for ease of storage and/or transport.

For more detailed explanations of other container configuration embodiments and further details regarding the materials, construction and details of interconnecting portions of the container described with respect to FIGS. 11 and 28-36, those skilled in the art are referred to the fully incorporated U.S. Pat. No. 9,296,511 and other referenced Patents referred to herein. It will be appreciated by those skilled in the art that all of the bulk material container embodiments illustrated and described herein are only illustrative of many other such bulk material container configurations that can be designed to meet the myriad of specific container needs found in the industry.

This specification provides several examples of embodiments of bulk material containers incorporating the principles of this invention. Other embodiments of the invention can be made without departing from the spirit and scope of the invention, which reside in the claims hereinafter appended.

What is claimed is:

1. A support sleeve of continuously woven fabric material for providing primary containment strength to a collapsible bulk material container of a type having a forming member surface portion arranged and configured to provide the container with a desired rigidity and shape, and to form an internal geometric volumetric cavity for receiving the bulk material to be contained by the container; said sleeve comprising:

(a) a sleeve of fabric material defining a tube having an open top that terminates at an upper edge and an open bottom that terminates in a lower edge having a sleeve length longitudinally extending between the upper and the lower edges that is sized to substantially engage the forming member surface portion that forms the internal cavity of the bulk material container;

(b) said sleeve fabric being seamless and continuously woven from longitudinally extending warp threads of a uniform weight and strength, intertwined with weft threads woven generally perpendicularly to the warp threads and having selectively varying weights and strengths;

(c) said sleeve having a plurality of contiguous fabric zones of selectable fabric weights and strengths along said sleeve length, wherein said fabric zones have width dimensions measured in the longitudinal sleeve length direction; wherein the fabric weights of at least a first zone adjacent the upper edge of the sleeve and a second zone positioned below and adjacent the first zone differ from each other; and (d) wherein the collective sleeve fabric zone weights are selected and arranged to sufficiently counter radial forces applied by contained bulk material of the bulk material container for which the sleeve is designed to provide strength support.

2. The support sleeve as recited in claim 1, wherein said sleeve includes a third zone adjacent and below the second zone, wherein the weft threads in the second zone are stronger than the weft threads in the first zone.

3. The support sleeve as recited in claim 2, wherein the sleeve length includes a lower extension portion that is sized to extend below a lower edge of the container forming member surface portion that defines the bulk material containment cavity, wherein the lower extension portion is intended in use to be folded inwardly along a bottom portion of the container.

4. The support sleeve as recited in claim 3, wherein the lower sleeve extension portion includes fastener portions for securing the sleeve lower extension portion to the bottom portion of the container.

5. The support sleeve as recited in claim 3, wherein the width of said fabric zone extending up from said lower edge of said sleeve is at least from about 20% to 50% of the total longitudinal length of the sleeve.

6. The support sleeve as recited in claim 1, wherein said woven fabric of said sleeve comprises polypropylene material.

7. The support sleeve as recited in claim 1, wherein said support sleeve has an initial inner circumference dimension; wherein said sleeve further has at least one longitudinally extending circumference adjustment tail formed by said continuous sleeve material, extending along said sleeve length; said adjustment tail being formed by a bonding strip extending along one longitudinal edge of said sleeve when in a flattened configuration with opposed inner surfaces of said sleeve engaging one another in face to face relationship with said bonding strip fixedly bonding said opposed engaged inner surfaces of said sleeve to one another to accurately define an adjusted inner circumference dimension of said sleeve that is less than said initial sleeve inner circumference dimension.

8. The support sleeve as recited in claim 7, further including a plurality of said adjustment tails laterally spaced across the sleeve and generally parallel to one another.

9. The support sleeve as recited in claim 1, wherein said sleeve includes a third zone adjacent and below the second zone, wherein the weft threads in the second zone are stronger than the weft threads in the third zone.

10. The support sleeve as recited in claim 1, wherein the same warp threads extend from the first zone to the second zone.

11. The support sleeve as recited in claim 1, wherein the sleeve includes a plurality of circumferentially spaced slits adjacent the lower edge.

* * * * *